US009606473B2

(12) United States Patent
Mushika et al.

(10) Patent No.: US 9,606,473 B2
(45) Date of Patent: Mar. 28, 2017

(54) CARTRIDGE HAVING DETECTED MEMBER

(71) Applicant: Brother Kogyo Kabushiki Kaisha, Nagoya-shi, Aichi-ken (JP)

(72) Inventors: Motoaki Mushika, Hashima (JP); Yasuo Fukamachi, Nagoya (JP); Kazuna Taguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/670,489

(22) Filed: Mar. 27, 2015

(65) Prior Publication Data

US 2015/0277281 A1 Oct. 1, 2015

(30) Foreign Application Priority Data

Mar. 31, 2014 (JP) ..... 2014-074727

(51) Int. Cl.

| | |
|---|---|
| ***G03G 15/00*** | (2006.01) |
| ***G03G 15/08*** | (2006.01) |
| ***G03G 21/18*** | (2006.01) |
| ***G03G 21/16*** | (2006.01) |

(52) U.S. Cl.

CPC ..... *G03G 15/0865* (2013.01); *G03G 21/1647* (2013.01); *G03G 21/1896* (2013.01); *G03G 2221/1657* (2013.01)

(58) Field of Classification Search

CPC ..... G03G 15/0865; G03G 15/0863; G03G 21/1857; G03G 21/1875; G03G 21/1647; G03G 21/1896; G03G 2221/1657

USPC ..... 399/12, 262, 119, 120

See application file for complete search history.

(56) References Cited

U.S. PATENT DOCUMENTS

| | | | |
|---|---|---|---|
| 4,974,020 | A | 11/1990 | Takamatsu et al. |
| 5,053,816 | A | 10/1991 | Takahashi |
| 5,489,976 | A | 2/1996 | Ichikawa |
| 5,495,323 | A | 2/1996 | Meetze, Jr. |
| 5,495,327 | A | 2/1996 | Inomata |
| 5,640,651 | A | 6/1997 | Katoh et al. |

(Continued)

FOREIGN PATENT DOCUMENTS

| | | | |
|---|---|---|---|
| AU | 2010281279 | B2 | 2/2014 |
| CN | 1445624 | A | 10/2003 |

(Continued)

OTHER PUBLICATIONS

Feb. 27, 2014—(KR) Notice of Preliminary Rejection—App 10-2012-7028457.

(Continued)

*Primary Examiner* — Sophia S Chen
(74) *Attorney, Agent, or Firm* — Banner & Witcoff, Ltd.

(57) ABSTRACT

A cartridge including a housing configured to accommodate therein developer, a driving receiving part configured to rotate by receiving a driving force, a rotary member configured to rotate from a first position by receiving a driving force from the driving receiving part, and a detected member including a detected part and configured to move in an axis direction parallel with a rotational axis of the rotary member while being restrained from rotating, by receiving a driving force from the rotary member, wherein the detected member includes a first restraint part configured to restrain the rotation of the rotary member at the first position.

20 Claims, 23 Drawing Sheets

(56) References Cited

U.S. PATENT DOCUMENTS

| | | | |
|---|---|---|---|
| 5,649,264 | A | 7/1997 | Domon et al. |
| 5,970,293 | A | 10/1999 | Huang |
| 6,088,561 | A | 7/2000 | Kawamura et al. |
| 6,154,619 | A | 11/2000 | Boockholdt et al. |
| 6,714,224 | B2 | 3/2004 | Yamanaka et al. |
| 6,792,217 | B2 | 9/2004 | Nishino et al. |
| 6,823,160 | B2 | 11/2004 | Okabe |
| 6,829,465 | B2 | 12/2004 | Yamanaka et al. |
| 6,903,759 | B2 | 6/2005 | Yamanaka et al. |
| 6,909,866 | B2 | 6/2005 | Kawai |
| 6,920,303 | B2 | 7/2005 | Yamanaka et al. |
| 7,116,919 | B2 | 10/2006 | Ishii |
| 7,130,551 | B2 | 10/2006 | Kobayashi |
| 7,418,214 | B2 | 8/2008 | Yoshida et al. |
| 7,463,834 | B2 | 12/2008 | Takagi et al. |
| 7,509,075 | B2 | 3/2009 | Hayakawa |
| 7,512,347 | B2 | 3/2009 | Suzuki et al. |
| 7,536,117 | B2 | 5/2009 | Kishi |
| 7,613,414 | B2 | 11/2009 | Kamimura |
| 7,643,777 | B2 | 1/2010 | Matsumoto et al. |
| 7,756,426 | B2 | 7/2010 | Kamimura |
| 7,933,536 | B2 | 4/2011 | Ogawa |
| 7,953,330 | B2 | 5/2011 | Ishikawa |
| 8,010,026 | B2 | 8/2011 | Kobayashi et al. |
| RE42,796 | E | 10/2011 | Ishii |
| 8,090,272 | B2 | 1/2012 | Ishikawa |
| 8,099,025 | B2 | 1/2012 | Ishikake |
| 8,126,366 | B2 | 2/2012 | Hattori |
| 8,417,130 | B2 | 4/2013 | Hashimoto |
| 8,463,145 | B2 | 6/2013 | Ukai et al. |
| 8,583,009 | B2 | 11/2013 | Takagi |
| 8,600,244 | B2 | 12/2013 | Hashimoto |
| 8,620,180 | B2 | 12/2013 | Shiraki et al. |
| 8,666,293 | B2 | 3/2014 | Mushika et al. |
| 8,744,288 | B2 | 6/2014 | Shinoya et al. |
| 8,761,643 | B2 | 6/2014 | Mushika et al. |
| 8,849,133 | B2 | 9/2014 | Itabashi et al. |
| 8,867,932 | B2 | 10/2014 | Ukai et al. |
| 8,948,617 | B2 | 2/2015 | Shiraki et al. |
| 8,948,661 | B2 | 2/2015 | Mushika et al. |
| 9,195,207 | B2 | 11/2015 | Itabashi |
| 9,207,567 | B2 | 12/2015 | Mushika et al. |
| 2003/0185579 | A1 | 10/2003 | Nishino et al. |
| 2003/0185594 | A1 | 10/2003 | Okabe |
| 2003/0215265 | A1 | 11/2003 | Kawai |
| 2006/0034625 | A1 | 2/2006 | Kajikawa |
| 2006/0104670 | A1 | 5/2006 | Nishitani et al. |
| 2006/0165423 | A1 | 7/2006 | Nishitani et al. |
| 2006/0171737 | A1 | 8/2006 | Nishimura et al. |
| 2006/0193643 | A1 | 8/2006 | Takagi et al. |
| 2006/0193646 | A1 | 8/2006 | Suzuki et al. |
| 2006/0245787 | A1 | 11/2006 | Ito et al. |
| 2007/0031158 | A1 | 2/2007 | Kamimura |
| 2007/0041747 | A1 | 2/2007 | Kim et al. |
| 2007/0059018 | A1 | 3/2007 | Tokuda |
| 2007/0059038 | A1 | 3/2007 | Shiraki |
| 2007/0077101 | A1 | 4/2007 | Tamura et al. |
| 2007/0122165 | A1 | 5/2007 | Igarashi et al. |
| 2007/0140709 | A1 | 6/2007 | Yoshida et al. |
| 2007/0140725 | A1 | 6/2007 | Kamimura |
| 2007/0253748 | A1 | 11/2007 | Matsumoto et al. |
| 2008/0080904 | A1 | 4/2008 | Murayama et al. |
| 2008/0205911 | A1 | 8/2008 | Ishikawa et al. |
| 2008/0205928 | A1 | 8/2008 | Ishikawa |
| 2008/0205931 | A1 | 8/2008 | Ishikawa |
| 2008/0223173 | A1 | 9/2008 | Ishikawa |
| 2008/0317509 | A1 | 12/2008 | Mori |
| 2009/0000423 | A1 | 1/2009 | Ishikawa et al. |
| 2009/0052911 | A1 | 2/2009 | Richey et al. |
| 2009/0084210 | A1 | 4/2009 | Tsukada et al. |
| 2009/0169247 | A1 | 7/2009 | Hattori |
| 2009/0257782 | A1 | 10/2009 | Ishikake |
| 2009/0269085 | A1 | 10/2009 | Ukai |
| 2009/0269086 | A1 | 10/2009 | Mikuni |
| 2009/0285604 | A1 | 11/2009 | Nakajima |
| 2009/0297226 | A1 | 12/2009 | Nagashima et al. |
| 2010/0054763 | A1 | 3/2010 | Tomiyori et al. |
| 2010/0209144 | A1 | 8/2010 | Nieda |
| 2011/0023368 | A1 | 2/2011 | Mizutani et al. |
| 2011/0038649 | A1 | 2/2011 | Miyabe et al. |
| 2011/0081163 | A1 | 4/2011 | Lee |
| 2011/0123231 | A1 | 5/2011 | Ozawa et al. |
| 2011/0236062 | A1 | 9/2011 | Takagi |
| 2011/0236065 | A1 | 9/2011 | Takagi |
| 2011/0236066 | A1 | 9/2011 | Takagi |
| 2011/0243578 | A1 | 10/2011 | Ukai et al. |
| 2012/0014713 | A1 | 1/2012 | Murakami et al. |
| 2012/0051795 | A1 | 3/2012 | Mushika et al. |
| 2012/0057905 | A1 | 3/2012 | Itabashi |
| 2012/0134688 | A1 | 5/2012 | Hashimoto |
| 2012/0148297 | A1 | 6/2012 | Peng et al. |
| 2012/0177398 | A1 | 7/2012 | Takigawa |
| 2012/0243882 | A1 | 9/2012 | Carot |
| 2012/0251165 | A1 | 10/2012 | Mushika et al. |
| 2012/0251216 | A1 | 10/2012 | Mushika |
| 2012/0321345 | A1 | 12/2012 | Shinoya et al. |
| 2013/0051813 | A1 | 2/2013 | Itabashi et al. |
| 2013/0051814 | A1* | 2/2013 | Itabashi ..... G03G 21/1857 399/12 |
| 2013/0051815 | A1 | 2/2013 | Itabashi et al. |
| 2013/0051816 | A1 | 2/2013 | Itabashi |
| 2013/0051833 | A1 | 2/2013 | Itabashi et al. |
| 2013/0084083 | A1 | 4/2013 | Itabashi et al. |
| 2013/0136460 | A1 | 5/2013 | Shiraki et al. |
| 2013/0170844 | A1 | 7/2013 | Itabashi |
| 2013/0170845 | A1 | 7/2013 | Itabashi |
| 2013/0259528 | A1 | 10/2013 | Yamamoto |
| 2013/0272724 | A1 | 10/2013 | Ukai et al. |
| 2014/0020489 | A1 | 1/2014 | Nozaki et al. |
| 2014/0086638 | A1 | 3/2014 | Sato |
| 2014/0169835 | A1 | 6/2014 | Nakajima |
| 2014/0219690 | A1 | 8/2014 | Li et al. |
| 2014/0294403 | A1 | 10/2014 | Shimizu |
| 2014/0341617 | A1 | 11/2014 | Mushika et al. |
| 2014/0363189 | A1 | 12/2014 | Hashimoto et al. |
| 2014/0376968 | A1 | 12/2014 | Yamamoto et al. |
| 2015/0000443 | A1 | 1/2015 | Shimizu |
| 2015/0003844 | A1 | 1/2015 | Ukai et al. |
| 2015/0005134 | A1 | 1/2015 | Shimizu |
| 2015/0010334 | A1 | 1/2015 | Nakajima |
| 2015/0037071 | A1 | 2/2015 | Yamamoto |
| 2015/0043944 | A1 | 2/2015 | Yamamoto |
| 2015/0104222 | A1 | 4/2015 | Mushika et al. |
| 2015/0117873 | A1 | 4/2015 | Mori et al. |
| 2015/0117906 | A1 | 4/2015 | Mori |
| 2015/0153675 | A1 | 6/2015 | Itabashi et al. |

FOREIGN PATENT DOCUMENTS

| | | | |
|---|---|---|---|
| CN | 1828447 | A | 9/2006 |
| CN | 1288515 | C | 12/2006 |
| CN | 2884266 | Y | 3/2007 |
| CN | 1983078 | A | 6/2007 |
| CN | 101063855 | A | 10/2007 |
| CN | 200962188 | Y | 10/2007 |
| CN | 101256379 | A | 9/2008 |
| CN | 101295157 | A | 10/2008 |
| CN | 201170840 | Y | 12/2008 |
| CN | 100476636 | C | 4/2009 |
| CN | 201222170 | Y | 4/2009 |
| CN | 101625537 | B | 1/2010 |
| CN | 201402371 | Y | 2/2010 |
| CN | 201464807 | U | 5/2010 |
| CN | 201489284 | U | 5/2010 |
| CN | 202102251 | U | 1/2012 |
| CN | 202472249 | U | 10/2012 |
| CN | 102799090 | A | 11/2012 |
| CN | 202649679 | U | 1/2013 |
| CN | 203673223 | U | 6/2014 |
| EP | 0838733 | A2 | 4/1998 |
| EP | 1696278 | A2 | 8/2006 |
| EP | 1696278 | A3 | 8/2006 |
| EP | 1965268 | A1 | 9/2008 |
| EP | 1965274 | A2 | 9/2008 |

(56) References Cited

FOREIGN PATENT DOCUMENTS

| | | | |
|---|---|---|---|
| EP | 1995644 | A2 | 11/2008 |
| EP | 2093619 | A1 | 8/2009 |
| EP | 2369422 | A1 | 9/2011 |
| EP | 2378378 | A2 | 10/2011 |
| EP | 2463723 | A1 | 6/2012 |
| EP | 2463723 | A4 | 6/2012 |
| EP | 2574991 | A2 | 4/2013 |
| EP | 2574992 | A2 | 4/2013 |
| EP | 2574993 | A2 | 4/2013 |
| HK | 1090991 | A1 | 11/2009 |
| JP | 55323696 | U | 2/1978 |
| JP | S6183570 | A | 4/1986 |
| JP | 563-118042 | U | 7/1988 |
| JP | H01205175 | A | 8/1989 |
| JP | H02-78949 | U | 6/1990 |
| JP | H02-262168 | A | 10/1990 |
| JP | H03-212656 | A | 9/1991 |
| JP | H04-31156 | A | 2/1992 |
| JP | H04-31156 | U | 3/1992 |
| JP | H04-191773 | A | 7/1992 |
| JP | H04-112263 | U | 9/1992 |
| JP | H04-114057 | U | 10/1992 |
| JP | 5323696 | B2 | 12/1993 |
| JP | 06-208301 | A | 7/1994 |
| JP | H07-140776 | A | 6/1995 |
| JP | H07-281519 | | 10/1995 |
| JP | H08-179608 | A | 7/1996 |
| JP | H08-248838 | A | 9/1996 |
| JP | H09160466 | A | 6/1997 |
| JP | H09222783 | A | 8/1997 |
| JP | 2551714 | Y2 | 10/1997 |
| JP | H09-258634 | A | 10/1997 |
| JP | H10-301382 | A | 11/1998 |
| JP | H11-37169 | A | 2/1999 |
| JP | H11-52716 | A | 2/1999 |
| JP | 2000338760 | A | 12/2000 |
| JP | 2001-042585 | A | 2/2001 |
| JP | 2001-166648 | A | 6/2001 |
| JP | 3266779 | B2 | 3/2002 |
| JP | 2002-169449 | A | 6/2002 |
| JP | 2003-271039 | A | 9/2003 |
| JP | 2003295614 | A | 10/2003 |
| JP | 2003-337504 | A | 11/2003 |
| JP | 2004-045603 | B2 | 2/2004 |
| JP | 2005-241942 | A | 9/2005 |
| JP | 3710375 | B2 | 10/2005 |
| JP | 2006-235236 | A | 9/2006 |
| JP | 2006-243072 | A | 9/2006 |
| JP | 2006-267994 | A | 10/2006 |
| JP | 2007-079284 | A | 3/2007 |
| JP | 2007-164095 | A | 6/2007 |
| JP | 2007-199514 | A | 8/2007 |
| JP | 2008-089731 | A | 4/2008 |
| JP | 2008-216391 | A | 9/2008 |
| JP | 2008-216392 | A | 9/2008 |
| JP | 2008-216393 | A | 9/2008 |
| JP | 2008-216394 | A | 9/2008 |
| JP | 2008216919 | A | 9/2008 |
| JP | 2008299123 | A | 12/2008 |
| JP | 2008299124 | A | 12/2008 |
| JP | 2008299125 | A | 12/2008 |
| JP | 2009069177 | A | 4/2009 |
| JP | 2009-162915 | A | 7/2009 |
| JP | 2009-180983 | A | 8/2009 |
| JP | 4310703 | B2 | 8/2009 |
| JP | 2009-223017 | A | 10/2009 |
| JP | 2009-244560 | A | 10/2009 |
| JP | 2009244563 | A | 10/2009 |
| JP | 2009-276727 | A | 11/2009 |
| JP | 4372703 | B2 | 11/2009 |
| JP | 2009-282099 | A | 12/2009 |
| JP | 2009-288549 | A | 12/2009 |
| JP | 4376861 | B2 | 12/2009 |
| JP | 2011-013323 | A | 1/2011 |
| JP | 3167011 | U | 3/2011 |
| JP | 2011-215374 | A | 10/2011 |
| JP | 4859139 | B2 | 1/2012 |
| JP | 2012-053095 | A | 3/2012 |
| JP | 2012-108537 | A | 6/2012 |
| JP | 2012-194318 | A | 10/2012 |
| JP | 2012-212086 | A | 11/2012 |
| JP | 2012-233941 | A | 11/2012 |
| JP | 2013-011911 | A | 1/2013 |
| JP | 2013501253 | A | 1/2013 |
| JP | 2013054063 | A | 3/2013 |
| RU | 2011138921 | A | 9/2013 |
| WO | 2007062588 | A1 | 6/2007 |
| WO | 20111015051 | A1 | 2/2011 |
| WO | 2013040989 | A | 3/2013 |
| WO | 2013073134 | A1 | 5/2013 |

OTHER PUBLICATIONS

Machine translation of JP 2006-235236 dated Jan. 9, 2014.
Jan. 5, 2012—(JP) Decision of Patent Grant—App 2010-083408.
Apr. 26, 2011—(WO) International Search Report (JPO)—App PCT/JP2011/057946.
Nov. 12, 2014—(US) Non-Final Office Action—U.S. Appl. No. 14/485,462.
Dec. 31, 2014—(CN) Notification of First Office Action—App 201310175410.5, Eng Tran.
Mar. 20, 2015—(US) Final Office Action—U.S. Appl. No. 14/485,462.
Mar. 27, 2015—(US) Co-pending U.S. Appl. No. 14/670,502.
Mar. 27, 2015—(US) Co-pending U.S. Appl. No. 14/670,676.
Decision to Grant a Patent issued in corresponding Japanese Patent Application No. 2010-193204 dated Sep. 18, 2012.
Notice of Reasons for Rejection issued in Japanese Patent Application No. 2012-229560 mailed Feb. 19, 2013
Machine translation of JP 07-281519A dated May 2, 2013.
Machine translation of JP 10-031382A dated May 1, 2013.
Notice of Allowance received in U.S. Appl. No. 13/222,096 mailed Oct. 16, 2013.
Office Action received in related Chinese Patent Application No. 201110251898.6 mailed Oct. 15, 2013.
Notification of the First Office Action with Search Report issued in corresponding Chinese Patent Application No. 201110251898.6 dated Dec. 11, 2012.
Notice of Reasons for Rejection issued in corresponding Japanese Patent Application 2010-193204 mailed Jun. 26, 2012.
Notice of Allowance issued in corresponding U.S. Appl. No. 14/154,521 mailed Feb. 10, 2014.
Sep. 19, 2014—(US) Notice of Allowance—U.S. Appl. No. 14/275,251.
Mar. 19, 2015—(US) Non-Final Office Action—U.S. Appl. No. 14/577,396.
Co-pending U.S. Appl. No. 14/316,959, filed Jun. 27, 2014.
Co-Pending U.S. Appl. No. 14/316,971, filed Jun. 27, 2014.
Apr. 6, 2015—(US) Non-Final Office Action—U.S. Appl. No. 14/316,959.
Apr. 21, 2015—(EP) Extended Search Report—App 14173865.8.
May 8, 2015—(US) Ex Parte Quayle—U.S. Appl. No. 14/316,971.
Mar. 3, 2015—(CN) Notification of First Office Action—App 201310175264.6, Eng Tran.
Mar. 3, 2015—(CN) Notification of First Office Action—App 201310175229.4, Eng Tran.
Aug. 20, 2015—(EP) Extended EP Search Report in App No. 15161221.5.
Aug. 21, 2015 (EP) Extended EP Search Report—App. No. 15161258.7.
Sep. 17, 2015—(EP) Office Action—App 11160291.8.
Oct. 19, 2015—(US) Non-Final Office Action—U.S. Appl. No. 14/611,393.
Oct. 28, 2015—(US) Notice of Allowance—U.S. Appl. No. 14/316,959.
Nov. 27, 2015—(US) Non-Final Office Action—U.S. Appl. No. 14/670,502.

(56) References Cited

OTHER PUBLICATIONS

Dec. 14, 2015—(US) Non-Final Office Action—U.S. Appl. No. 14/926,345.
Dec. 17, 2015—(US) Non-Final Office Action—U.S. Appl. No. 14/670,676.
Jan. 20, 2016—(US) Notice of Allowance—U.S. Appl. No. 14/316,971.
Jan. 21, 2016—(US) Notice of Allowance—U.S. Appl. No. 14/485,462.
Aug. 19, 2015—(US) Non-Final Office Action—U.S. Appl. No. 14/589,696.
Sep. 16, 2013—(US) Non-final office action—U.S. Appl. No. 13/431,077.
Sep. 6, 2013—(CN) Office Action—App 201210083604.8.
Mar. 27, 2014—(US) Notice of Allowance—U.S. Appl. No. 13/431,077.
May 1, 2015—(US) Non-Final Office Action—U.S. Appl. No. 14/491,157.
Dec. 24, 2015—(US) Notice of Allowance—U.S. Appl. No. 14/491,157.
Sep. 30, 2013—(CN) Office Action—App 201210083716.3.
Nov. 19, 2013—(JP) Office Action—App 2013-103770.
Jan. 8, 2014—(US) Notice of Allowance—U.S. Appl. No. 13/430,950.
May 27, 2014—(EP) Extended Search Report—App 12161226.1.
Feb. 4, 2015—(US) Notice of Allowance—U.S. Appl. No. 14/289,780.
Jan. 20, 2015—(JP) Notification of Reasons for Refusal—App 2014-042421, Eng Tran.
Jul. 16, 2012—(EP ) Search Report—App 12157690.4.
Feb. 19, 2014—(US) Notice of Allowance—U.S. Appl. No. 13/431,074.
Jun. 19, 2014—(US) Non-final office action—U.S. Appl. No. 14/290,188.
Oct. 7, 2014—(US) Notice of Allowance—U.S. Appl. No. 14/290,188.
Mar. 5, 2014—(CN) Office Action—App 201210324350.4
Apr. 14, 2014 (US) Non-Final Office Action in U.S. Appl. No. 13/628,492.
Sep. 23, 2014—(US) Notice of Allowance—U.S. Appl. No. 13/628,492.
May 18, 2015—(US) Non-Final Office Action—U.S. Appl. No. 14/611,393.
Apr. 15, 2015—(US) Notice of Allowance—U.S. Appl. No. 14/529,221.
Jul. 22, 2015—(US) Non-Final Office Action—U.S. Appl. No. 14/316,971.
Aug. 4, 2015—(US) Notice of Allowance—U.S. Appl. No. 14/577,396.
Aug. 25, 2015—(US) Non-Final Office Action—U.S. Appl. No. 14/671,413.
Sep. 16, 2015—(US) Notice of Allowance—U.S. Appl. No. 14/485,462.
Sep. 17, 2015—(EP) Office Action—App 11179283.4.
Sep. 23, 2015—(US) Notice of Allowance—U.S. Appl. No. 14/529,221.
Sep. 30, 2015—(US) Non-Final Office Action—U.S. Appl. No. 14/670,522.
Oct. 5, 2015—(US) Non-Final Office Action—U.S. Appl. No. 14/670,801.
Feb. 25, 2016—(US) Non-Final Office Action—U.S. Appl. No. 14/316,959.
Feb. 8, 2016—(EP) Extended European Search Report—App 15161221.5.
Sep. 23, 2015—(EP) Extended European Search Report—App 15161223.1.
Sep. 23, 2015—(EP) Extended European Search Report—App 15161224.9.
Sep. 25, 2015—(EP) Extended European Search Report—App 15161229.8.
Sep. 29, 2015—(EP) Extended European Search Report—App 15161242.1.
Apr. 1, 2016—(US) Notice of Allowance—U.S. Appl. No. 14/926,345.
Apr. 12, 2016—(US) Notice of Allowance—U.S. Appl. No. 14/611,393.
Apr. 14, 2016—(US) Notice of Allowance—U.S. Appl. No. 14/670,522.
Apr. 26, 2016—(US) Non-Final Office Action—U.S. Appl. No. 15/079,829.
Feb. 2, 2016—(US) Notice of Allowance—U.S. Appl. No. 14/670,516.
Feb. 17, 2016—(US) Notice of Allowance—U.S. Appl. No. 14/671,413.
Feb. 18, 2016—(US) Notice of Allowance—U.S. Appl. No. 14/529,221.
Mar. 4, 2016—(US) Notice of Allowance—U.S. Appl. No. 14/491,157.
Mar. 29, 2016—(US) Notice of Allowance—U.S. Appl. No. 14/485,462.
May 24, 2016—(US) Notice of Allowance—U.S. Appl. No. 14/485,462.
May 27, 2016—(US) Notice of Allowance—U.S. Appl. No. 14/671,413.
Jun. 10, 2016—(US) Notice of Allowance—U.S. Appl. No. 14/316,971.
Jun. 17, 2016—(US) Notice of Allowance—U.S. Appl. No. 14/926,345.
Jun. 17, 2016—(US) Notice of Allowance—U.S. Appl. No. 14/491,157.
Jun. 22, 2016—(US) Notice of Allowance—U.S. Appl. No. 14/670,516.
May 24, 2016—(EP) Communication—App 12157679.7.
Sep. 14, 2015—(EP) Communication—App 12157679.7.
May 24, 2016—(EP) Communication—App 12157690.4.
Sep. 11, 2015—(EP) Communication—App 12157690.4.
Jul. 16, 2012—(EP) Search Report 12157679.7.
Jun. 22, 2016—(US) Notice of Allowance—U.S. Appl. No. 14/529,221.
Apr. 16, 2013 (JP) Notice of Allowance—App. 2011100507, (Date of drafting: Apr. 11, 2013).
Feb. 17, 2015 (JP) Notice of Allowance—App. 2011078637, (Date of drafting: Feb. 9, 2015).
May 11, 2016—(EP) Communication—App 12161226.1.
Jun. 29, 2016—(US) Notice of Allowance—U.S. Appl. No. 14/611,393.
Jul. 11, 2016—(US) Non-Final Office Action—U.S. Appl. No. 14/670,502.
Jul. 14, 2016—(US) Notice of Allowance—U.S. Appl. No. 14/670,676.
Jul. 15, 2016—(US) Notice of Allowance—U.S. Appl. No. 14/670,522.
Aug. 1, 2016—(US) Notice of Allowance—U.S. Appl. No. 14/670,516.
Aug. 9, 2016—(US) Notice of Allowance—U.S. Appl. No. 15/079,829.
Sep. 12, 2016—(US) Notice of Allowance—U.S. Appl. No. 14/589,696.
Sep. 28, 2016—(US) Notice of Allowance—U.S. Appl. No. 14/670,801.
Nov. 22, 2016—(JP) Office Action—App 2013137422—Eng Tran.
Dec. 13, 2016—(JP) Office Action—App 2014000609—Eng Tran.
Dec. 13, 2016—(JP) Office Action—App 2013137425—Eng Tran.
Dec. 12, 2016—(JP) Office Action—App 2014074727—Eng Tran.
Dec. 27, 2016—(JP) Office Action—App 2014074728—Eng Tran.
Dec. 27, 2016—(JP) Office Action—App 2014074729—Eng Tran.
Dec. 27, 2016—(JP) Office Action—App 2014074730—Eng Tran.

* cited by examiner

52D(52)

52D(52)

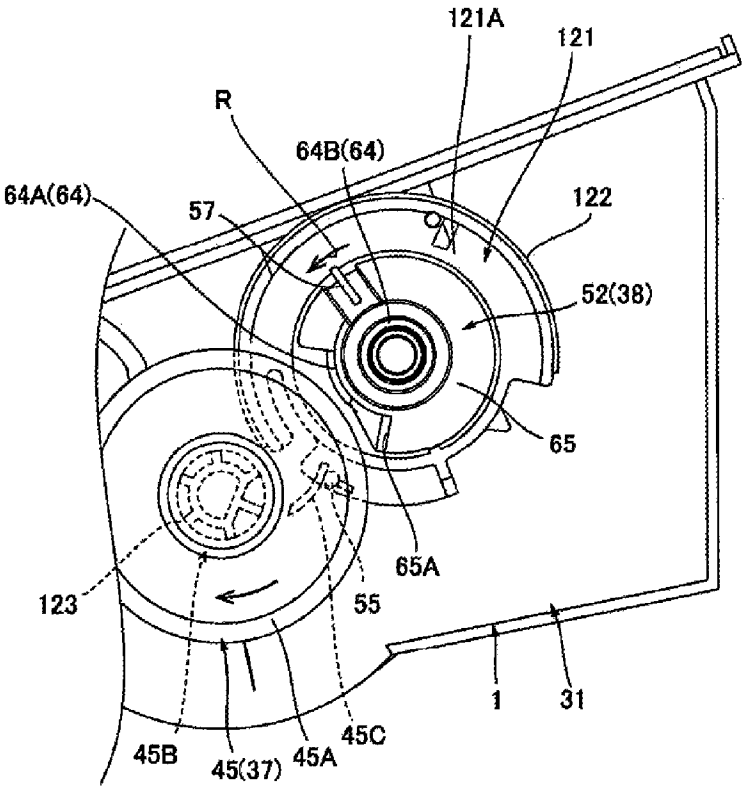
FIG.22
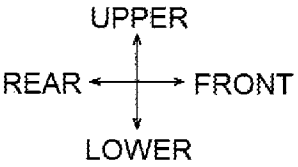

CARTRIDGE HAVING DETECTED MEMBER

CROSS-REFERENCE TO RELATED APPLICATIONS

This application claims priority from Japanese Patent Application No. 2014-074727 filed on Mar. 31, 2014, the entire contents of which are incorporated herein by reference.

TECHNICAL FIELD

Aspects of the disclosure relate to a cartridge configured to be mounted to an electrophotographic image forming apparatus.

BACKGROUND

As an electrophotographic printer, a printer to which a cartridge accommodating therein developer can be detachably mounted is known.

In the known printer, when a used cartridge is replaced with an unused cartridge, it is necessary to enable the printer to recognize that the non-used cartridge has been mounted.

SUMMARY

It is therefore an object of the disclosure to provide a cartridge capable of enabling an external device to recognize that an unused cartridge has been mounted.

According to an aspect of the disclosure, there is provided a cartridge including: a housing configured to accommodate therein developer; a driving receiving part configured to rotate by receiving a driving force; a rotary member configured to rotate from a first position by receiving a driving force from the driving receiving part; and a detected member including a detected part and configured to move in an axis direction parallel with a rotational axis of the rotary member while being restrained from rotating, by receiving a driving force from the rotary member, wherein the detected member includes a first restraint part configured to restrain the rotation of the rotary member at the first position.

According to another aspect of the disclosure, there is provided a cartridge including: a housing configured to accommodate therein developer; a driving receiving part configured to rotate by receiving a driving force; a rotary member configured to rotate by receiving the driving force from the driving receiving part, and a detected member including a detected part and configured to move in an axis direction along a rotational axis of the rotary member while being restrained from rotating, by receiving a driving force from the rotary member, wherein the detected member is configured to move from an original position to a first advance position more advanced towards a direction away from the housing than the original position, upon a first movement after receiving the driving force from the rotary member, and then move from the first advance position to a second advance position more advanced towards the direction away from the housing than the first position.

BRIEF DESCRIPTION OF DRAWINGS

In FIG. 19B, the gear cover is shown with being cut so as to illustrate the stopper of the toothless gear and the stopper of the gear cover;

FIG. 22 illustrates a sixth modified embodiment of the developing cartridge.

DETAILED DESCRIPTION

1. Outline of Developing Cartridge

Figure 1:
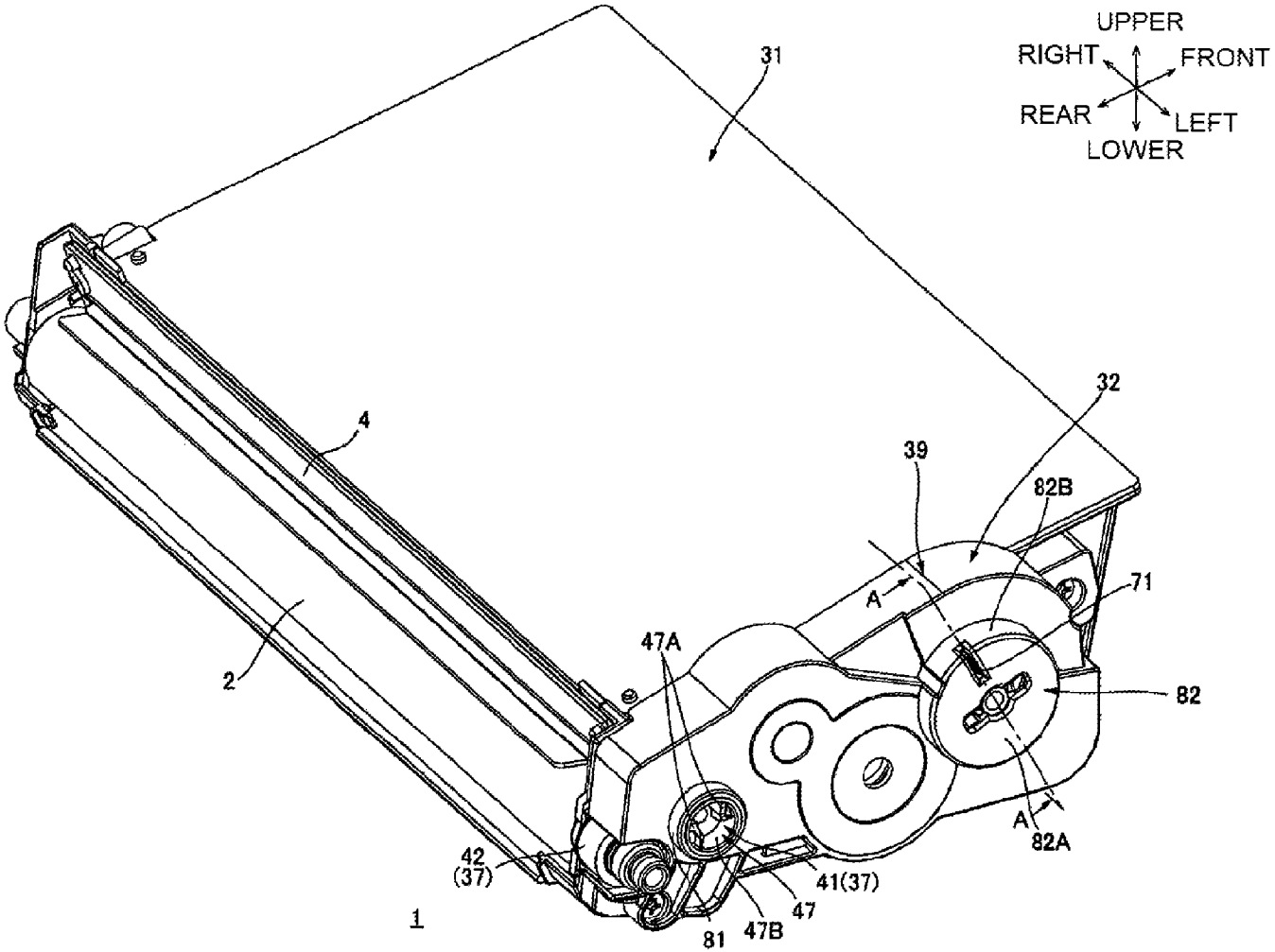
FIG. 1 is a perspective view of a developing cartridge according to an illustrative embodiment of the cartridge of the disclosure, as seen from a left-rear side.
Figure 2:
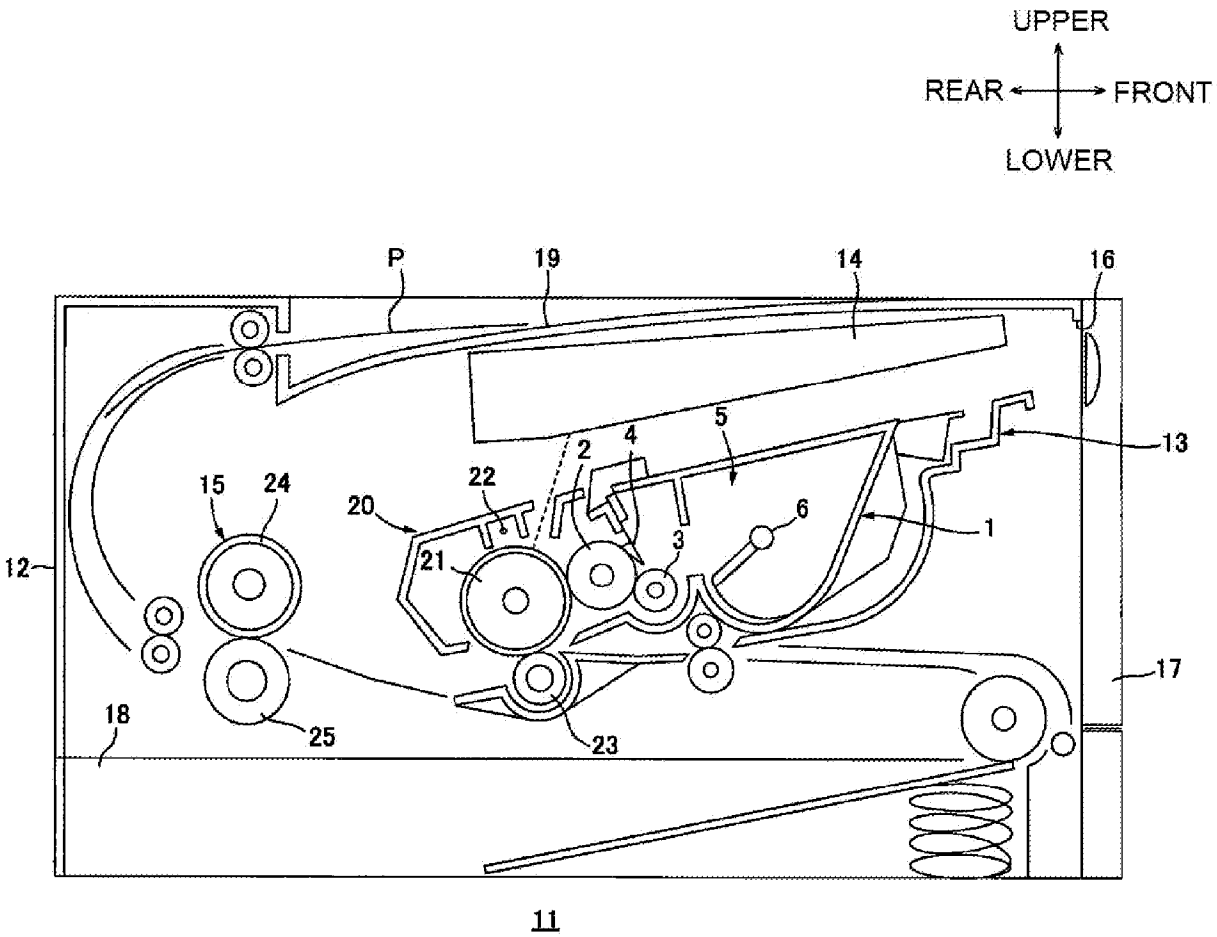
FIG. 2 is a central sectional view of a printer to which the developing cartridge of FIG. 1 is mounted.

As shown in FIGS. 1 and 2, a developing cartridge 1, which is an example of the cartridge, has a developing roller 2, which is an example of the developer carrier, a supply roller 3, a layer thickness regulation blade 4 and a toner accommodating portion 5.

In the description hereinafter, directions of the developing cartridge 1 are described on the basis of a state where the developing cartridge 1 is horizontally placed. Specifically, arrow directions indicated in FIG. 1 are used as the basis. A left-right direction is an example of the axis direction.

The developing roller 2 is rotatably supported by a rear end portion of the developing cartridge 1. The developing roller 2 has a substantially cylindrical shape extending in the left-right direction.

The supply roller 3 is arranged at a front-lower side of the developing roller 2. The supply roller 3 is rotatably supported by the developing cartridge 1. The supply roller 3 has a substantially cylindrical shape extending in the left-right direction. The supply roller 3 contacts a front lower end portion of the developing roller 2.

The layer thickness regulation blade 4 is arranged at a front-upper side of the developing roller 2. The layer thickness regulation blade 4 contacts a front end portion of the developing roller 2.

The toner accommodating portion 5 is arranged in front of the supply roller 3 and the layer thickness regulation blade 4. The toner accommodating portion 5 is configured to accommodate therein toner, which is an example of the developer. The toner accommodating portion 5 has an agitator 6.

The agitator 6 is rotatably supported in the toner accommodating portion 5.

2. Using Aspects of Developing Cartridge

As shown in FIG. 2, the developing cartridge 1 is used with being mounted to an image forming apparatus 11.

The image forming apparatus 11 is an electrophotographic monochrome printer. The image forming apparatus 11 has an apparatus main body 12, a process cartridge 13, a scanner unit 14, and a fixing unit 15.

The apparatus main body 12 has a substantially box shape. The apparatus main body 12 has an opening 16, a front cover 17, a sheet feeding tray 18, and a sheet discharge tray 19.

The opening 16 is arranged at a front end portion of the apparatus main body 12. The opening 16 enables an inside and an outside of the apparatus main body 12 to communicate with each other so that the process cartridge 13 can pass therethrough.

The front cover 17 is arranged at the front end portion of the apparatus main body 12. The front cover 17 has a substantially flat plate shape. The front cover 17 extends in the upper-lower direction, and is swingably supported by a front wall of the apparatus main body 12 at a lower end portion thereof serving as a support point. The front cover 17 is configured to open or close the opening 16.

The sheet feeding tray 18 is arranged at a bottom of the apparatus main body 12. The sheet feeding tray 18 is configured to accommodate therein sheets P.

The sheet discharge tray 19 is arranged at a center of an upper wall of the apparatus main body 12. The sheet discharge tray 19 is recessed downwardly from an upper surface of the apparatus main body 12 so that the sheet P can be placed thereon.

The process cartridge 13 is accommodated at a substantially center of the apparatus main body 12 in the upper-lower direction. The process cartridge 13 is configured to be mounted to or to be detached from the apparatus main body 12. The process cartridge 13 has a drum cartridge 20, and the developing cartridge 1.

The drum cartridge 20 has a photosensitive drum 21, a scorotron-type charger 22, and a transfer roller 23.

The photosensitive drum 21 is rotatably supported by a rear end portion of the drum cartridge 20.

The scorotron-type charger 22 is arranged at an interval from the photosensitive drum 21 at a rear-upper side of the photosensitive drum 21.

The transfer roller 23 is arranged below the photosensitive drum 21. The transfer roller 23 contacts a lower end portion of the photosensitive drum 21.

The developing cartridge 1 is detachably mounted to the drum cartridge 20 so that the developing roller 2 contacts a front end portion of the photosensitive drum 21 at the front of the photosensitive drum 21.

The scanner unit 14 is arranged above the process cartridge 13. The scanner unit 14 is configured to emit a laser beam based on image data towards the photosensitive drum 21.

The fixing unit 15 is arranged at the rear of the process cartridge 13. The fixing unit 15 has a heating roller 24, and a pressing roller 25 pressed to a rear lower end portion of the heating roller 24.

When the image forming apparatus 11 starts an image forming operation, the scorotron-type charger 22 uniformly charges a surface of the photosensitive drum 21. The scanner unit 14 exposes the surface of the photosensitive drum 21. Thereby, an electrostatic latent image based on the image data is formed on the surface of the photosensitive drum 21.

Also, the agitator 6 stirs the toner in the toner accommodating portion 5, thereby supplying the same to the supply roller 3. The supply roller 3 supplies the toner supplied by the agitator 6 to the developing roller 2. At this time, the toner is positively friction-charged between the developing roller 2 and the supply roller 3, and is then carried on the developing roller 2. The layer thickness regulation blade 4 regulates a layer thickness of the toner carried on the developing roller 2 to a predetermined thickness.

The toner carried on the developing roller 2 is supplied to the electrostatic latent image on the surface of the photosensitive drum 21. Thereby, a toner image is carried on the surface of the photosensitive drum 21.

The sheet P is fed one by one at predetermined timing from the sheet feeding tray 18 towards between the photosensitive drum 21 and the transfer roller 23 by rotations of a variety of rollers. The toner image on the surface of the photosensitive drum 21 is transferred to the sheet P when the sheet P passes between the photosensitive drum 21 and the transfer roller 23.

Thereafter, the sheet P is heated and pressed while it passes between the heating roller 24 and the pressing roller 25. Thereby, the toner image on the sheet P is heat-fixed to the sheet P. Then, the sheet P is discharged to the sheet discharge tray 19.

3. Details of Developing Cartridge

As shown in FIG. 1, the developing cartridge 1 has a developing frame 31, which is an example of the housing, and a driving unit 32.

(i) Developing Frame

Figure 3B:
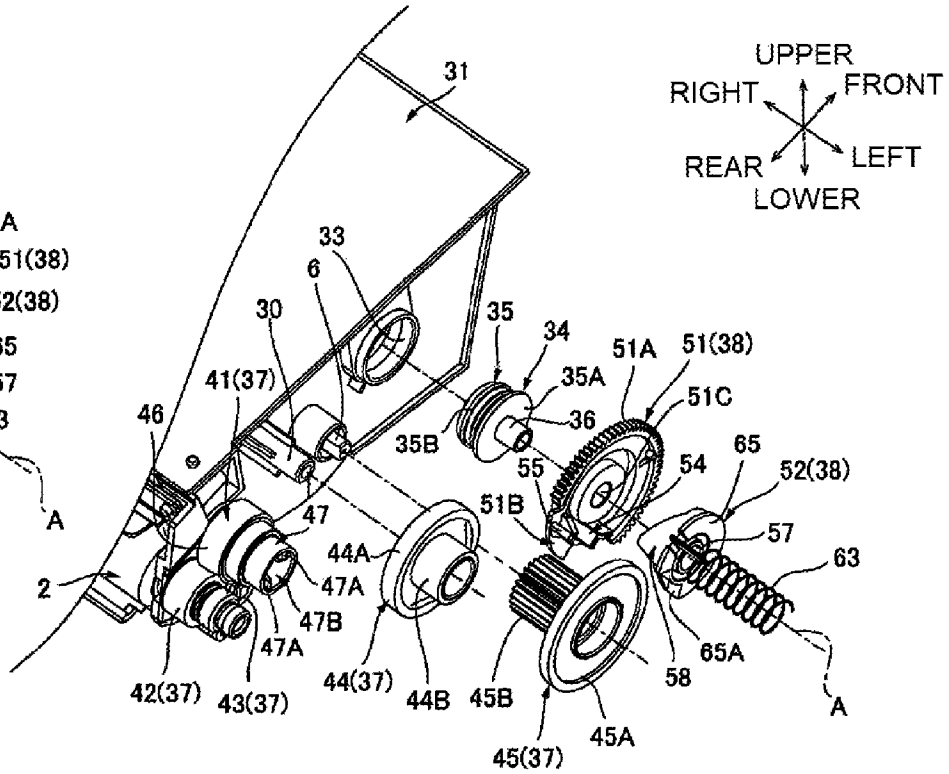
FIG. 3B is an exploded perspective view of the developing cartridge shown in FIG. 3A, as seen from a left-rear side.

The developing frame 31 has a substantially box shape, as shown in FIG. 3B. The developing frame 31 has the toner accommodating portion 5 and supports the developing roller 2, the supply roller 3, the layer thickness regulation blade 4 and the agitator 6. The developing frame 31 has an idle gear support shaft 30, a toner filling port 33, which is an example of the filling port, and a toner cap 34, which is an example of the closing member.

The idle gear support shaft 30 is arranged at a substantially center of an upper end portion of a left wall of the developing frame 31 in the front-rear direction. The idle gear support shaft 30 has a substantially cylindrical shape extending leftward from the left wall of the developing frame 31. The idle gear support shaft 30 is formed integrally with the left wall of the developing frame 31.

The toner filling port 33 is arranged at a front end portion of the left wall of the developing frame 31. The toner filling port 33 has a substantially circular shape, in a side view, and penetrates the left wall of the developing frame 31 in the left-right direction.

The toner cap 34 is fitted in the toner filling port 33 to close the toner filling port 33. The toner cap 34 has a cap main body 35, and a support shaft 36, which is an example of the second support part.

The cap main body 35 has a substantially cylindrical shape extending in the left-right direction and having a closed left end portion. The cap main body 35 has a closing part 35A and an insertion part 35B.

The closing part 35A is arranged at the left end portion of the cap main body 35. The closing part 35A has a substantially disc shape having a thickness in the left-right direction. An outer diameter of the closing part 35A is greater than an inner diameter of the toner filling port 33.

The insertion part 35B has a substantially cylindrical shape extending rightward from a right surface of the closing part 35A. An outer diameter of the insertion part 35B is smaller than the outer diameter of the closing part 35A and is slightly greater than the inner diameter of the toner filling port 33. The insertion part 35B is inserted into the toner filling port 33.

The support shaft 36 has a substantially cylindrical shape extending leftward from a substantially center of the left surface of the closing part 35A. A left end portion of the support shaft 36 opens.

(ii) Driving Unit

Figure 3A:
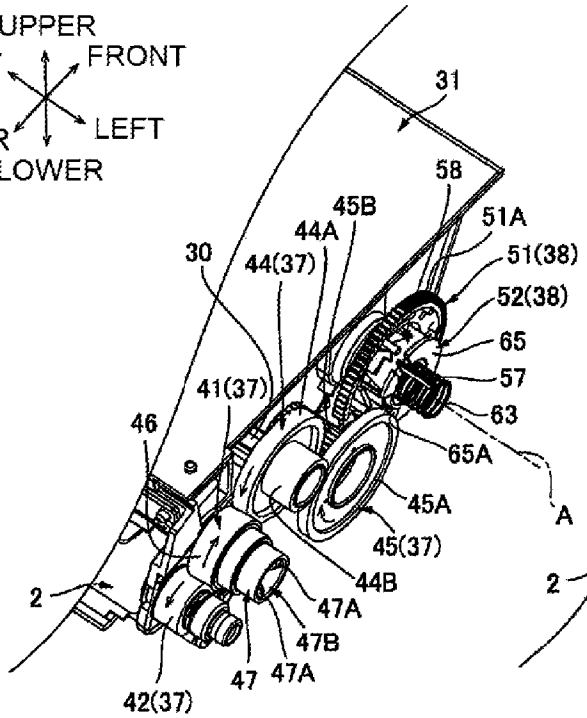
FIG. 3A is a perspective view of the developing cartridge shown in FIG. 1 with a gear cover being detached, as seen from a left-rear side.

As shown in FIGS. 1 and 3A, the driving unit 32 is arranged at the left of the developing frame 31 at the left end portion of the developing cartridge 1. The driving unit 32 has a gear train 37, a detection unit 38, a gear cover 39, which is an example of the covering member, and a compression spring 63, which is an example of the urging member.

(ii-1) Gear Train

As shown in FIGS. 3A and 3B, the gear train 37 has a developing coupling 41, which is an example of the driving receiving part, a developing gear 42, a supply gear 43, an idle gear 44, and an agitator gear 45, which is an example of the transmission member.

The developing coupling 41 is arranged at a rear end portion of the developing cartridge 1. The developing coupling 41 has a substantially cylindrical shape extending in the left-right direction. The developing coupling 41 is rotatably supported by a support shaft (not shown) provided integrally for the left wall of the developing frame 31. The developing coupling 41 has a gear part 46 and a coupling part 47.

The gear part 46 is arranged at a substantially right half part of the developing coupling 41. The gear part 46 has a substantially cylindrical shape extending in the left-right direction and having a closed left end portion. The gear part 46 has gear teeth over an entire circumference thereof.

The coupling part 47 has a substantially cylindrical shape extending leftward from a left wall of the gear part 46 and having an opened left end portion. The coupling part 47 shares a central axis with the gear part 46. The coupling part 47 has a pair of protrusions 47A.

The pair of protrusions 47A are respectively arranged at an interval from each other in a diametrical direction of the coupling part 47 in an inner space 47B of the coupling part 47 in the diametrical direction. Each of the pair of protrusions 47A protrudes inwardly, in the diametrical direction, from an inner peripheral surface of the coupling part 47, and has a substantially rectangular shape, in a side view.

The developing gear 42 is arranged at a rear-lower side of the developing coupling 41. The developing gear 42 has a substantially disc shape having a thickness in the left-right direction. The developing gear 42 has gear teeth over an entire circumference thereof. The developing gear 42 is supported by a left end portion of a rotary shaft of the developing roller 2 so that it cannot be relatively rotated. The developing gear 42 is engaged with a rear lower end portion of the gear part 46 of the developing coupling 41.

The supply gear 43 is arranged below the developing coupling 41. The supply gear 43 has a substantially disc shape having a thickness in the left-right direction. The supply gear 43 has gear teeth over an entire circumference thereof. The supply gear 43 is supported by a left end portion of a rotary shaft of the supply roller 3 so that it cannot be relatively rotated. The supply gear 43 is engaged with a lower end portion of the gear part 46 of the developing coupling 41.

The idle gear 44 is arranged at a front-upper side of the developing coupling 41. The idle gear 44 is rotatably supported by the idle gear support shaft 30. The idle gear 44 integrally has a large diameter gear 44A and a small diameter gear 44B.

The large diameter gear 44A is arranged at a right end portion of the idle gear 44. The large diameter gear 44A has a substantially disc shape having a thickness in the left-right direction. The large diameter gear 44A has gear teeth over an entire circumference thereof. The large diameter gear 44A is engaged with a front upper end portion of the gear part 46 of the developing coupling 41.

The small diameter gear 44B has a substantially cylindrical shape extending leftward from a left surface of the large diameter gear 44A. The small diameter gear 44B shares a central axis with the large diameter gear 44A. An outer diameter of the small diameter gear 44B is smaller than an outer diameter of the large diameter gear 44A. The small diameter gear 44B has gear teeth over an entire circumference thereof.

The agitator gear 45 is arranged at a front-lower side of the idle gear 44. The agitator gear 45 is supported by a left end portion of a rotary shaft of the agitator 6 so that it cannot be relatively rotated. The agitator gear 45 has a first gear part 45A, a second gear part 45B, which is an example of the transmitting part, and an abutting rib 45C, which is an example of the engaging part, as shown in FIGS. 3B and 15A.

The first gear part 45A is arranged at a left end portion of the agitator gear 45. The first gear part 45A has a substantially disc shape having a thickness in the left-right direction. The first gear part 45A has gear teeth over an entire circumference thereof. The first gear part 45A is engaged with a front lower end portion of the small diameter gear 44B of the idle gear 44.

The second gear part 45B has a substantially cylindrical shape extending rightward from a right surface of the first gear part 45A. The second gear part 45B shares a central axis with the first gear part 45A. An outer diameter of the second gear part 45B is smaller than an outer diameter of the first gear part 45A. The second gear part 45B has gear teeth over an entire circumference thereof. The second gear part 45B has an interval from the large diameter gear 44A of the idle gear 44.

The abutting rib 45C protrudes rightwards from the right surface of the first gear part 45A at an outer side than the second gear part 45B in the diametrical direction. The abutting rib 45C extends so that it is inclined in the counterclockwise direction toward the outer side of the agitator gear 45 in the diametrical direction, as seen from a left side, and has a substantially flat plate shape.

(ii-2) Detection Unit

The detection unit 38 has a toothless gear 51, which is an example of the rotary member, and a detection member 52, which is an example of the detected member.

(ii-2-1) Toothless Gear

Figure 4:
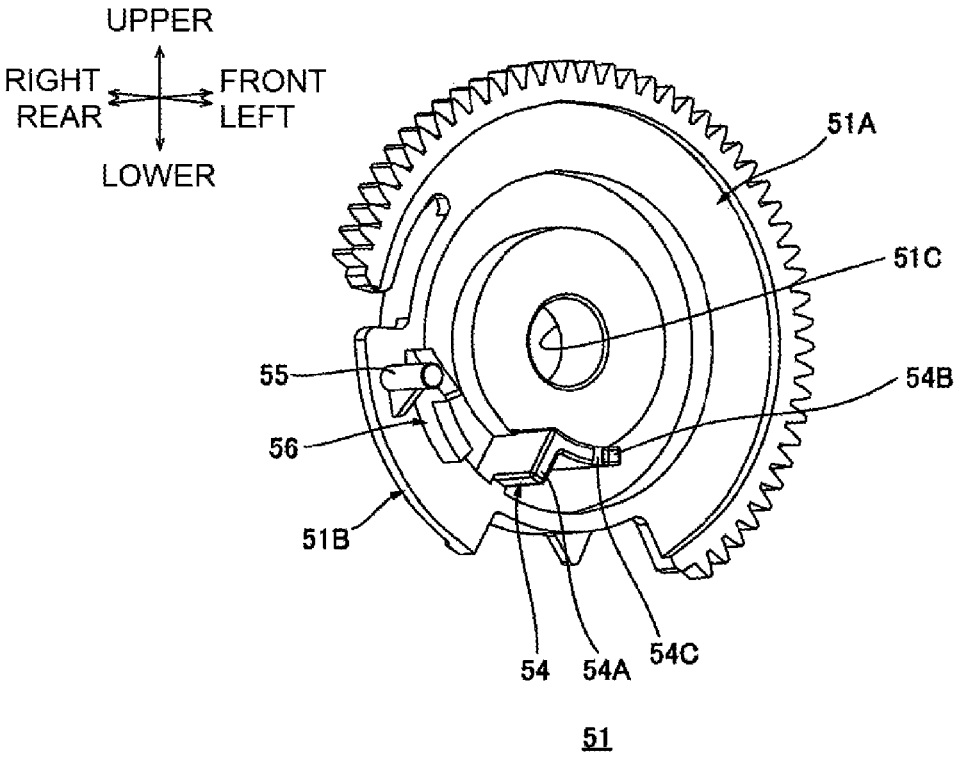
FIG. 4 is a perspective view of a toothless gear shown in FIG. 3A, as seen from a left-lower side.

As shown in FIG. 4, the toothless gear 51 has a substantially disc shape having a thickness in the left-right direction. The toothless gear 51 has a teeth part 51A, which is an example of the transmitted part, a toothless part 51B, and an insertion hole 51C.

The teeth part 51A is a part occupying about two-thirds (⅔) of the toothless gear 51 in a circumferential direction, and corresponds to a fan-shaped part having a central angle of about 240° of the toothless gear 51, in a side view. The teeth part 51A has gear teeth over an entire circumference.

The toothless part 51B is a part occupying about one-third (⅓) of the toothless gear 51 in the circumferential direction, except for the teeth part 51A, and corresponds to a fan-shaped part having a central angle of about 120° of the toothless gear 51, in a side view. The toothless part 51B does not have gear teeth. The toothless part 51B has a boss 55, which is an example of the engaged part, a slide part 54, which is an example of the operating part, and a stopper 56.

The boss 55 is arranged at an upstream end portion of the toothless part 51B in the counterclockwise direction, as seen from the left side. The boss 55 has a substantially cylindrical shape protruding leftward from a left surface of the toothless part 51B.

The slide part 54 is arranged at an inner side of the boss 55 in the diametrical direction and at a downstream side in the counterclockwise direction, as seen from the left side. The slide part 54 protrudes leftward from the left surface of the toothless part 51B and has a substantially L-shaped curved plate shape, in a side view. Specifically, the slide part 54 has a slide rib 54A, a reinforcement rib 54B, and a recess portion 54C.

The slide rib 54A is arranged at an upstream end portion of the slide part 54 in the counterclockwise direction, as seen from a left side. The slide rib 54A has a substantially plate shape extending in a diametrical direction of the toothless gear 51.

The reinforcement rib 54B has a substantially plate shape continuing from an inner end portion of the slide rib 54A in the diametrical direction and extending in the counterclockwise direction, as seen from the left side.

The recess portion 54C is arranged on a middle portion of the reinforcement rib 54B in a circumferential direction of the reinforcement rib 54B. The recess portion 54C is recessed rightward from a left end edge.

The stopper 56 is arranged to be close to an inner side of the boss 55 in the diametrical direction at an outer side than the slide part 54 in the diametrical direction. The stopper 56 has a substantially plate shape protruding leftward from the left surface of the toothless part 51B and extending in the circumferential direction of the toothless gear 51.

The insertion hole 51C is arranged at a central portion of the toothless gear 51 in the diametrical direction. The insertion hole 51C penetrates the toothless gear 51 in the left-right direction, and has a substantially circular shape, in a side view. An inner diameter of the insertion hole 51C is substantially the same as an outer diameter of the support shaft 36 of the toner cap 34.

(ii-2-2) Detection Member

A plurality of types of the detection members 52 is prepared depending on the specification of the developing cartridge 1. For example, each of the plurality of types of the detection members 52 is mounted to the developing cartridge 1 depending on the maximum number of image formation sheets of the developing cartridge 1, which is an example of the specification of the developing cartridge 1.

Specifically, among the plurality of types of the detection members 52, a first detection member 52A is mounted to the developing cartridge 1 of which the maximum number of image formation sheets is 3,000 sheets. Among the plurality of types of the detection members 52, a second detection member 52B is mounted to the developing cartridge 1 of which the maximum number of image formation sheets is 6,000 sheets. Among the plurality of types of the detection members 52, a third detection member 52C is mounted to the developing cartridge 1 of which the maximum number of image formation sheets is 9,000 sheets. Among the plurality of types of the detection members 52, a fourth detection member 52D is mounted to the developing cartridge 1 of which the maximum number of image formation sheets is 12,000 sheets.

(ii-2-2-1) First Detection Member

Figure 5A:
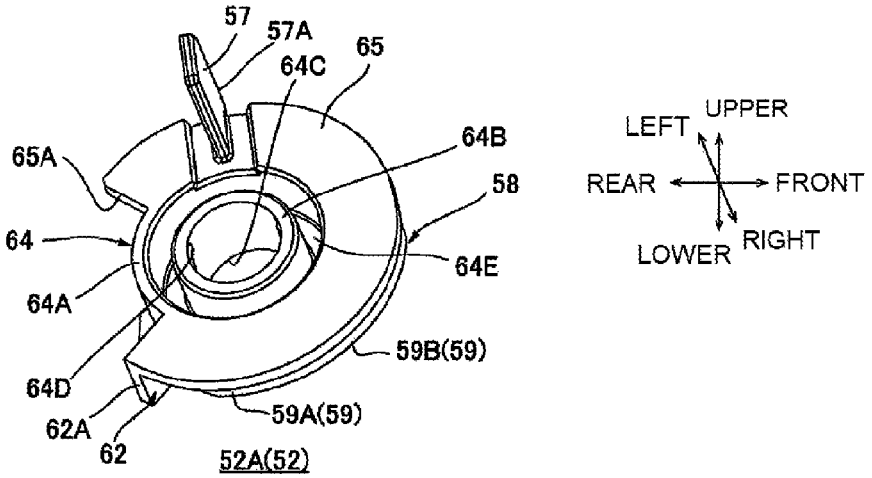
FIG. 5A is a perspective view of a first detection member shown in FIG. 3A, as seen from a left-lower side.
Figure 5B:
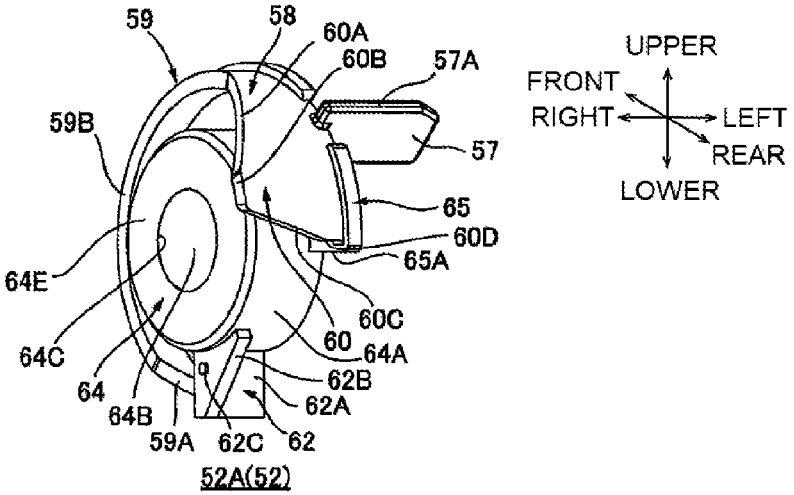
FIG. 5B is a perspective view of the first detection member shown in FIG. 5A, as seen from a rear-lower side.

As shown in FIGS. 5A and 5B, the first detection member 52A has a substantially cylindrical shape extending in the left-right direction. The first detection member 52A has a cylinder part 64, a collar part 65, a detection projection 57, which is an example of the detected part, a displacement part 58, and a stopper 62.

The cylindrical part 64 is arranged at a central portion of the detection member 52 in the diametrical direction. The cylindrical part 64 has an outer cylinder 64A and an inner cylinder 64B.

The outer cylinder 64A has a substantially cylindrical shape extending in the left-right direction and having a closed right end portion. The outer cylinder 64A has an insertion hole 64C.

The insertion hole 64C is arranged at a central portion of a right wall 64E of the outer cylinder 64A in the diametrical direction. The insertion hole 64C penetrates the right wall 64E of the outer cylinder 64A in the left-right direction and has a substantially circular shape, in a side view. A center of the insertion hole 64C coincides with a central axis of the outer cylinder 64A, when projected in the left-right direction.

The inner cylinder 64B is arranged at an inner side of the outer cylinder 64A in the diametrical direction. The inner cylinder 64B extends leftward continuously from a peripheral edge part of the insertion hole 64C at the diametrical center of the right wall 64E of the outer cylinder 64A, and has a substantially cylindrical shape. A central axis of the inner cylinder 64B coincides with the central axis of the outer cylinder 64A. An inner diameter of the inner cylinder 64B is the same as an inner diameter of the insertion hole 64C. The inner cylinder 64B has a pair of engaging projections 64D.

The pair of engaging projections 64D is respectively arranged on both inner surfaces of the inner cylinder 64B in the diametrical direction. Each of the pair of engaging projections 64D is a protrusion protruding inward, in the diametrical direction, from the inner surface of the inner cylinder 64B and extending circumferentially.

The collar part 65 protrudes outward, in the diametrical direction, from an outer surface of a left end portion of the outer cylinder 64A in the diametrical direction and extends in the circumferential direction of the outer cylinder 64A. The collar part 65 has a substantially C-shaped plate shape of which a rear end portion is notched over about a quarter (¼) thereof in the circumferential direction, in a side view. In other words, a notched portion 65A of the collar part 65 is notched forward from a rear end edge of the collar part 65. The notched portion 65A of the collar part 65 is an example of the notched part of the detection member 52.

The detection projection 57 is arranged at an upper end portion of the collar part 65. The detection projection 57 has a substantially flat plate shape protruding leftward from the left surface of the collar part 65 and extending in the diametrical direction of the detection member 52. An outer end portion 57A of the detection projection 57 in the diametrical direction protrudes outward, in the diametrical direction, beyond the collar part 65.

Figure 5C:
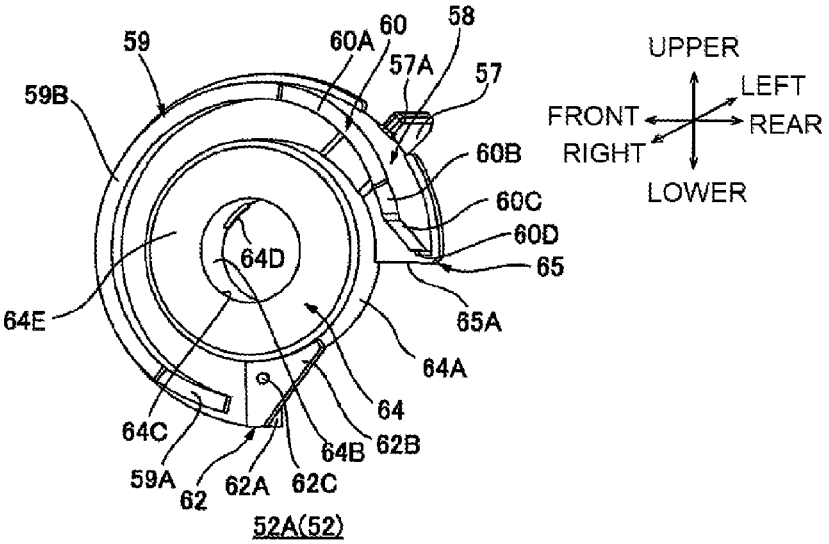
FIG. 5C is a perspective view of the first detection member shown in FIG. 5A, as seen from a right-rear side.

As shown in FIGS. 5B and 5C, the displacement part 58 is arranged at the peripheral edge part of the collar part 65. The displacement part 58 has a substantially C-shaped flat plate shape protruding rightward from the right surface of the peripheral edge part of the collar part 65 and extending in the circumferential direction of the collar part 65. The displacement part 58 has a base part 59, and a protruding part 60, which is an example of one abutment part.

Figure 6A:
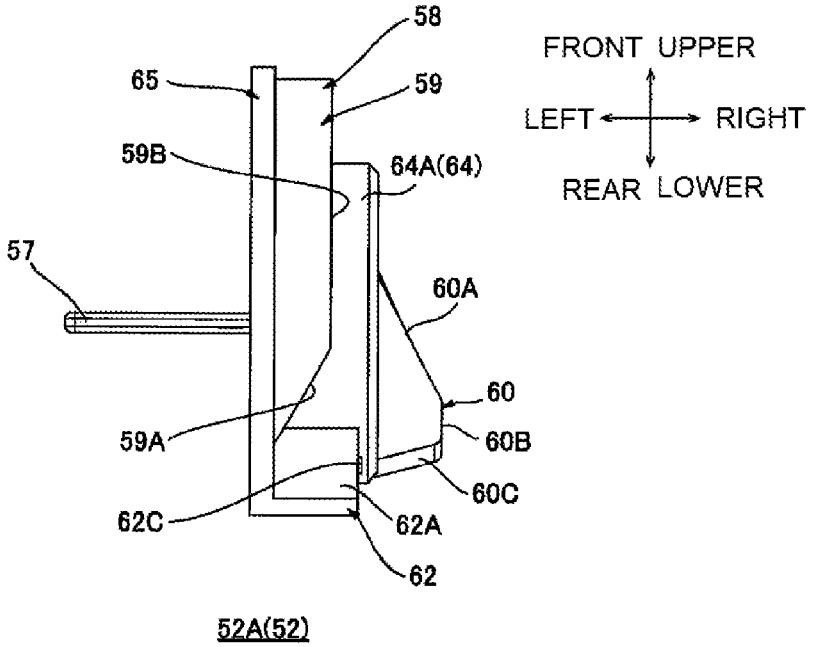
FIG. 6A is a side view of the first detection member shown in FIG. 5C, as seen from a front-lower side.

As shown in FIGS. 5C and 6A, the base part 59 is a part occupying about two-thirds (⅔) of an upstream side of the displacement part 58 in the counterclockwise direction, as seen from the left side. The base part 59 has an inclined surface 59A, which is an example of the inclined part, and a parallel surface 59B, which is an example of the flat surface.

The inclined surface 59A is arranged at an upstream end portion of the base part 59 in the counterclockwise direction, as seen from the left side. The inclined surface 59A continues to the right surface of the collar part 65 and is inclined rightward towards the downstream side in the counterclockwise direction, as seen from the left side.

The parallel surface 59B continues to a downstream side of the inclined surface 59A in the counterclockwise direction, as seen from the left side, and extends in the counterclockwise direction, as seen from the left side. The parallel surface 59B is parallel with the right surface of the collar part 65 so that a distance thereof from the right surface of the collar part 65 in the left-right direction is constant.

Figure 6B:
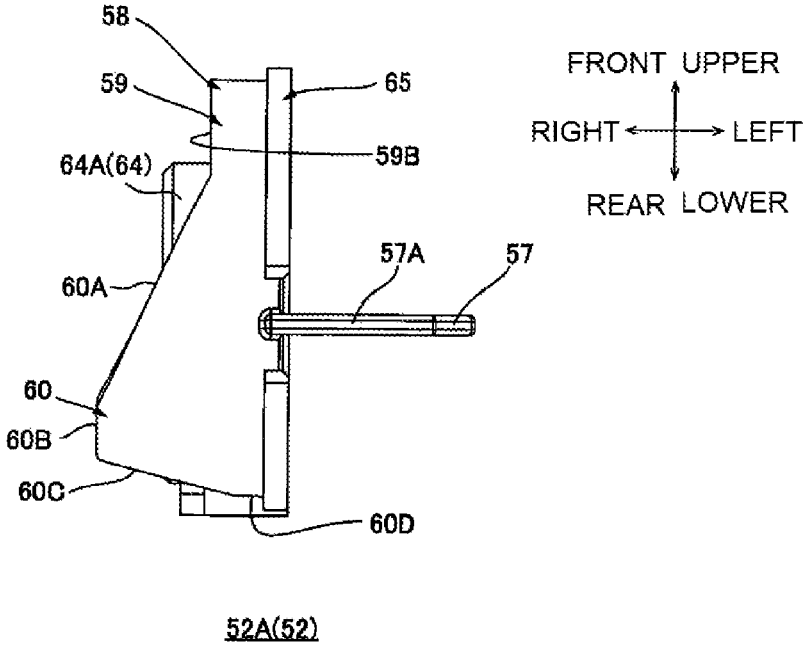
FIG. 6B is a side view of the first detection member shown in FIG. 5C, as seen from a rear-upper side.

As shown in FIGS. 5B and 6B, the protruding part 60 is arranged to continue to a downstream side of the base part 59 in the counterclockwise direction, as seen from the left side. The protruding part 60 has a first inclined surface 60A, a parallel surface 60B, a second inclined surface 60C, and an orthogonal surface 60D, which is an example of the third restraint part.

The first inclined surface 60A is arranged at an upstream end portion of the protruding part 60 in the counterclockwise direction, as seen from the left side. The first inclined surface 60A continues to the parallel surface 59B of the base part 59 and is inclined rightward towards the counterclockwise direction, as seen from the left side.

The parallel surface 60B continues to a downstream side of the first inclined surface 60A in the counterclockwise direction, as seen from the left side, and extends in the counterclockwise direction, as seen from the left side. The parallel surface 60B is parallel with the right surface of the collar part 65 so that a distance thereof from the right surface of the collar part 65 in the left-right direction is constant.

The second inclined surface 60C continues to a downstream side of the parallel surface 60B in the counterclockwise direction, as seen from the left side, and is inclined leftward towards the downstream side in the counterclockwise direction, as seen from the left side.

The orthogonal surface 60D continues to a downstream side of the second inclined surface 60C in the counterclockwise direction, as seen from the left side, and extends leftward. The orthogonal surface 60D is orthogonal to the right surface of the collar part 65.

As shown in FIG. 5B, the stopper 62 is arranged at an upstream end portion of the collar part 65 in the counterclockwise direction, as seen from the left side. The stopper 62 faces the base part 59 at an interval therebetween at an upstream side in the counterclockwise direction, as seen from the left side. The stopper 62 has a substantially L-shaped curved plate shape protruding rightward from the right surface of the collar part 65, as seen from a bottom. Specifically, the stopper 62 has a stopper rib 62A, which is an example of the extension part, a reinforcement rib 62B, and a projection 62C, which is an example of the fixing part.

The stopper rib 62A is arranged at an upstream end portion of the stopper 62 in the counterclockwise direction, as seen from the left side. The stopper rib 62A has a substantially plate shape extending in the diametrical direction of the first detection member 52A. The stopper rib 62A configures the first restraint part, together with the base part 59.

The reinforcement rib 62B has a substantially plate shape continuing from a right end portion of the stopper rib 62A and extending the clockwise direction, as seen from the left side.

The projection 62C has a substantially cylindrical shape protruding rightward from a right surface of the reinforcement rib 62B.

(ii-2-2-2) Second Detection Member

Figure 7A:
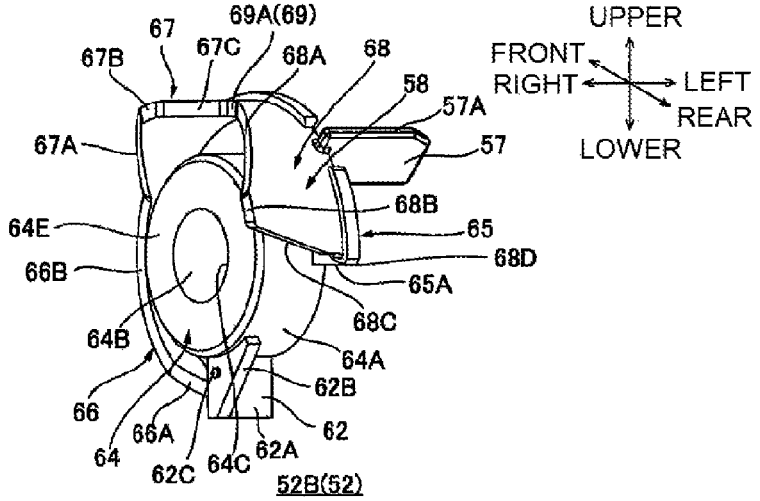
FIG. 7A is a perspective view of a second detection member, as seen from a rear-lower side.

As shown in FIG. 7A, the displacement part 58 of the second detection member 52B has two protruding parts, unlike the first detection member 52A.

The displacement part 58 of the second detection member 52B has a first base part 66, a first protruding part 67, which is an example of the first abutment part, a second base part 69, and a second protruding part 68, which is an example of the second abutment part.

Figure 7B:
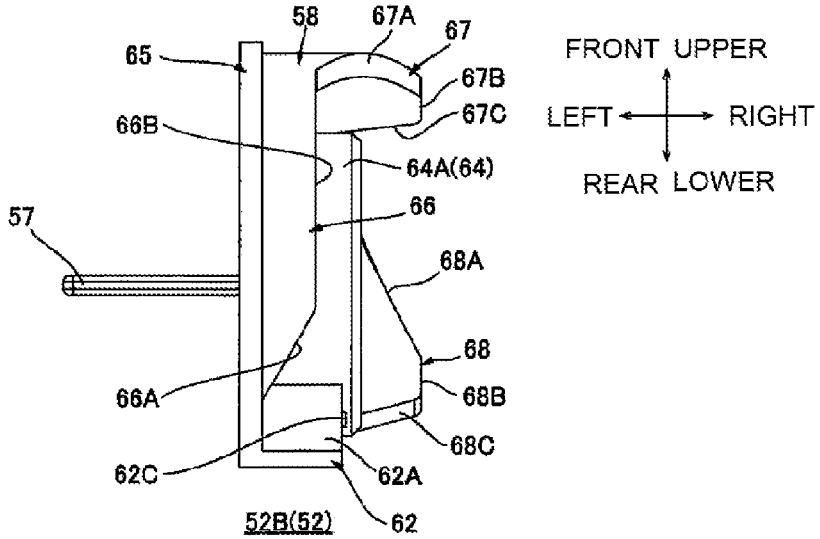
FIG. 7B is a side view of the second detection member shown in FIG. 7A, as seen from a front-lower side.

As shown in FIGS. 7A and 7B, the first base part 66 is a part occupying about a half (½) of an upstream side of the displacement part 58 in the counterclockwise direction, as seen from the left side. The first base part 66 configures the first restraint part, together with the stopper rib 62A. The first base part 66 has an inclined surface 66A, which is an example of the inclined part, and a parallel surface 66B, which is an example of the flat surface.

The inclined surface 66A is arranged at an upstream end portion of the first base part 66 in the counterclockwise direction, as seen from the left side. The inclined surface 66A continues to the right surface of the collar part 65 and is inclined rightward towards the downstream side in the counterclockwise direction, as seen from the left side.

The parallel surface 66B continues to a downstream side of the first inclined surface 67A in the counterclockwise direction, as seen from the left side, and extends in the counterclockwise direction, as seen from the left side. The parallel surface 66B is parallel with the right surface of the collar part 65 so that a distance thereof from the right surface of the collar part 65 in the left-right direction is constant.

The first protruding part 67 is arranged to continue to a downstream side of the first base part 66 in the counterclockwise direction, as seen from the left side. The first protruding part 67 has a first inclined surface 67A, a parallel surface 67B, and a second inclined surface 67C.

The first inclined surface 67A continues to a downstream side of the parallel surface 67B in the counterclockwise direction, as seen from the left side, and is inclined rightward towards the downstream side in the counterclockwise direction, as seen from the left side.

Figure 7C:
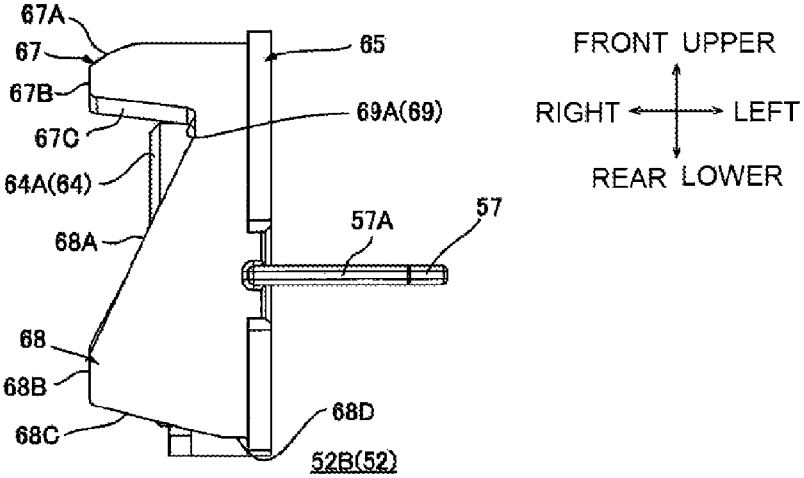
FIG. 7C is a side view of the second detection member shown in FIG. 7A, as seen from a rear-upper side.

The parallel surface 67B continues to a downstream side of the first inclined surface 67A in the counterclockwise direction, as seen from the left side, and extends in the counterclockwise direction, as seen from the left side. The parallel surface 67B is parallel with the right surface of the collar part 65 so that a distance thereof from the right surface of the collar part 65 in the left-right direction is constant As shown in FIGS. 7A and 7C, the second inclined surface 67C continues to a downstream side of the parallel surface 67B in the counterclockwise direction, as seen from the left side, and is inclined leftward towards the downstream side in the counterclockwise direction, as seen from the left side.

The second base part 69 is arranged to continue to a downstream side of the first protruding part 67 in the counterclockwise direction, as seen from the left side. The second base part 69 has a parallel surface 69A.

The parallel surface 69A continues to a downstream side of the first protruding part 67 in the counterclockwise direction, as seen from the left side, and extends in the counterclockwise direction, as seen from the left side. The parallel surface 69A is parallel with the right surface of the collar part 65 so that a distance thereof from the right surface of the collar part 65 in the left-right direction is constant.

The second protruding part 68 is arranged to continue to a downstream side of the second base part 69 in the counterclockwise direction downstream, as seen from the left side. The second protruding part 68 has a first inclined surface 68A, a parallel surface 68B, a second inclined surface 68C, and an orthogonal surface 68D, which is an example of the third restraint part.

The first inclined surface 68A continues to the parallel surface 69A of the second base part 69, and is inclined rightward towards the downstream side in the counterclockwise direction, as seen from the left side.

The parallel surface 68B continues to a downstream side of the first inclined surface 68A in the counterclockwise direction, as seen from the left side, and extends in the counterclockwise direction, as seen from the left side. The parallel surface 68B is parallel with the right surface of the collar part 65 so that a distance thereof from the right surface of the collar part 65 in the left-right direction is constant.

The second inclined surface 68C continues to a downstream side of the parallel surface 68B in the counterclockwise direction, as seen from the left side, and is inclined leftward towards the downstream side in the counterclockwise direction, as seen from the left side.

The orthogonal surface 68D continues to a downstream side of the second inclined surface 68C in the counterclockwise direction, as seen from the left side, and extends leftward. The orthogonal surface 68D is orthogonal to the right surface of the collar part 65.

(ii-2-2-3) Third Detection Member

Figure 8A:
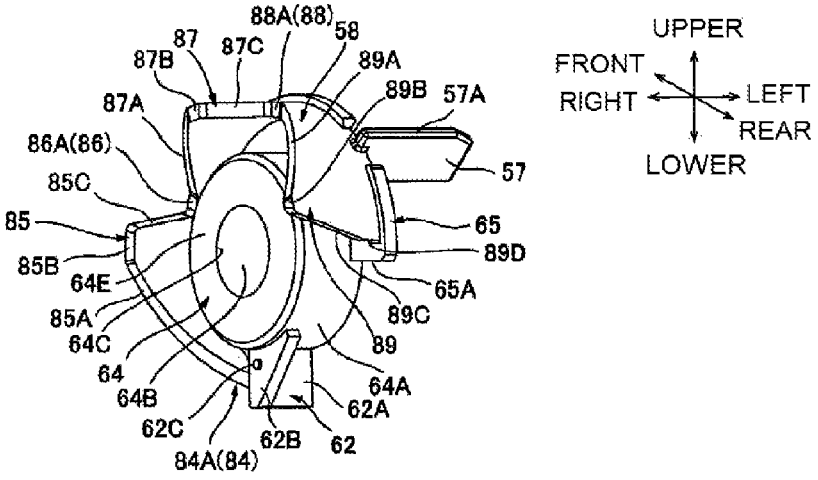
FIG. 8A is a perspective view of a third detection member, as seen from a rear-lower side.
Figure 8B:
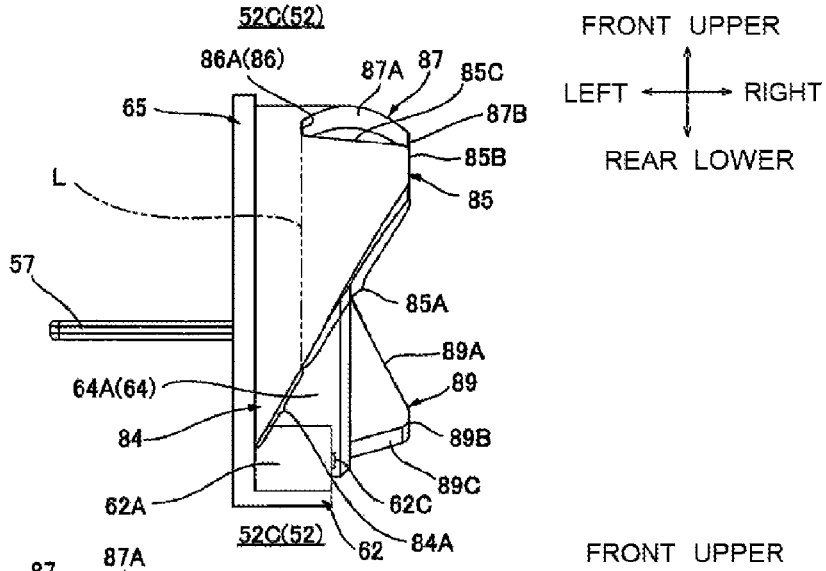
FIG. 8B is a side view of the third detection member shown in FIG. 8A, as seen from a front-lower side.

As shown in FIGS. 8A and 8B, the displacement part 58 of the third detection member 52C has three protruding parts, unlike the first detection member 52A.

The displacement part 58 of the third detection member 52C has a first base part 84, a first protruding part 85, which is an example of the first abutment part, a second base part 86, a second protruding part 87, which is an example of the second abutment part, a third base part 88 and a third protruding part 89, which is an example of the abutment part.

The first base part 84 is arranged at an upstream end portion of the displacement part 58 in the counterclockwise direction, as seen from the left side. The first base part 84 configures the first restraint part, together with the stopper rib 62A. The first base part 84 does not have a parallel surface, unlike the base part 59 of the first detection member 52A, and has an inclined surface 84A, which is an example of the inclined part.

The inclined surface 84A is arranged at an upstream end portion of the first base part 84 in the counterclockwise direction, as seen from the left side. The inclined surface 84A is arranged at the left of a virtual line L, which is obtained by extending a parallel surface 86A (which will be described later) of the second base part 86 in a circumferential direction. The inclined surface 84A continues to the right surface of the collar part 65 and is inclined rightward towards the downstream side in the counterclockwise direction, as seen from the left side. In the meantime, the inclined surface 84A of the third detection member 52C is an example of the flat surface.

The first protruding part 85 is arranged to continue to a downstream side of the first base part 84 in the counterclockwise direction, as seen from the left side. The first protruding part 85 has a first inclined surface 85A, a parallel surface 85B, and a second inclined surface 85C.

The first inclined surface 85A continues to a downstream side of the inclined surface 84A of the first base part 84 in the counterclockwise direction, as seen from the left side, and is inclined rightward towards the downstream side in the counterclockwise direction, as seen from the left side. The first inclined surface 85A is arranged at the right of the virtual line L, which is obtained by extending the parallel surface 86A (which will be described later) of the second base part 86 in a circumferential direction.

The parallel surface 85B continues to a downstream side of the first inclined surface 85A in the counterclockwise direction, as seen from the left side, and extends in the counterclockwise direction, as seen from the left side. The parallel surface 85B is parallel with the right surface of the collar part 65 so that a distance thereof from the right surface of the collar part 65 in the left-right direction is constant The second inclined surface 85C continues to a downstream side of the parallel surface 85B in the counterclockwise direction, as seen from the left side, and is inclined leftward towards the downstream side in the counterclockwise direction, as seen from the left side.

The second base part 86 is arranged to continue to a downstream side of the first protruding part 85 in the counterclockwise direction, as seen from the left side. The second base part 86 has a parallel surface 86A.

The parallel surface 86A continues to a downstream side of the second inclined surface 85C in the counterclockwise direction, as seen from the left side, and extends in the counterclockwise direction, as seen from the left side. The parallel surface 86A is parallel with the right surface of the collar part 65 so that a distance thereof from the right surface of the collar part 65 in the left-right direction is constant.

Figure 8C:
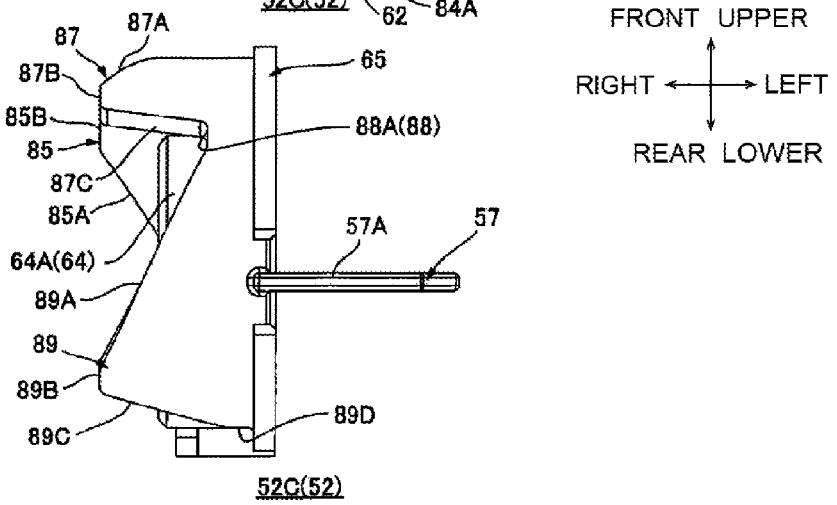
FIG. 8C is a side view of the third detection member shown in FIG. 7A, as seen from a rear-upper side.

As shown in FIGS. 8A and 8C, the second protruding part 87 is arranged to continue to a downstream side of the second base part 86 in the counterclockwise direction, as seen from the left side. The second protruding part 87 has a first inclined surface 87A, a parallel surface 87B, and a second inclined surface 87C.

The first inclined surface 87A continues to the parallel surface 86A of the second base part 86, and is inclined rightward towards the downstream side in the counterclockwise direction, as seen from the left side.

The parallel surface 87B continues to a downstream side of the first inclined surface 87A in the counterclockwise direction, as seen from the left side, and extends in the counterclockwise direction, as seen from the left side. The parallel surface 87B is parallel with the right surface of the collar part 65 so that a distance thereof from the right surface of the collar part 65 in the left-right direction is constant.

The second inclined surface 87C continues to a downstream side of the parallel surface 87B in the counterclockwise direction, as seen from the left side, and is inclined leftward towards the downstream side in the counterclockwise direction, as seen from the left side.

The third base part 88 is arranged to continue to a downstream side of the second protruding part 87 in the counterclockwise direction, as seen from the left side. The third base part 86 has a parallel surface 88A.

The parallel surface 88A continues to a downstream side of the second inclined surface 87C in the counterclockwise direction, as seen from the left side, and extends in the counterclockwise direction, as seen from the left side. The parallel surface 88A is parallel with the right surface of the collar part 65 so that a distance thereof from the right surface of the collar part 65 in the left-right direction is constant.

The third protruding part 89 is arranged to continue to a downstream side of the third base part 88 in the counterclockwise direction, as seen from the left side. The third protruding part 89 has a first inclined surface 89A, a parallel surface 89B, a second inclined surface 89C, and an orthogonal surface 89D, which is an example of the third restraint part.

The first inclined surface 89A continues to the parallel surface 88A of the third base part 86, and is inclined rightward towards the downstream side in the counterclockwise direction, as seen from the left side.

The parallel surface 89B continues to a downstream side of the first inclined surface 89A in the counterclockwise direction, as seen from the left side, and extends in the counterclockwise direction, as seen from the left side. The parallel surface 89B is parallel with the right surface of the collar part 65 so that a distance thereof from the right surface of the collar part 65 in the left-right direction is constant.

The second inclined surface 89C continues to a downstream side of the parallel surface 89B in the counterclockwise direction, as seen from the left side, and is inclined leftward towards the downstream side in the counterclockwise direction, as seen from the left side.

The orthogonal surface 89D continues to a downstream side of the second inclined surface 89C in the counterclockwise direction, as seen from the left side, and extends leftward. The orthogonal surface 89D is orthogonal to the right surface of the collar part 65.

(ii-2-2-4) Fourth Detection Member

Figure 9A:
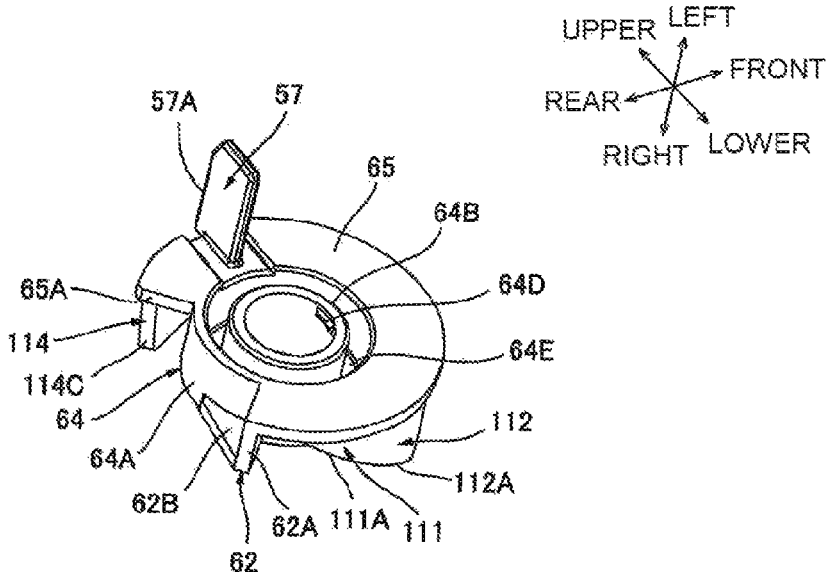
FIG. 9A is a perspective view of a fourth detection member, as seen from a rear-lower side.
Figure 9B:
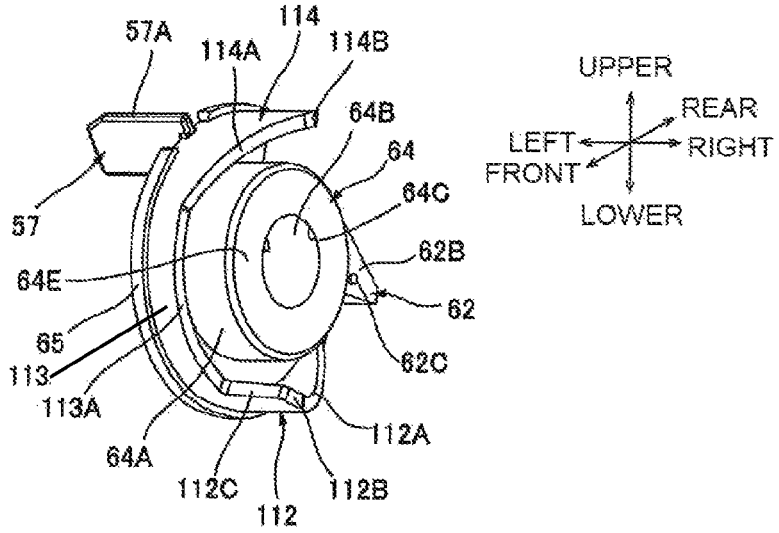
FIG. 9B is a side view of the fourth detection member shown in FIG. 9A, as seen from a right-front side.

As shown in FIGS. 9A and 9B, the fourth detection member 52D has protruding parts, which are respectively provided at both end portions of the displacement part 58 in the counterclockwise direction, as seen from the left side, unlike the second detection member 52B.

The displacement part 58 of the fourth detection member 52D has a first base part 111, a first protruding part 112, which is an example of the first abutment part, a second base part 113, and a second protruding part 114, which is an example of the second abutment part.

The first base part 111 is arranged at an upstream end portion of the displacement part 58 in the counterclockwise direction, as seen from the left side. The first base part 111 configures the first restraint part, together with the stopper rib 62A. The first base part 111 does not have a parallel surface, like the first base part 84 of the third detection member 52C, and has an inclined surface 111A, which is an example of the inclined part.

The inclined surface 111A is arranged at an upstream end portion of the first base part 111 in the counterclockwise direction, as seen from the left side. The inclined surface 111A continues to the right surface of the collar part 65 and is inclined rightward towards the downstream side in the counterclockwise direction, as seen from the left side. In the meantime, the inclined surface 111A of the fourth detection member 52D is an example of the flat surface.

The first protruding part 112 is arranged to continue to a downstream side of the first base part 111 in the counterclockwise direction, as seen from the left side. The first protruding part 112 has a first inclined surface 112A, a parallel surface 112B, and a second inclined surface 112C.

The first inclined surface 112A continues to a downstream side of the inclined surface 111A of the first base part 111 in the counterclockwise direction, as seen from the left side, and is inclined rightward towards the downstream side in the counterclockwise direction, as seen from the left side.

The parallel surface 112B continues to a downstream side of the first inclined surface 112A in the counterclockwise direction, as seen from the left side, and extends in the counterclockwise direction, as seen from the left side. The parallel surface 112B is parallel with the right surface of the collar part 65 so that a distance thereof from the right surface of the collar part 65 in the left-right direction is constant The second inclined surface 112C continues to a downstream side of the parallel surface 112B in the counterclockwise direction, as seen from the left side, and is inclined leftward towards the downstream side in the counterclockwise direction, as seen from the left side.

The second base part 113 is arranged to continue to a downstream side of the first protruding part 112 in the counterclockwise direction, as seen from the left side. The second base part 113 has a parallel surface 113A.

The parallel surface 113A continues to a downstream side of the second inclined surface 112C in the counterclockwise direction, as seen from the left side, and extends in the counterclockwise direction, as seen from the left side. The parallel surface 113A is longer than the parallel surface 69A of the second base part 69 of the second detection member 52B. The parallel surface 113A is parallel with the right surface of the collar part 65 so that a distance thereof from the right surface of the collar part 65 in the left-right direction is constant.

The second protruding part 114 is arranged to continue to a downstream side of the second base part 113 in the counterclockwise direction, as seen from the left side. The second protruding part 114 has a first inclined surface 114A, a parallel surface 114B, and a second inclined surface 114C (see FIG. 9A).

The first inclined surface 114A continues to the parallel surface 113A of the second base part 113, and is inclined rightward towards the downstream side in the counterclockwise direction, as seen from the left side.

The parallel surface 114B continues to a downstream side of the first inclined surface 114A in the counterclockwise direction, as seen from the left side, and extends in the counterclockwise direction, as seen from the left side. The parallel surface 114B is parallel with the right surface of the collar part 65 so that a distance thereof from the right surface of the collar part 65 in the left-right direction is constant.

The second inclined surface 114C continues to a downstream side of the parallel surface 114B in the counterclockwise direction, as seen from the left side, and is inclined leftward towards the downstream side in the counterclockwise direction, as seen from the left side.

In the meantime, although not shown, the second protruding part 114 continues to a downstream side of the second inclined surface 114C in the counterclockwise direction, as seen from the left side, and has an orthogonal surface extending leftward, like the second protruding part 68 of the second detection member 52B.

(ii-3) Gear Cover and Compression Spring

Figure 10:
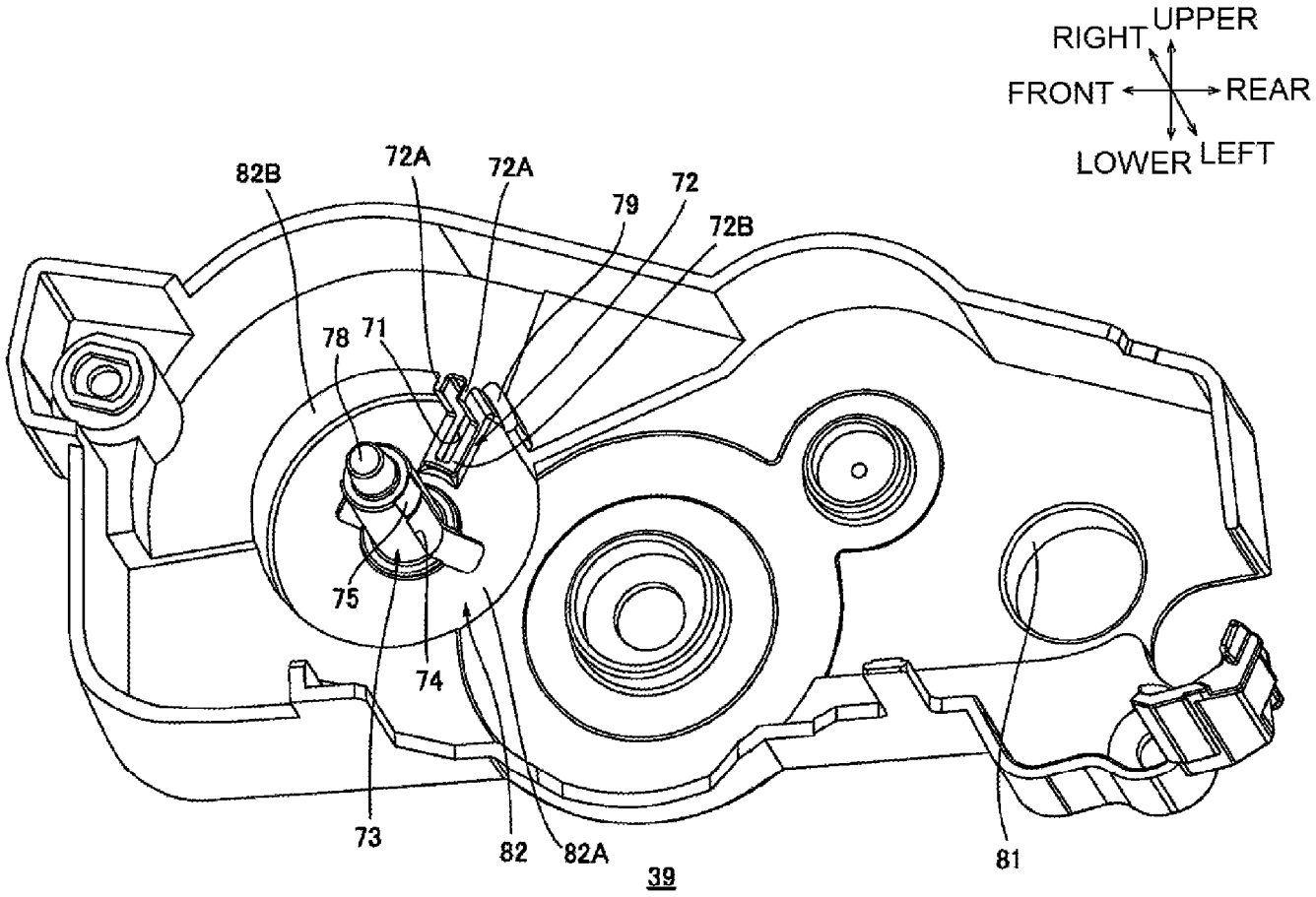
FIG. 10 is a perspective view of a gear cover shown in FIG. 1, as seen from a right-lower side.

As shown in FIGS. 1 and 10, the gear cover 39 is supported by the left end portion of the developing frame 31. The gear cover 39 has a substantially square tube shape extending in the left-right direction and having a closed left end portion. The gear cover 39 covers the gear train 37 and the detection unit 38. The gear cover 39 has a coupling collar 81 and a detection member accommodation part 82.

The coupling collar 81 is arranged at a rear end portion of the gear cover 39. The coupling collar 81 has a substantially cylindrical shape penetrating a left wall of the gear cover 39 and extending in the left-right direction. An inner diameter of the coupling collar 81 is substantially the same as an outer diameter of the coupling part 47 of the developing coupling 41. The coupling part 47 of the developing coupling 41 is rotatably fitted in the coupling collar 81.

The detection member accommodation part 82 is arranged at a front end portion of the gear cover 39. The detection member accommodation part 82 has a substantially cylindrical shape extending leftward from a left surface of the gear cover 39 and having a closed left end portion. A left wall 82A of the detection member accommodation part 82 is an example of the covering part. In the meantime, a right end portion of the detection member accommodation part 82 communicates with an inside of the gear cover 39. The detection member accommodation part 82 accommodates therein the detection member 52. The detection member accommodation part 82 has a slit 71, a guide rib 72, which is an example of the guide part, a support shaft 73, which is an example of the first support part, and a stopper 79, which is an example of the second restraint part.

The slit 71 is arranged at an upper end portion of the detection member accommodation part 82. The slit 71 penetrates the left wall 82A of the detection member accommodation part 82 in the left-right direction and extends in a diametrical direction of the detection member accommodation part 82.

The guide rib 72 is arranged at a peripheral edge part of the slit 71. The guide rib 72 has a pair of first guide parts 72A, and a second guide part 72B.

The pair of first guide parts 72A is arranged at an interval in a circumferential direction of the detection member accommodation part 82 so as to sandwich an upper end portion of the slit 71 therebetween. Each of the pair of first guide parts 72A has a substantially flat plate shape protruding downwardly from an inner surface of a peripheral wall 82B in the diametrical direction at an upper end portion of the detection member accommodation part 82 and extending in the left-right direction. A left end portion of each of the pair of first guide parts 72A continues to a peripheral edge part of the upper end portion of the slit 71.

The second guide part 72B is arranged to continue to respective lower sides of the pair of first guide parts 72A. The second guide part 72B protrudes rightward from a right surface of the left wall 82A of the detection member accommodation part 82 at the peripheral edge part of the slit 71, and has a substantially U shape so as to surround the slit 71, in a side view. A size of the second guide part 72B in the left-right direction is shorter than a size of the first guide part 72A in the left-right direction.

The support shaft 73 has a substantially cylindrical shape extending rightward from a diametrical center of the left wall 82A of the detection member accommodation part 82. An outer diameter of the support shaft 73 is the same as the inner diameter of the insertion hole 64C of the detection member 52. The support shaft 73 has guide recesses 74, engaging claws 75 and a protrusion 78.

The guide recesses 74 are arranged at both end portions of the support shaft 73 in the front-rear direction. The guide recess 74 is recessed inward, in the diametrical direction, from an outer peripheral surface of the support shaft 73 and extends in the left-right direction.

The engaging claw 75 is arranged in a right end portion of the guide recess 74. The engaging claw 75 protrudes outward, in the diametrical direction, from an inner surface of the guide recess 74 in the diametrical direction. An outer surface of the engaging claw 75 in the diametrical direction is inclined towards the outer side in the diametrical direction toward the left side.

The protrusion 78 is arranged at a right end portion of the support shaft 73. The protrusion 78 has a substantially cylindrical shape protruding rightward from a right surface of the support shaft 73 and having a diameter that is gradually decreased toward the right side. The protrusion 78 is fitted in a left end portion of the support shaft 36 (see FIG. 14A) of the toner cap 34. Thereby, the support shaft 73 of the gear cover 39 configures a support part, together with the support shaft 36 of the toner cap 34.

The stopper 79 has a substantially plate shape protruding rightward from a rear-upper peripheral edge part of the detection member accommodation part 82 and extending in the circumferential direction of the detection member accommodation part 82.

Figure 14A:
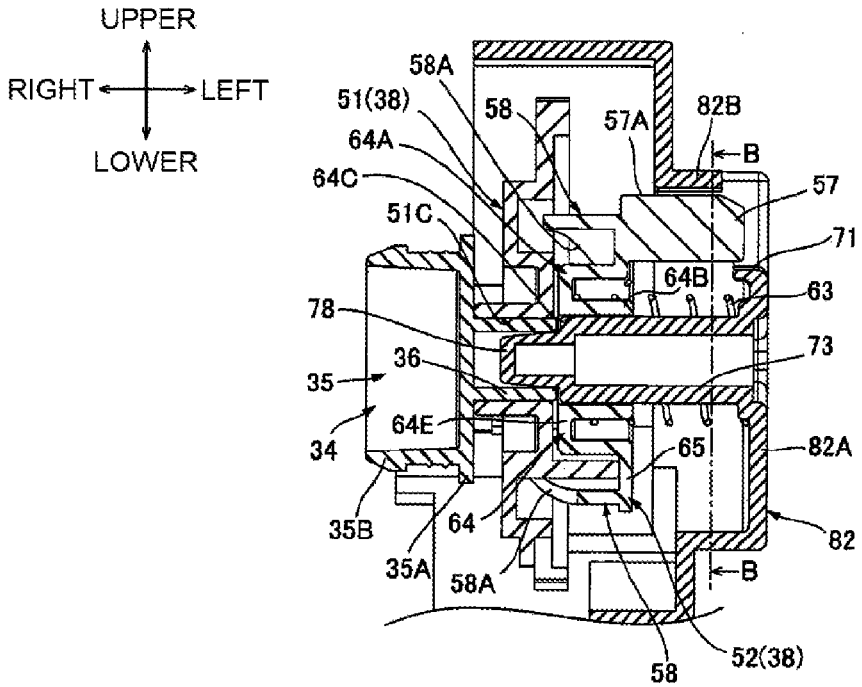
FIG. 14A is a sectional view taken along a line A-A of FIG. 1.

As shown in FIGS. 3A and 14A, the compression spring 63 is a coil spring extending in the left-right direction. A left end portion of the compression spring 63 abuts on the left wall 82A of the detection member accommodation part 82 of the gear cover 39. A right end portion of the compression spring 63 abuts on the right wall 64E of the outer cylinder 64A of the detection member 52. Thereby, the compression spring 63 always urges the detection member 52 rightward towards the developing frame 31.

(ii-4) Mounted State of Detection Unit

Hereinafter, a mounted state of the detection unit 38 is described. In the meantime, each of the four detection members 52 (the first detection member 52A, the second detection member 52B, the third detection member 52C and the fourth detection member 52D) is mounted to the developing cartridge 1 at the same mounted state. For this reason, in the below, description will be made by referring to the first detection member 52A of the four detection members 52.

As shown in FIG. 4A, the toothless gear 51 is rotatably supported by the support shaft 36 of the toner cap 34. The support shaft 36 of the toner cap 34 is fitted in the insertion hole 51C of the toothless gear 51 so that it can be relatively rotated.

The detection member 52 is supported by the support shaft 73 of the gear cover 39 so that it can move in the left-right direction.

Figure 11:
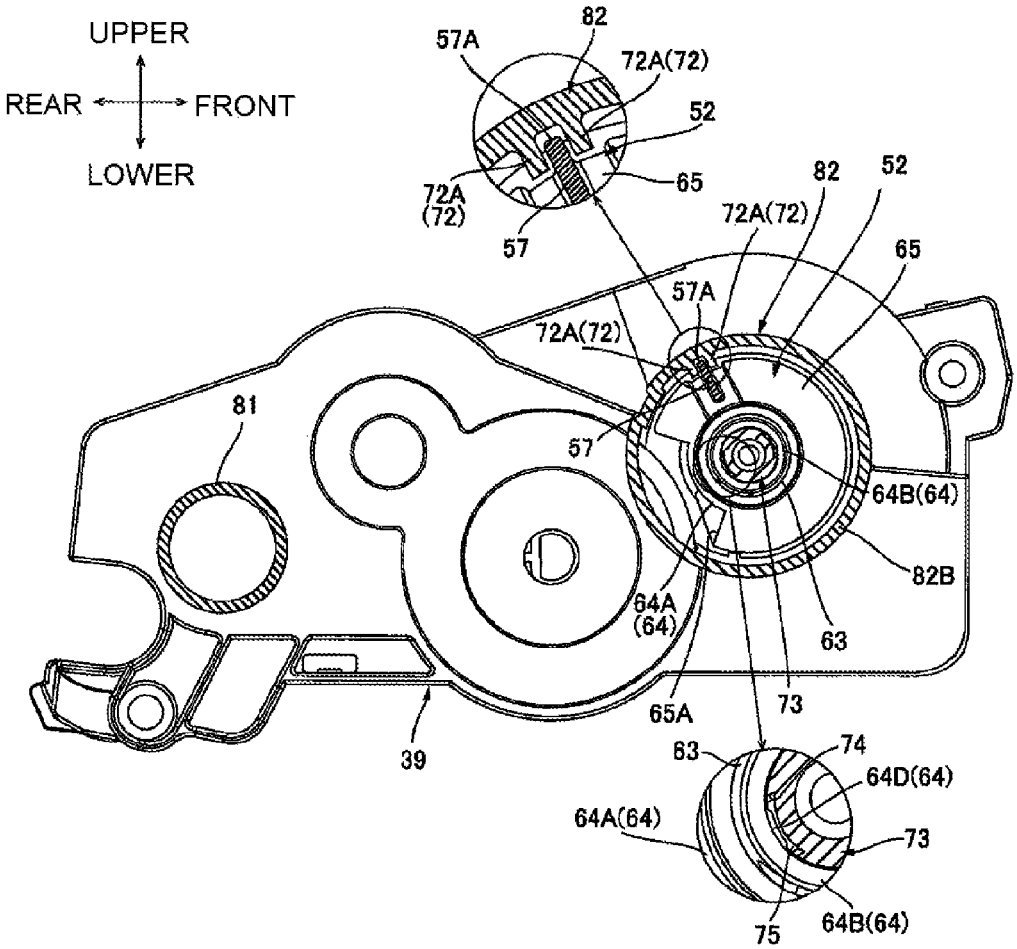
FIG. 11 is a sectional view taken along a line B-B of FIG. 14A, which illustrates engagement between a detection member accommodation part and a detection member.

The outer end portion 57A of the detection projection 57 in the diametrical direction is arranged between the pair of first guide parts 72A of the gear cover 39, as shown in FIG. 11.

The support shaft 73 of the gear cover 39 is fitted in the insertion hole 64C and the inner cylinder 64B of the detection member 52. The engaging projections 64D of the detection member 52 are fitted in the guide recesses 74 at the left of the engaging claws 75. Thereby, the detection member 52 is restrained from further moving rightward.

Also, as shown in FIGS. 1 and 3A, the left end portion of the detection projection 57 is arranged in the slit 71 of the gear cover 39.

Also, as shown in FIG. 15A, the front end portion of the first gear part 45A of the agitator gear 45 is arranged in the notched portion 65A of the detection member 52.

Figure 12A:
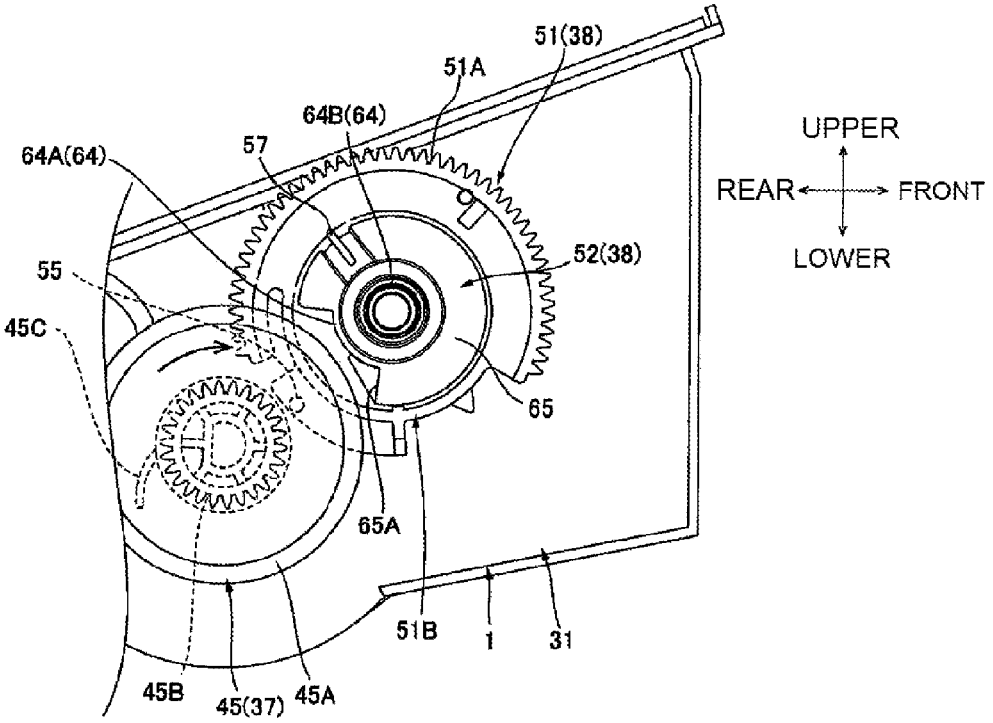
FIG. 12A illustrates a state where the toothless gear is arranged at a driving start position.

As shown in FIG. 12A, at a state where the developing cartridge 1 is not used yet, i.e., the developing cartridge 1 is a new product, a downstream end portion of the teeth part 51A of the toothless gear 51 in the counterclockwise direction is arranged at an interval above the front of the second gear part 45B of the agitator gear 45, as seen from a left side. A position of the toothless gear 51 at that time is a driving start position, which is an example of the first position.

Figure 12B:
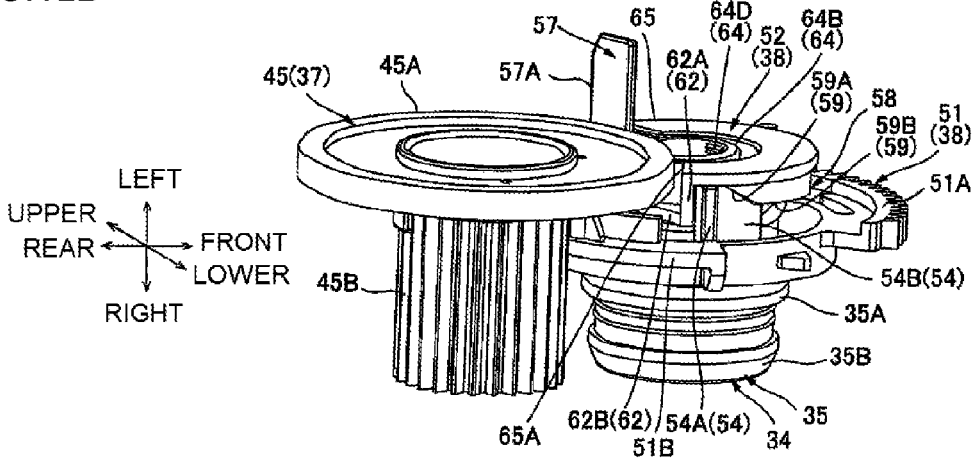
FIG. 12B illustrates that the toothless gear is restrained from rotating by the detection member at the state shown in FIG. 12A.

Also, as shown in FIG. 12B, the slide rib 54A of the toothless gear 51 faces the rear of the inclined surface 59A, at the front of the stopper rib 62A of the detection member 52. The toothless gear 51 is restrained from rotating in the clockwise direction by the stopper rib 62A, as seen from the left side, and is restrained from rotating in the counterclockwise direction by the inclined surface 59A, as seen from the left side. That is, at the driving start position, the toothless gear 51 is restrained from rotating by the stopper rib 62A and the base part 59.

Figure 14B:
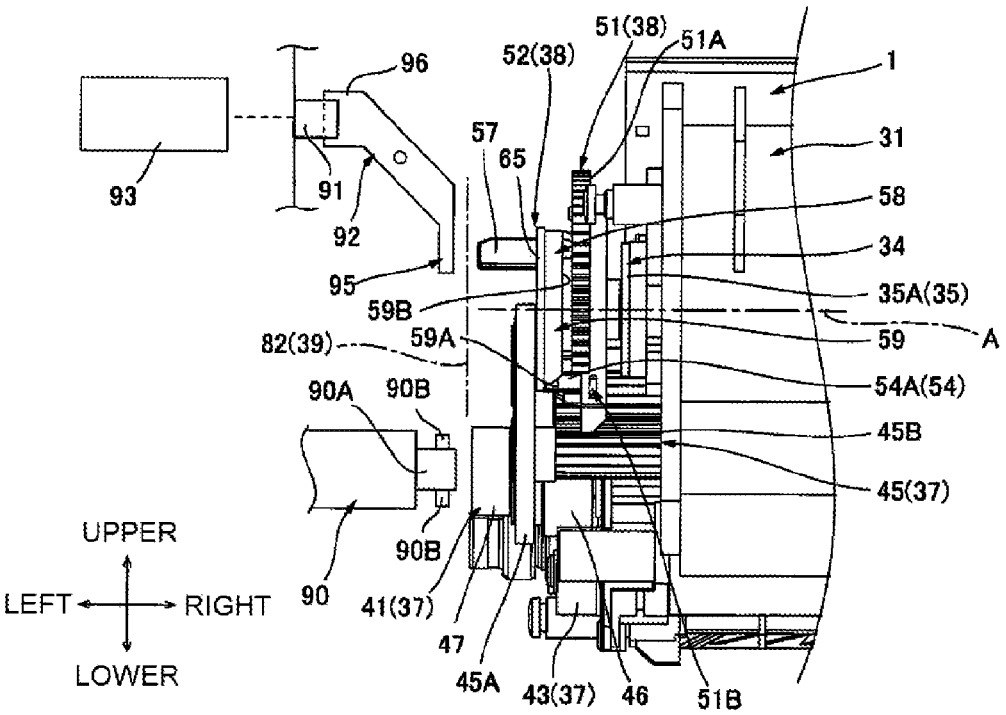
FIG. 14B is a front view of the developing cartridge shown in FIG. 3A.

Also, as shown in FIG. 14B, the detection member 52 is located at an accommodation position, which is an example of the original position at which the detection projection 57 is accommodated in the gear cover 39.

(ii-5) Driving Inspection of Developing Cartridge

Hereinafter, a driving inspection of the developing cartridge 1 is described.

An operator carries out a driving inspection of the developing cartridge 1 after the developing cartridge 1 has been completely assembled.

Figure 13A:
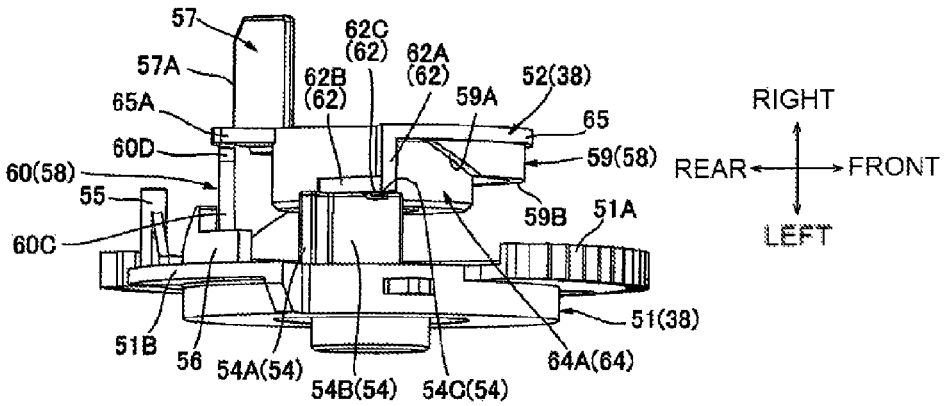
FIG. 13A is a bottom view of a detection unit at the time that a driving inspection of the developing cartridge is carried out.

In order to carry out the driving inspection of the developing cartridge 1, the operator first moves the detection member 52 leftward against the urging force of the compression spring 63, as shown in FIG. 13A, Then, the operator rotates the toothless gear 51 in the clockwise direction from the driving start position, as seen from the left side, thereby fitting the projection 62C of the stopper 62 of the detection member 52 into the recess portion 54C of the slide part 54 of the toothless gear 51.

Figure 13B:
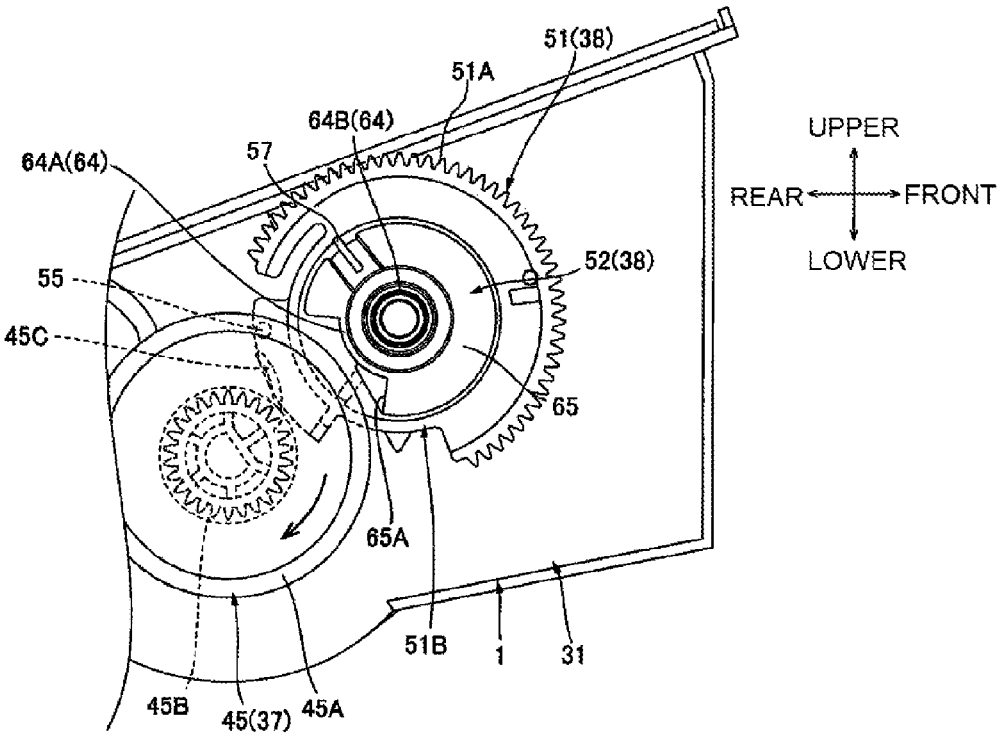
FIG. 13B is a side view of the detection unit at the state shown in FIG. 13A.

Thereby, as shown in FIG. 13B, the position of the toothless gear 51 is fixed at a position at which the boss 55 does not abut on the abutting rib 45C, i.e., at a driving inspection position, which is an example of the retreat position to which the toothless gear 51 is moved in the diametrically outer side of the agitator gear 45 up to an outer side of the moving trajectory of the abutting rib 45C, which is made when the toothless gear 51 is rotated.

Then, as shown in FIG. 3A, the operator inputs a driving force to the developing coupling 41. Thereby, the developing coupling 41 is rotated in the clockwise direction, as seen from the left side.

Thereby, the developing gear 42, the supply gear 43 and the idle gear 44 are rotated in the counterclockwise direction, as seen from the left side. Thereby, the developing roller 2 and the supply roller 3 are rotated in the counterclockwise direction, as seen from the left side.

Also, when the idle gear 44 is rotated, the agitator gear 45 is rotated in the clockwise direction, as seen from the left side, at the state where the toothless gear 51 is stopped at the driving inspection position. Thereby, the agitator 6 is rotated in the clockwise direction, as seen from the left side.

Then, after the operator checks that the developing roller 2, the supply roller 3 and the agitator 6 are rotated, the operator separates the projection 62C of the stopper 62 of the detection member 52 from the recess portion 54C of the slide part 54 of the toothless gear 51, and rotates the toothless gear 51 in the counterclockwise direction from the driving inspection position, as seen from the left side, thereby again arranging the toothless gear 51 at the driving start position. Further, the detection member 52 is again arranged at the accommodation position.

Thereby, the driving inspection of the developing cartridge 1 is completed.

4. Details of Apparatus Main Body

As shown in FIG. 14B, the apparatus main body 12 has a main body coupling 90, an optical sensor 91, an actuator 92, and a control unit 93.

The main body coupling 90 is arranged in the apparatus main body 12 so that it is positioned at the left of the developing cartridge 1. The main body coupling 90 has a substantially cylindrical shape extending in the left-right direction. The main body coupling 90 operates in accordance with the opening and closing of the front cover 17 of the apparatus main body 12. That is, when the front cover 17 is opened, the main body coupling 90 is retreated leftward to separate from the developing cartridge 1. When the front cover 17 is closed, the main body coupling 90 is advanced rightward towards the developing cartridge 1. The main body coupling 90 has an engaging shaft 90A.

The engaging shaft 90A is arranged at a right end portion of the main body coupling 90. The engaging shaft 90A has a substantially cylindrical shape protruding rightward from the right end portion of the main body coupling 90. The engaging shaft 90A is inserted in the inner space 47B (see FIG. 3A) of the coupling part 47 of the developing coupling 41 when the main body coupling 90 is advanced towards the developing cartridge 1. The engaging shaft 90A has a pair of engaging projections 90B.

Each of the pair of engaging projections 90B has a substantially rectangular column shape extending outward, in the diametrical direction, from each of both diametrical surfaces of the engaging shaft 90A, in a side view. The pair of engaging projections 90B faces the pair of protrusions 47A (see FIG. 3A) of the coupling part 47 when the engaging shaft 90A is inserted into the inner space 47B of the coupling part 47.

The optical sensor 91 is arranged in the apparatus main body 12 so that it is positioned at a left-upper side of the developing cartridge 1. The optical sensor 91 has a light emitting device and a light receiving device facing each other at an interval. The light emitting device always emits detection light towards the light receiving device. The light receiving device receives the detection light emitted from the light emitting device. The optical sensor 91 generates a light receiving signal when the light receiving device receives the detection light, and does not generate a light receiving signal when the light receiving device does not receive the detection light. The optical sensor 91 is electrically connected to the control unit 93.

The actuator 92 is arranged at the right of the optical sensor 91. The actuator 92 has a substantially rod shape extending in left-upper and right-lower directions and is rotatably supported at a predetermined part thereof in the upper-lower direction in the apparatus main body 12. The actuator 92 can be rotated to a non-detection position (see FIG. 14B) at which the detection light of the optical sensor 91 is shielded and a detection position (see FIG. 16B) at which the detection light of the optical sensor 91 is not shielded. The actuator 92 is all the time urged towards the non-detection position by an urging member (not shown). The actuator 92 has a pressed part 95 and a light shielding part 96.

The pressed part 95 is arranged at a right lower end portion of the actuator 92. The pressed part 95 has a substantially flat plate shape extending in the front-rear and upper-lower directions.

The light shielding part 96 is arranged at a left upper end portion of the actuator 92. The light shielding part 96 has a substantially flat plate shape extending in the upper-lower and left-right directions. The light shielding part 96 is positioned between the light emitting device and light receiving device of the optical sensor 91 when the actuator 92 is located at the non-detection position (see FIG. 14B), and is retreated rightward from between the light emitting device and light receiving device of the optical sensor 91 when the actuator 92 is located at the detection position (see FIG. 16B).

The control unit 93 has a circuit board having an application specific integrated circuit (ASIC) and is arranged in the apparatus main body 12. Also, the control unit 93 is configured to count the number of rotations of the developing roller 2.

5. Detection Operation

As shown in FIG. 2, when the process cartridge 13 having the developing cartridge 1 of which a maximum number of image formation sheets is 3,000 sheets is mounted to the apparatus main body 12 and the front cover 17 is closed, the main body coupling 90 (see FIG. 14B) in the apparatus main body 12 is fitted to the developing coupling 41 (see FIG. 14B) so that it cannot be relatively rotated, in accordance with the closing operation of the front cover 17.

After that, the control unit 93 starts a warm-up operation of the image forming apparatus 11.

When the warm-up operation of the image forming apparatus 11 starts, the engaging projections 90B of the main body coupling 90 are engaged with the protrusions 47A of the developing coupling 41.

Then, a driving force is input from the apparatus main body 12 to the developing coupling 41 through the main body coupling 90, and the developing coupling 41 is rotated in the clockwise direction, as seen from the left side, as shown in FIG. 3A.

Then, the developing gear 42, the supply gear 43 and the idle gear 44 are rotated in the counterclockwise direction, as seen from the left side. Thereby, the developing roller 2 and the supply roller 3 are rotated in the counterclockwise direction, as seen from the left side.

Also, when the idle gear 44 is rotated, the agitator gear 45 is rotated in the clockwise direction, as seen from the left side. Thereby, the agitator 6 is rotated in the clockwise direction, as seen from the left side.

When the agitator gear 45 is rotated, the abutting rib 45C is moved in the clockwise direction, as seen from the left side, in accordance with the rotation of the agitator gear 45, as shown in FIG. 15A. Then, the abutting rib 45C abuts on the boss 55 of the toothless gear 51 from a rear-upper side, thereby pressing the boss 55 in a front-lower direction. That is, the driving force from the developing coupling 41 is input to the toothless gear 51 through the agitator gear 45.

Figure 15B:
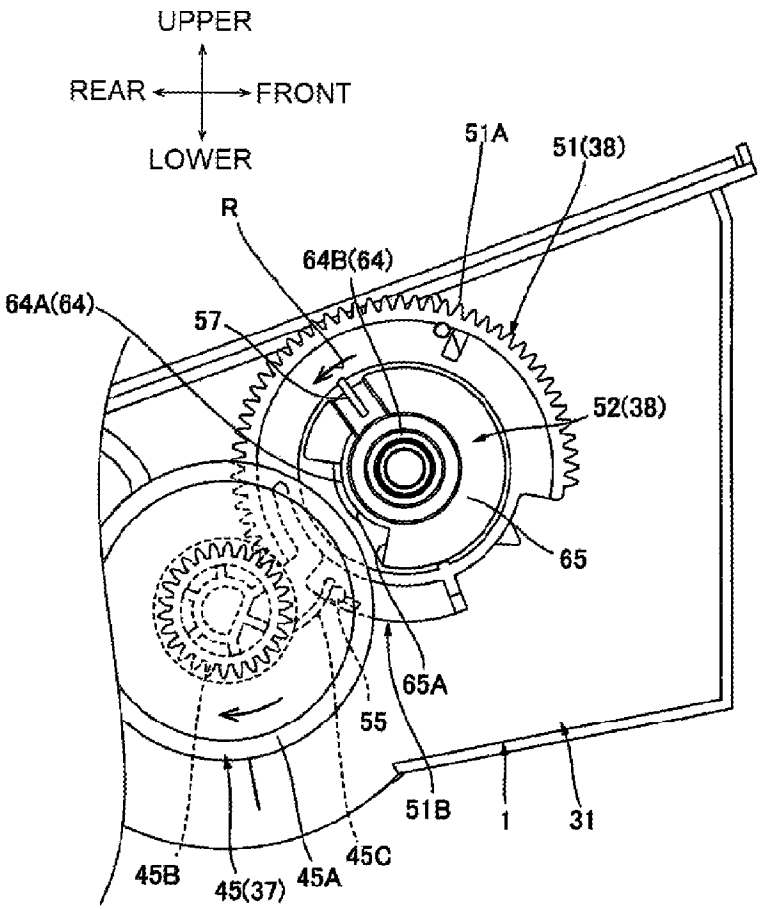
FIG. 15B illustrates the new product detection operation of the developing cartridge subsequent to FIG. 15A, which illustrates a state where a teeth part of the toothless gear is engaged with the agitator gear.
Figure 15A:
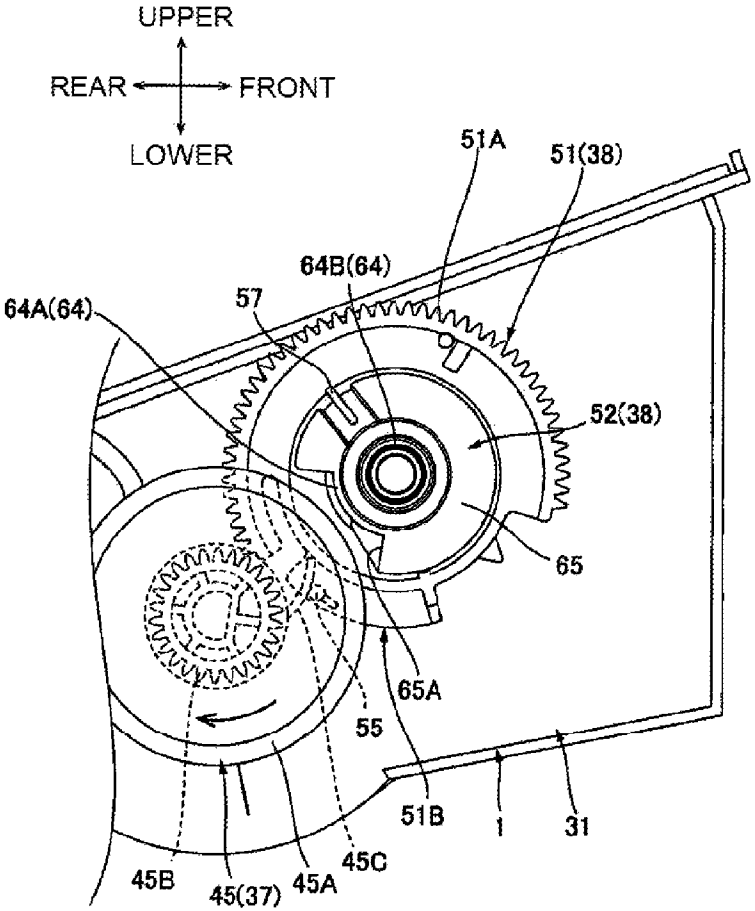
FIG. 15A illustrates a new product detection operation of the developing cartridge, which illustrates a state where an abutting rib of an agitator gear abuts on a boss of the toothless gear.

Thereby, the toothless gear 51 is rotated in the counterclockwise direction, as seen from the left side, and is engaged with the front upper end portion of the second gear part 45B of the agitator gear 45 at the gear teeth of the downstream end portion of the teeth part 51A in the counterclockwise direction, as seen from the left side, as shown in FIG. 15B. A position of the toothless gear 51 at that time is an example of the driving position.

Then, the driving force is transmitted from the agitator gear 45 to the toothless gear 51, and the toothless gear 51 is rotated about a central axis A (see FIG. 3A) of the support shaft 36 in the counterclockwise direction, as seen from the left side. Hereinafter, the counterclockwise direction as seen from the left side is referred to as a rotating direction R. The central axis A of the support shaft 36 is the rotational axis of the toothless gear 51.

Then, the slide rib 54A of the toothless gear 51 abuts on the inclined surface 59A of the base part 59 of the first detection member 52A from an upstream side in the rotating direction R, as shown in FIG. 12B.

Here, as described above, the outer end portion 57A of the detection projection 57 in the diametrical direction is arranged between the pair of first guide parts 72A of the gear cover 39 (see FIG. 11). Also, the engaging projections 64D of the detection member 52 are fitted in the guide recesses 74.

Thereby, the outer end portion 57A of the detection projection 57 in the diametrical direction abuts on the first guide part 72A at the downstream side in the rotating direction R and the engaging projections 64D abut on the inner surfaces of the guide recess 74 in the rotating direction, so that the detection projection 57 is restrained from being further rotated in the rotating direction R.

When the toothless gear 51 is further rotated, the slide rib 54A presses leftward the inclined surface 59A of the base part 59 while sliding along the same in the rotating direction R. Thereby, the first detection member 52A is gradually moved leftward to separate from the developing frame 31 against the urging force of the compression spring 63 while being restrained from rotating.

Figure 16B:
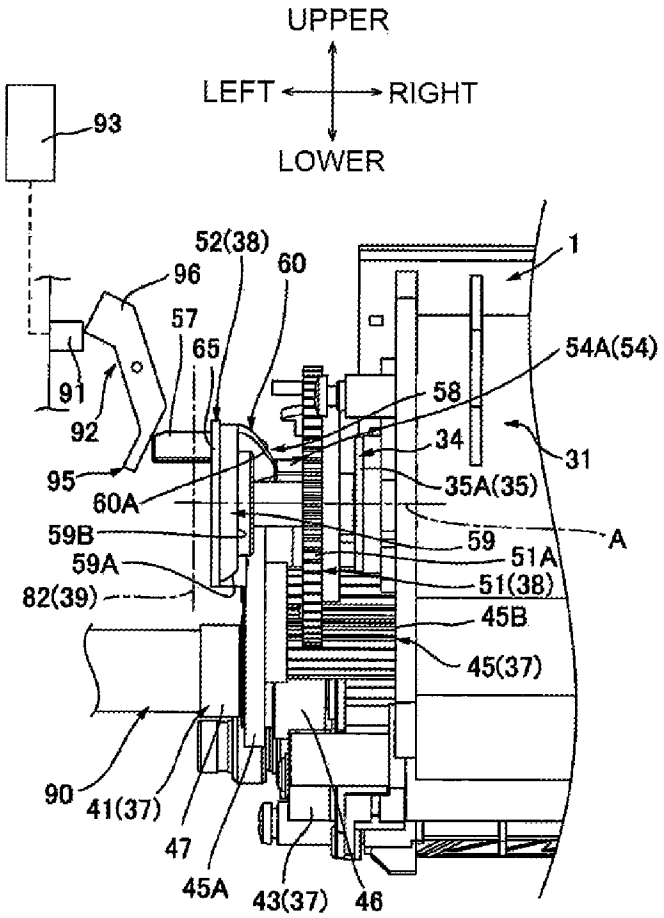
FIG. 16B illustrates the new product detection operation of the developing cartridge subsequent to FIG. 16A, which illustrates a state where the slide part of the toothless gear abuts on a parallel surface of a protruding part of the detection member, the detection member is located at an advance position and an actuator is located at a detection position.
Figure 16A:
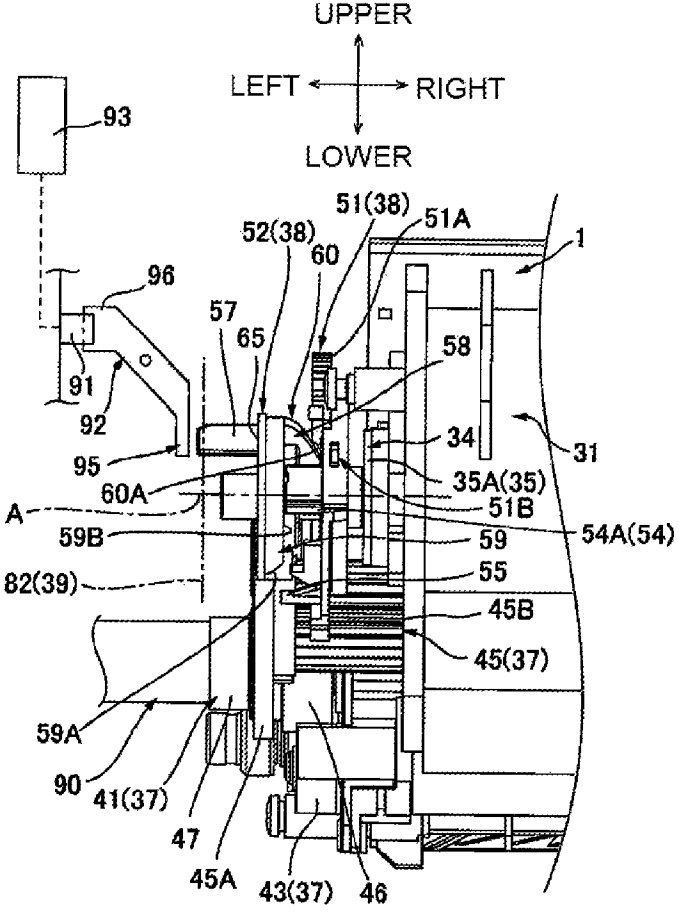
FIG. 16A illustrates the new product detection operation of the developing cartridge subsequent to FIG. 15B, which illustrates a state where a slide part of the toothless gear abuts on a parallel surface of a base part of the detection member and the detection member is located at a standby position.

Thereby, as shown in FIG. 16A, the detection projection 57 is moved leftward while being guided by the pair of first guide parts 72A. When the slide rib 54A abuts on the parallel surface 59B of the base part 59, the detection projection 57 is slightly advanced leftward beyond the gear cover 39. A position of the first detection member 52A at that time is a standby position, which is an example of the first advance position.

At this time, the detection projection 57 is arranged at a slight interval from the left of the pressed part 95 of the actuator 92. The actuator 92 is located at the non-detection position.

When the toothless gear 51 is further rotated, the slide rib 54A abuts on the first inclined surface 60A of the protruding part 60 of the first detection member 52A and presses leftward the first inclined surface 60A while sliding along the first inclined surface 60A in the rotating direction R. Thereby, the first detection member 52A is gradually moved leftward to further separate from the developing frame 31 against the urging force of the compression spring 63 while being restrained from rotating.

Then, the detection projection 57 is further advanced leftward through the slit 71 while being guided by the pair of first guide parts 72A, abuts on the pressed part 95 of the actuator 92 from right, and presses leftward the pressed part 95. Thereby, the actuator 92 swings in the clockwise direction from the non-detection position, as seen from the front.

Figure 17:
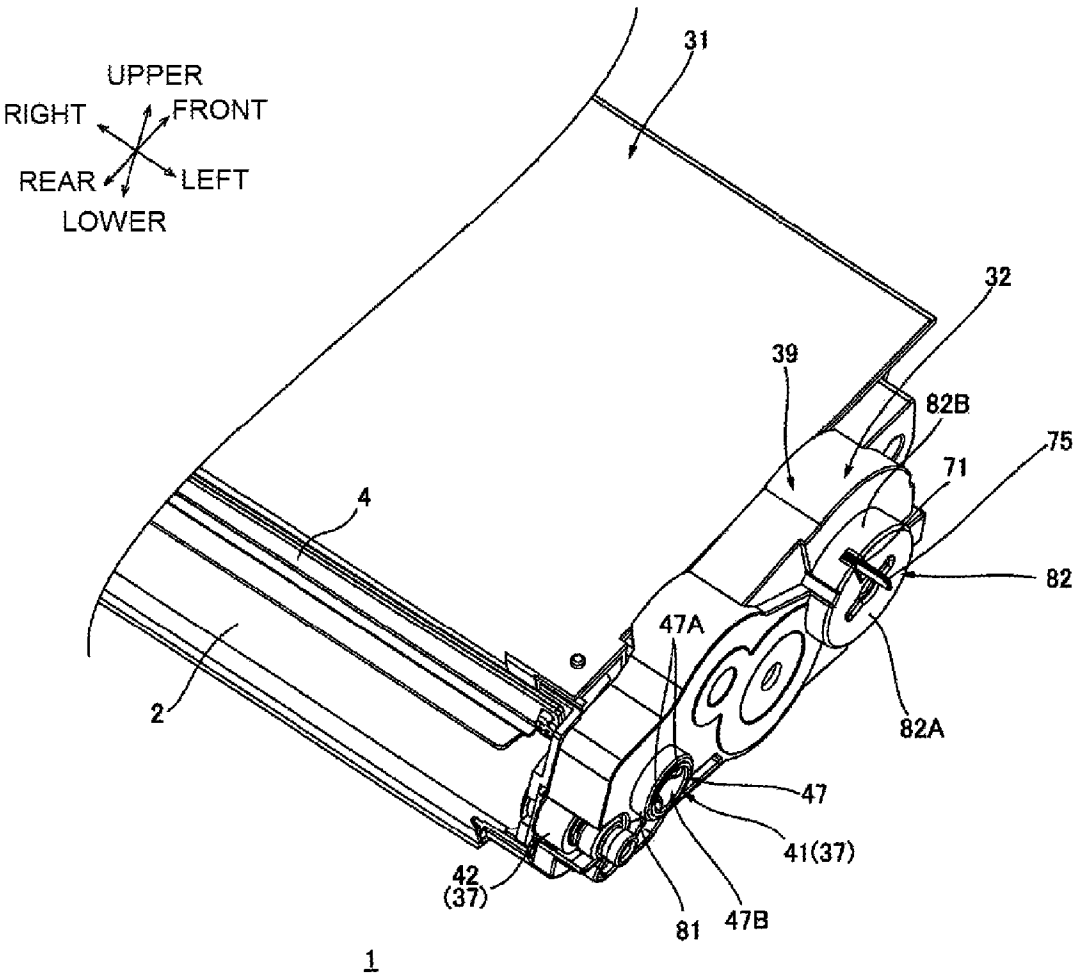
FIG. 17 is a perspective view of the developing cartridge at the state shown in FIG. 16B, as seen from a left-rear side.

Then, when the toothless gear 51 is further rotated, the detection projection 57 is advanced most leftward at the time that the slide rib 54A abuts on the parallel surface 60B of the protruding part 60, as shown in FIGS. 16B and 17. The position of the first detection member 52A at that time is an advance position, which is an example of the second advance position.

At this time, the actuator 92 is located at the detection position. The light shielding part 96 is retreated rightward between the light emitting device and light receiving device of the optical sensor 91. Thereby, the light receiving device of the optical sensor 91 receives the detection light, and the optical sensor 91 outputs a light receiving signal.

Then, the control unit 93 determines that the unused (new product) developing cartridge 1 has been mounted to the apparatus main body 12, because the light receiving signal is received from the optical sensor 91 within predetermined time after the warm-up operation starts. Thereby, the control unit 93 resets the counted number of rotations of the developing roller 2.

Then, when the toothless gear 51 is further rotated, the slide rib 54A abuts on the second inclined surface 60C of the protruding part 60 and slides along the second inclined surface 60C in the rotating direction R. Then, the first detection member 52A is gradually moved rightward to come close to the developing frame 31 by the urging force of the compression spring 63 while being restrained from rotating.

Thereby, the detection projection 57 is gradually retreated into the gear cover 39 and is spaced rightward from the pressed part 95 of the actuator 92. Then, the actuator 92 swings in the counterclockwise direction from the detection position, as seen from the front, and is located at the non-detection position.

Thereby, the light shielding part 96 of the actuator 92 is positioned between the light emitting device and light receiving device of the optical sensor 91.

Thus, the light receiving device of the optical sensor 91 does not receive the detection light and the optical sensor 91 stops the output of the light receiving signal.

Figure 18A:
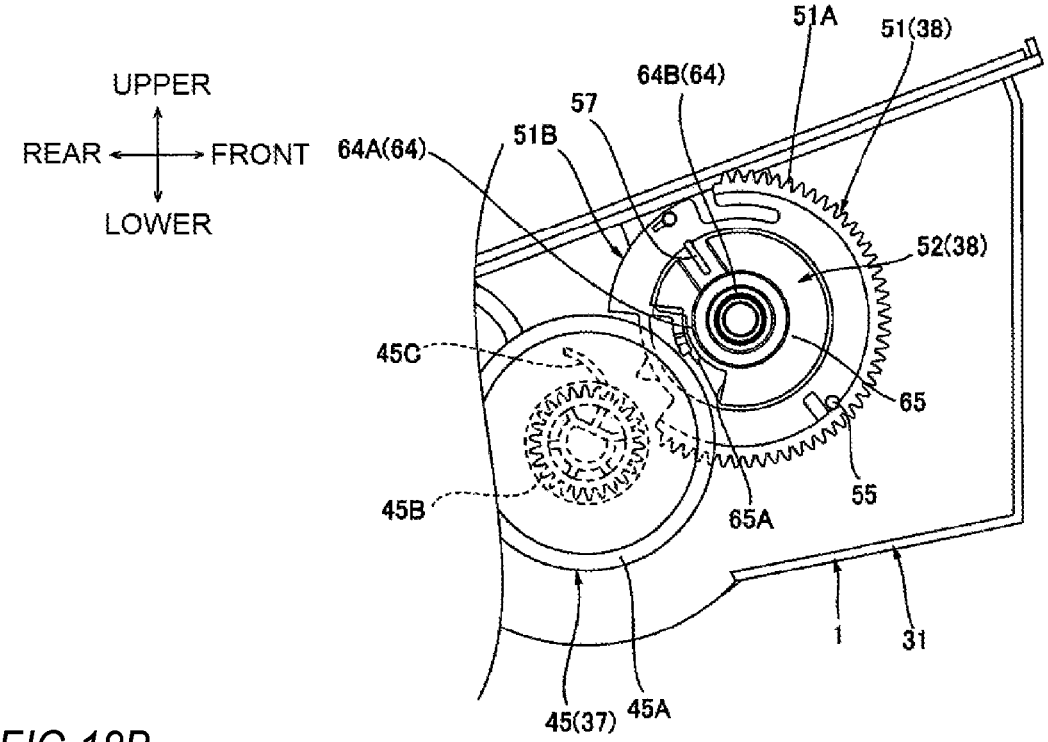
FIG. 18A illustrates the new product detection operation of the developing cartridge subsequent to FIG. 16B, which illustrates a state where the meshing between the teeth part of the toothless gear and the agitator gear is released.

Then, when the toothless gear 51 is further rotated, the teeth part 51A of the toothless gear 51 is spaced from the second gear part 45B of the agitator gear 45, so that the toothless gear 51 is stopped, as shown in FIG. 18A. Thereby, the reciprocating movement of the first detection member 52A is completed. The position of the toothless gear 51 at that time is a driving end position, which is an example of the second position.

Figure 18B:
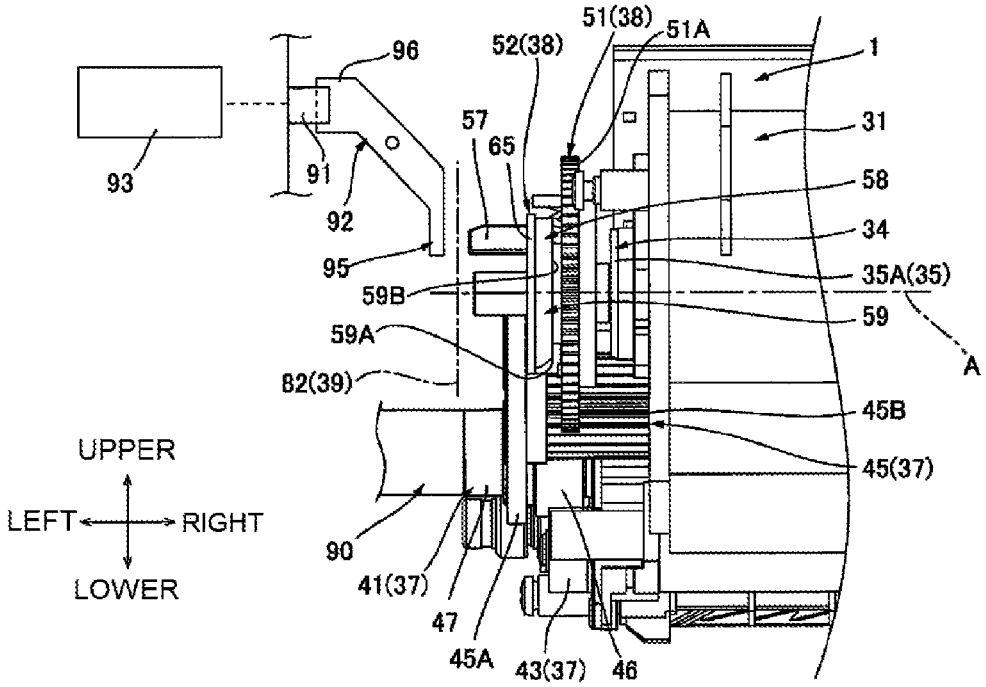
FIG. 18B is a front view of the developing cartridge shown in FIG. 18A, which illustrates a state where the detection member is located at an accommodation position and the actuator is located at a non-detection position.

At this time, as shown in FIG. 18B, the first detection member 52A is located at the accommodation position.

Figure 19B:
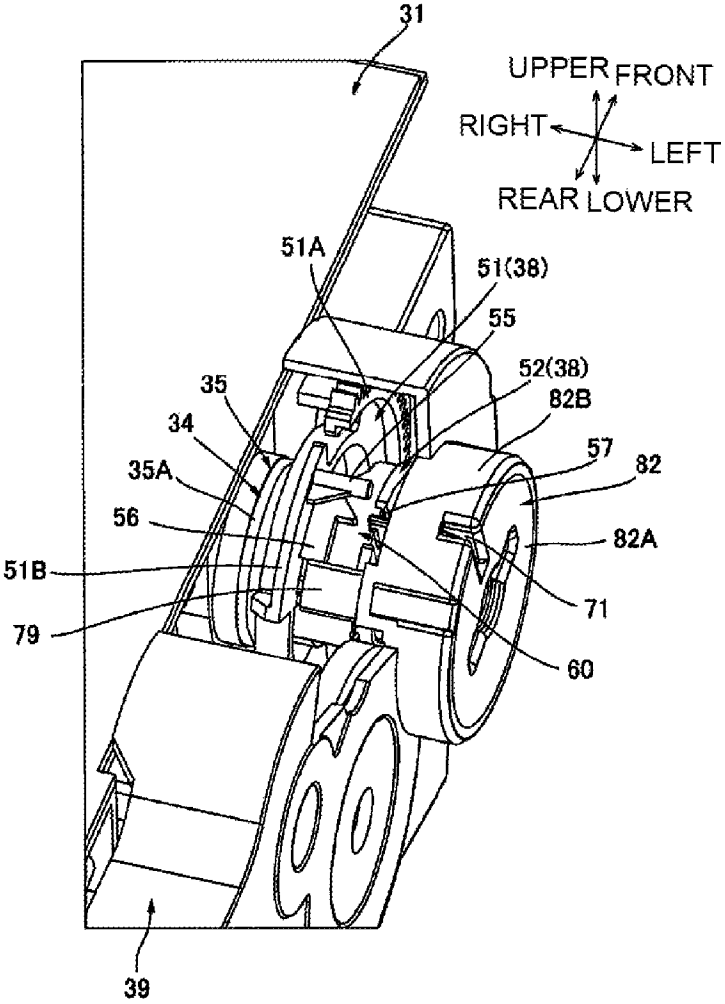
FIG. 19B illustrates the rotation restraint of the toothless gear by the detection member after the toothless gear is rotated, which illustrates a state where a stopper of the toothless gear faces a stopper of the gear cover.
Figure 19A:
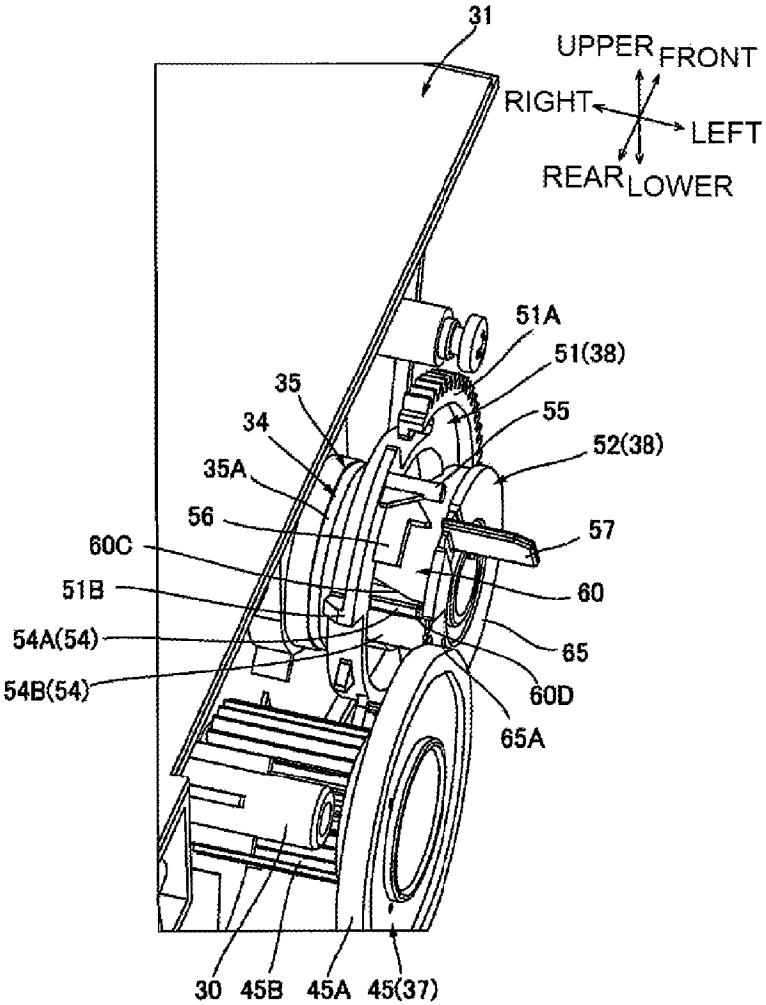
FIG. 19A illustrates the rotation restraint of the toothless gear by the detection member after the toothless gear is rotated, which illustrates a state where a slide rib faces an orthogonal surface of the protruding part of the detection member.

Also, as shown in FIG. 19A, the slide rib 54A of the toothless gear 51 faces a downstream side of the orthogonal surface 60D of the protruding part 60 of the first detection member 52A in the rotating direction R. Thereby, the toothless gear 51 is restrained from rotating in an opposite direction to the rotating direction R by the orthogonal surface 60D.

Also, as shown in FIG. 19B, the stopper 56 of the toothless gear 51 faces an upstream side of the stopper 79 of the gear cover 39 in the rotating direction R. Thereby, the toothless gear 51 is restrained from rotating in the rotating direction R by the stopper 79.

The control unit 93 determines that the developing cartridge 1 of which the maximum number of image formation sheets is 3,000 sheets has been mounted to the apparatus main body 12, if the light receiving signal is received one time after the warm-up operation starts.

On the other hand, in case that the process cartridge 13 having the developing cartridge 1 of which the maximum number of image formation sheets is 6,000 sheets is mounted to the apparatus main body 12, when the toothless gear 51 is rotated, the slide part 54 first abuts on the first base part 66 of the second detection member 52B (see FIG. 7A). Thereby, the slide rib 54A sequentially slides along the inclined surface 66A and parallel surface 66B of the first base part 66, so that the second detection member 52B is located at the standby position. Thereafter, the slide rib 54A slides along the first inclined surface 67A of the first protruding part 67 and abuts on the parallel surface 67B, so that the second detection member 52B is located at the advance position. After that, the slide rib 54A slides along the second inclined surface 67C and abuts on the parallel surface 69A of the second base part 69, so that the second detection member 52B is located at the standby position. Thereby, the first reciprocating movement of the second detection member 52B is completed. The optical sensor 91 outputs a first light receiving signal and then stops the output of the first light receiving signal.

Then, when the toothless gear 51 is further rotated, the slide rib 54A abuts on the second protruding part 68 of the second detection member 52B. Thereby, the second detection member 52B is located at the advance position and then at the retreat position, like the above case where the slide rib 54A abuts on the protruding part 60 of the first detection member 52A. As a result, the second time reciprocating movement of the second detection member 52B is completed. The optical sensor 91 outputs a second time light receiving signal and then stops the output of the second time light receiving signal.

The control unit 93 determines that the developing cartridge 1 of which the maximum number of image formation sheets is 6,000 sheets has been mounted to the apparatus main body 12 when the light receiving signal is received two times after the warm-up operation starts.

Also, in case that the process cartridge 13 having the developing cartridge 1 of which the maximum number of image formation sheets is 9,000 sheets is mounted to the apparatus main body 12, when the toothless gear 51 is rotated, the slide part 54 first abuts on the first base part 84 of the third detection member 52C (see FIG. 8A). Thereby, the slide rib 54A slides along the inclined surface 84A of the first base part 84 and subsequently slides along the inclined surface 85A of the first protruding part 85 and abuts on the parallel surface 85B, so that the third detection member 52C is located at the advance position. Thereafter, the slide rib 54A slides along the second inclined surface 85C and abuts on the parallel surface 86A of the second base part 86, so that the third detection member 52C is located at the standby position. Thereby, the first reciprocating movement of the third detection member 52C is completed. The optical sensor 91 outputs a first light receiving signal and then stops the output of the first light receiving signal.

Then, when the toothless gear 51 is further rotated, the slide rib 54A sequentially abuts on the second protruding part 87 and third protruding part 89 of the third detection member 52C. Thereby, the third detection member 52C is located in order of the advance position, the standby position, the advance position and the retreat position, like the above case where the slide rib 54A abuts on the first protruding part 67 and second protruding part 68 of the second detection member 52B. As a result, the second time and third time reciprocating movements of the third detection member 52C are completed. Also, the optical sensor 91 sequentially performs the operations of outputting a second time light receiving signal, stopping the output of the second time light receiving signal, outputting a third time light receiving signal and stopping the output of the third time light receiving signal.

The control unit 93 determines that the developing cartridge 1 of which the maximum number of image formation sheets is 9,000 sheets has been mounted to the apparatus main body 12 when the light receiving signal is received three times after the warm-up operation starts.

Also, in case that the process cartridge 13 having the developing cartridge 1 of which the maximum number of image formation sheets is 12,000 sheets is mounted to the apparatus main body 12, when the toothless gear 51 is rotated, the slide part 54 first abuts on the first base part 111 of the fourth detection member 52D (see FIGS. 9A and 9B). Thereby, the slide rib 54A slides along the inclined surface 111A of the first base part 111 and subsequently slides along the inclined surface 112A of the first protruding part 112 and abuts on the parallel surface 112B, so that the fourth detection member 52D is located at the advance position, like the above case where the slide rib 54A abuts on the first base part 84 and first protruding part 95 of the third detection member 52C. Thereafter, the slide rib 54A slides along the second inclined surface 112C and abuts on the parallel surface 113A of the second base part 113, so that the fourth detection member 52D is located at the standby position. Thereby, the first reciprocating movement of the fourth detection member 52D is completed. The optical sensor 91 outputs a first light receiving signal and then stops the output of the first light receiving signal.

Then, when the toothless gear 51 is further rotated, the slide rib 54A slides along the parallel surface 113A of the second base part 113 of the fourth detection member 52D in the rotating direction R and then abuts on the second protruding part 114 of the fourth detection member 52D. Thereby, the fourth detection member 52D is located at the advance position and then at the retreat position, like the above case where the slide rib 54A abuts on the second protruding part 68 of the second detection member 52B. As a result, the second time reciprocating movement of the fourth detection member 52D is completed. The optical sensor 91 outputs a second time light receiving signal and then stops the output of the second time light receiving signal.

The control unit 93 determines that the developing cartridge 1 of which the maximum number of image formation sheets is 12,000 sheets has been mounted to the apparatus main body 12 when the light receiving signal is received two times at a longer interval than the second detection member 52B after the warm-up operation starts.

Thereafter, when the predetermined time elapses, the control unit 93 ends the warm-up operation.

On the other hand, when the light receiving signal is not received from the optical sensor 91 within the predetermined time after the warm-up operation starts, the control unit 93 determines that the developing cartridge 1 used or being used is mounted to the apparatus main body 12.

6. Operational Effects (i) According to the developing cartridge 1, as shown in FIG. 17, it is possible to move the detection projection 57 only in the left-right direction while restraining the rotation thereof.

For this reason, as compared to a configuration where the detection projection 57 is moved in the rotating direction in accordance with the rotation of the detection member 52, it is possible to save space in a moving trajectory of the detection projection 57.

Also, as shown in FIG. 12B, the slide rib 54A is fitted between the stopper 62 of the detection member 52 and the displacement part 58, so that the toothless gear 51 is restrained from rotating at the driving start position before the toothless gear 51 is rotated.

When the driving force is input to the developing coupling 41, the developing coupling is rotated in the counterclockwise direction from the driving start position, as seen from the left side. Thereby, as shown in FIGS. 16A and 16B, the detection member 52 is moved leftward.

That is, it is possible to prevent the toothless gear 51 from receiving the driving force from the developing coupling 41 at an unintentional posture.

Also, after the driving force is input to the developing coupling 41, the detection member 52 is moved at predetermined timing by the rotation of the toothless gear 51. Thereby, it is possible to enable the apparatus main body 12 to recognize that the unused (new product) developing cartridge 1 has been mounted to the apparatus main body 12.

Also, since the rotation of the toothless gear 51 is restrained by the detection member 52, it is possible to restrain the rotation of the toothless gear 51 by keeping a relative arrangement between the detection member 52 and the toothless gear 51.

(ii) According to the developing cartridge 1, as shown in FIG. 16B, the slide rib 52A of the toothless gear 51 is enabled to abut on the protruding part 60 of the detection member 52, so that it is possible to press leftward the detection member 52 by the rotational driving force of the toothless gear 51.

(iii) According to the developing cartridge 1, as shown in FIG. 5C, the base part 59 and the protruding part 60 are continuous in the rotating direction R of the toothless gear 51.

For this reason, when the toothless gear 51 is rotated by the driving force from the developing coupling 41, the slide rib 54A of the toothless gear 51 continuously abuts from the base part 59 to the protruding part 60.

As a result, after the driving force is input to the developing coupling 41, it is possible to smoothly transmit the driving force of the toothless gear 51 to the detection member 52.

(iv) According to the developing cartridge 1, as shown in FIG. 5C, the base part 59 continues to the first inclined surface 60A of the protruding part 60 by the flat parallel surface 59B.

For this reason, as shown in FIGS. 16A and 16B, when the toothless gear 51 is rotated, the slide rib 54A of the toothless gear 51 continuously abuts from the base part 59 to the protruding part 60 via the flat parallel surface 59B.

As a result, it is possible to smoothly deliver the slide rib 54A from the base part 59 to the protruding part 60.

(v) According to the developing cartridge 1, as shown in FIG. 12B, before the driving force is input to the developing coupling 41, the slide rib 54A interferes with the inclined surface 59A of the base part 59 of the detection member 52, so that the toothless gear 51 is retrained from rotating in the rotating direction R.

Also, when the driving force is input to the developing coupling 41, the toothless gear 51 presses the inclined surface 59A of the base part 59 at the slide rib 54A.

At this time, it is possible to smoothly move the detection member 52 in a direction separating from the toothless gear 51 due to the inclination of the inclined surface 59A.

As a result, it is possible to keep the toothless gear 51 at a stopped state until the driving force is input to the developing coupling 41, and it is possible to smoothly rotate the toothless gear 51 after the driving force is input to the developing coupling 41.

(vi) According to the developing cartridge 1, as shown in FIG. 12B, the slide rib 54A is restrained from both sides in the rotating direction R by the stopper 62 and the base part 59 of the detection member 52, so that it is possible to restrain the toothless gear 51 at the driving start position.

Also, since the stopper 62 extends in the left-right direction, it is possible to reliably restrain the toothless gear 51 from being rotated in the opposite direction of the rotating direction R.

As a result, it is possible to restrain the toothless gear 51 at the driving start position until the driving force is input to the developing coupling 41.

(vii) According to the developing cartridge 1, as shown in FIGS. 7A, 8A and 9B, the second detection member 52B, the third detection member 52C and the fourth detection member 52D have the plurality of protruding parts, respectively.

When the toothless gear 51 is rotated, the slide rib 54A of the toothless gear 51 sequentially abuts on the plurality of protruding parts.

Thereby, it is possible to move the detection member 52 a plurality of times after the driving force is input to the developing coupling 41.

As a result, it is possible to secure a degree of freedom of the detection pattern, as compared to a configuration where the detection member 52 is moved only once.

(viii) According to the developing cartridge 1, as shown in FIG. 14B, when the developing cartridge 1 is not in use (new product) and the detection member 52 is not detected by the configuration of the apparatus main body 12, the detection member 52 is covered with the left wall 82A of the detection member accommodation part 82 of the gear cover 39, so that it is possible to reliably prevent an interference with a surrounding member.

As a result, it is possible to further protect the detection member 52.

(ix) According to the developing cartridge 1, as shown in FIG. 19B, after the rotation of the toothless gear 51 is over, it is possible restrain the toothless gear 51 at the driving end position by the stopper 79 of the gear cover 39.

As a result, it is possible to rotate the toothless gear 51 from the driving start position (see FIG. 15A) by a predetermined driving amount and then to stop the same at the driving end position (see FIG. 18A).

(x) According to the developing cartridge 1, as shown in FIG. 19A, after the rotation of the toothless gear 51 is over, it is possible to restrain the toothless gear 51 at the driving end position by the orthogonal surface 60D of the detection member 52.

For this reason, it is possible to restrain the toothless gear 51 at the driving end position by the stopper 79 of the gear cover 39 and the orthogonal surface 60D of the detection member 52.

As a result, it is possible to reliably restrain the toothless gear 51 at the driving end position after the toothless gear 51 is rotated.

(xi) According to the developing cartridge 1, as shown in FIGS. 14A and 18B, it is possible to reliably retreat the detection member 52 rightward by the urging force of the compression spring 63.

As a result, it is possible to suppress the interference between the detection member 52 and the surrounding member with the simple configuration.

(xii) According to the developing cartridge 1, as shown in FIG. 14A, the gear cover 39 has the support shaft 73 that supports the detection member 52, and the toner cap 34 has the support shaft 36 that supports the toothless gear 51.

For this reason, it is possible to support the toothless gear 51 and the detection member 52 while reducing the number of components by using the gear cover 39 and the toner cap 34.

Also, the toothless gear 51 is supported by the support shaft 36 of the toner cap 34, so that it is possible to rotate the rotary member at a position close to the developing frame 31.

Thereby, it is possible to stably rotate the toothless gear 51.

Further, the detection member 52 is supported by the support shaft 73 of the gear cover 39 positioned at the left of the developing frame 31.

For this reason, it is possible to stably advance the detection member 52 leftward.

As a result, it is possible to stably advance the detection member 52 leftward by the driving force input from the toothless gear 51 being stably rotated.

(xiii) According to the developing cartridge 1, it is possible to operate the developing cartridge 1 with the toothless gear 51 being stopped after the driving force is input from the apparatus main body 12 to the developing coupling 41 and until the abutting rib 45C of the agitator gear 45 abuts on the boss 55 of the toothless gear 51, as shown in FIG. 8A.

Thereafter, the abutting rib 45C of the agitator gear 45 abuts on the boss 55 of the toothless gear 51, so that it is possible to transmit the driving force from the agitator gear 45 to the toothless gear 51.

Thereby, after the developing cartridge 1 operates stably, the driving force is transmitted from the agitator gear 45 to the toothless gear 51, thereby moving the detection member 52.

As a result, it is possible to enable the apparatus main body 12 to detect the detection member 52 while the developing cartridge 1 is stably operating.

(xv) According to the developing cartridge 1, as shown in FIGS. 13A and 13B, it is possible to check the driving transmission of the developing cartridge 1 at a state where the driving force is input to the developing coupling 41 with the toothless gear 51 being fixed at the driving inspection position and the transmission of the driving force from the agitator gear 45 to the toothless gear 51 is released.

(xvi) According to the developing cartridge 1, as shown in FIG. 15A, the front end portion of the agitator gear 45 is positioned within the notched portion 65A of the detection member 52.

For this reason, it is possible to closely arrange the detection member 52 and the agitator gear 45 in the front-rear direction.

As a result, it is possible to make the developing cartridge 1 small.

(xvii) According to the developing cartridge 1, as shown in FIG. 1, in the configuration where the developing roller 2 is provided, the apparatus main body 12 can be enabled to recognize that the unused (new product) developing cartridge 1 has been mounted.

(xviii) According to the developing cartridge 1, as shown in FIG. 11, it is possible to move the detection member in the left-right direction while guiding the same with the guide rib 72.

Thereby, it is possible to stably move the detection member 52 leftward, thereby bringing the detection projection 57 into stable contact with the actuator 92 of the apparatus main body 12.

(xix) According to the developing cartridge 1, as shown in FIGS. 16A and 16B, upon the first movement after the driving force from the toothless gear 51 is received, the detection member 52 is moved from the accommodation position to the standby position and then moved to the advance position.

For this reason, until the driving force is input to the developing coupling 41, it is possible to position the detection member 52 at the accommodation position close to the developing frame 31 and to thus protect the detection projection 57 from the interference with the surrounding member.

Also, after the driving force is input to the developing coupling 41, the detection member 52 is temporarily moved from the accommodation position to the standby position, and is then located at the advance position at predetermined timing. Thereby, it is possible to enable the apparatus main body 12 to recognize that the unused (new product) developing cartridge 1 has been mounted.

8. Modified Embodiments

(i) First Modified Embodiment

Figure 20A:
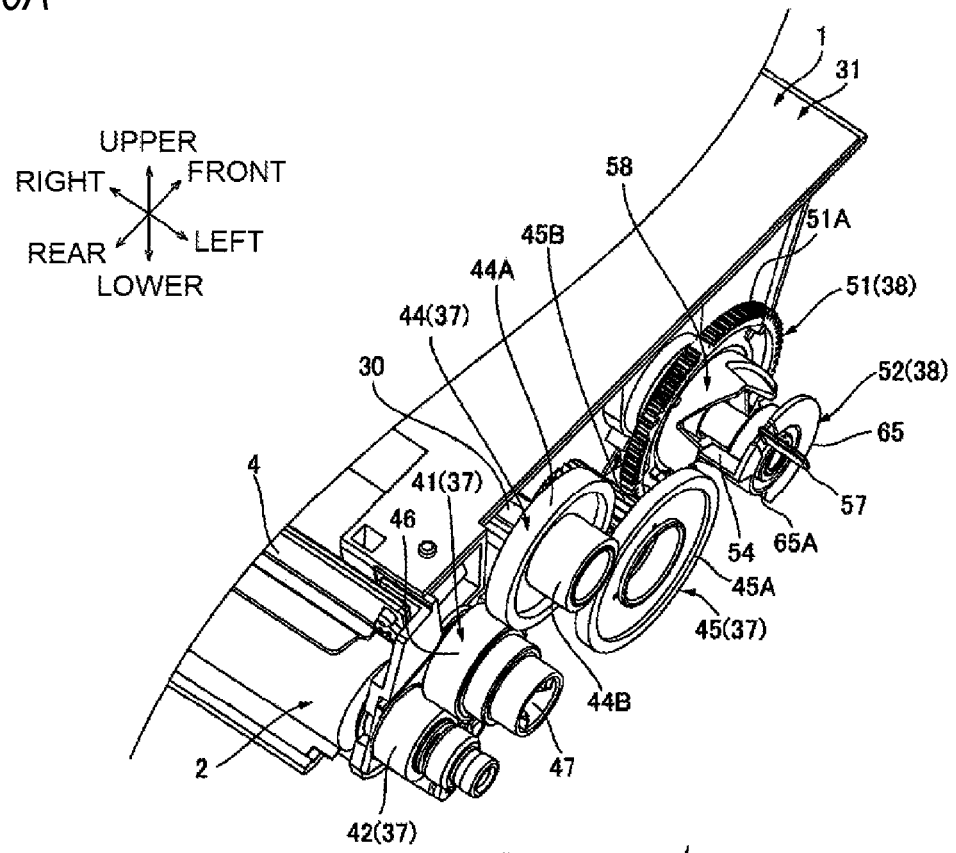
FIG. 20A illustrates a first modified embodiment of the developing cartridge.

In the first illustrative embodiment, the detection member 52 is provided with the displacement part 58, and the toothless gear 51 is provided with the slide part 54. However, as shown in FIG. 20A, the toothless gear 51 may be provided with the displacement part 58, and the detection member 52 may be provided with the slide part 54.

Also in the first modified embodiment, it is possible to accomplish the same operational effects as the first illustrative embodiment.

(ii) Second Modified Embodiment

Figure 20B:
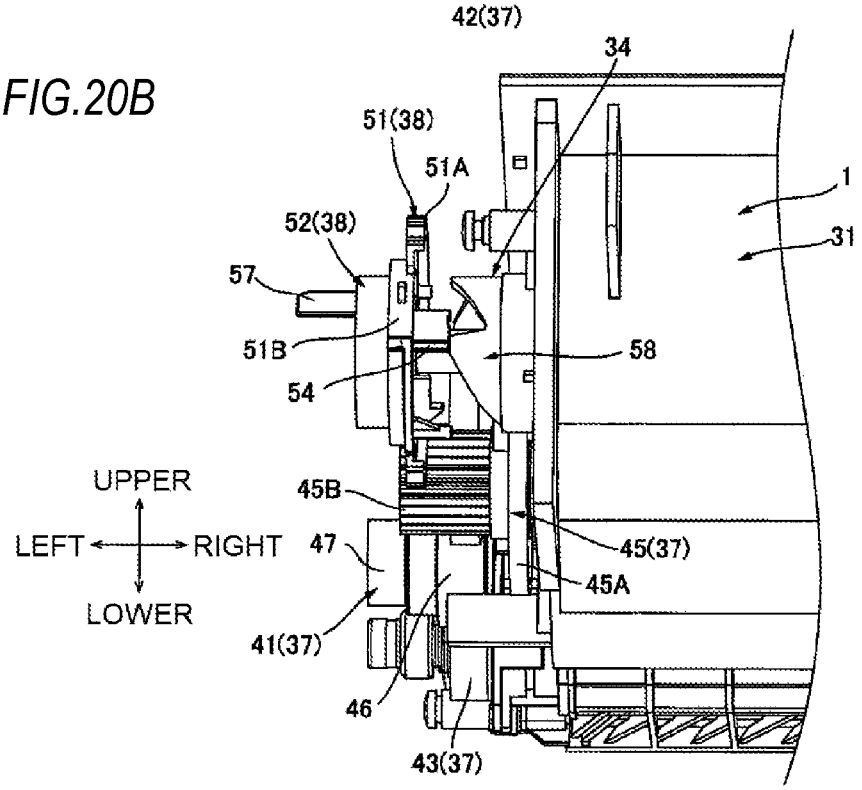
FIG. 20B illustrates a second modified embodiment of the developing cartridge.

Also, as shown in FIG. 20B, the toner cap 34 may be provided with the displacement part 58, and the toothless gear 51 may be provided with the slide part 54.

Also, in this case, the developing frame 31 may be provided with the displacement part 58.

Also in the second modified embodiment, it is possible to accomplish the same operational effects as the first illustrative embodiment.

(iii) Third Modified Embodiment

Figure 21A:
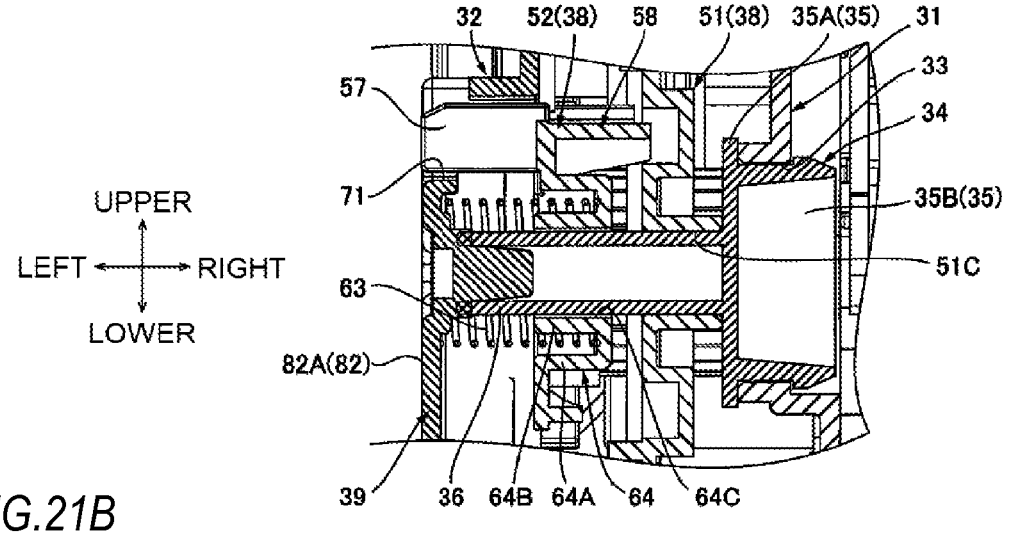
FIG. 21A illustrates a third modified embodiment of the developing cartridge.

In the first illustrative embodiment, the support 36 of the toner cap 34 supports the toothless gear 51, and the support shaft 73 of the gear cover 39 supports the detection member 52. However, as shown in FIG. 21A, the gear cover 39 may not be provided with the support shaft 73 and the support shaft 36 of the toner cap 34 may be elongated in the left-right direction to support the toothless gear 51 and the detection member 52 to the support shaft 36 of the toner cap 34.

Also in the third modified embodiment, it is possible to accomplish the same operational effects as the first illustrative embodiment.

(iv) Fourth Modified Embodiment

Figure 21B:
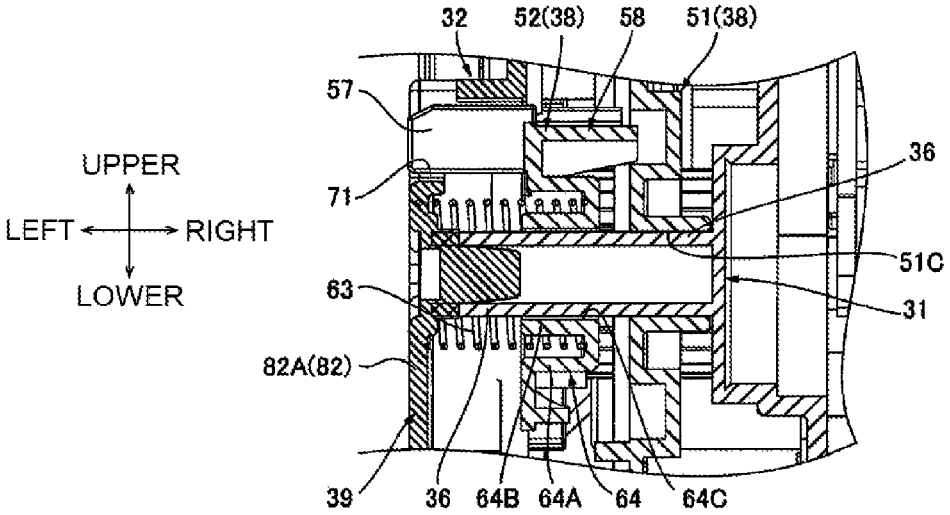
FIG. 21B illustrates a fourth modified embodiment of the developing cartridge.

In the third modified embodiment, the toner cap 34 is provided with the support shaft 36. However, as shown in FIG. 21B, the support shaft 36 may be provided on the left wall of the developing frame 31.

Also in the fourth modified embodiment, it is possible to accomplish the same operational effects as the first illustrative embodiment.

(v) Fifth Modified Embodiment

Figure 21C:
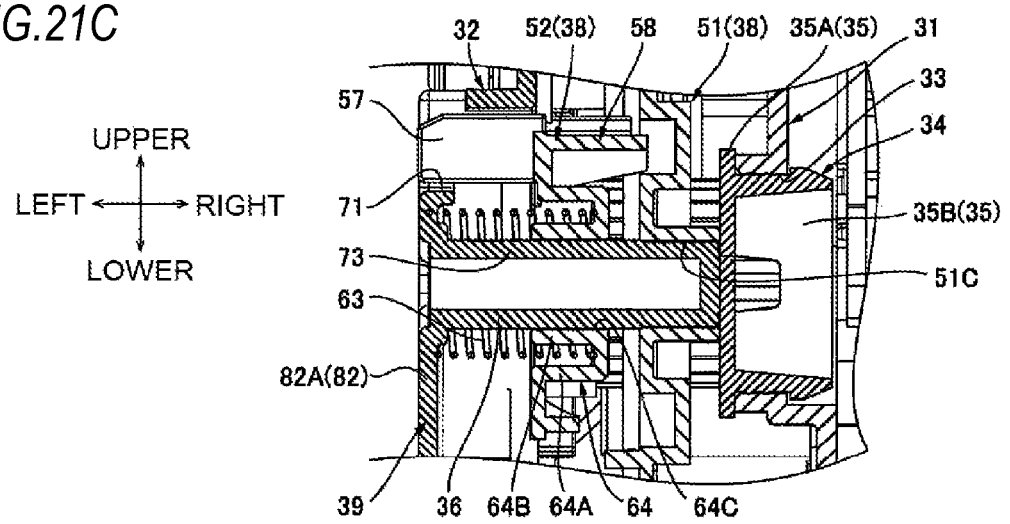
FIG. 21C illustrates a fifth modified embodiment of the developing cartridge.

Also, as shown in FIG. 21C, the toner cap 34 may not be provided with the support shaft 36 and the gear cover 39 may be configured with the support shaft 73 elongated in the left-right direction to support the toothless gear 51 and the detection member 52 to the support shaft 73 of the gear cover 39.

Also, in this case, the support shaft 73 provided to the gear cover 39 may be supported with the developing frame 31, instead of the toner cap 34.

Also in the fifth modified embodiment, it is possible to accomplish the same operational effects as the first illustrative embodiment.

(vi) Sixth Modified Embodiment

In the first illustrative embodiment, the toothless gear 51 has been exemplified as the rotary member, and the agitator gear 45 has been exemplified as the transmission member. However, the rotary member and the transmission member are not limited to the gear.

For example, the rotary member and the transmission member may be configured by friction wheels having no gear teeth.

Specifically, as shown in FIG. 22, the second gear part 45B of the agitator gear 45 may be provided with a first resistance applying member 123 of which at least an outer peripheral surface is configured by a material having a relatively large friction coefficient such as rubber, instead of the gear teeth, a transmitted part 121A of a rotary member 121 may be provided with a second resistance applying member 122 of which at least an outer peripheral surface is configured by a material having a relatively large friction coefficient such as rubber, instead of the gear teeth, and the driving force may be transmitted through friction between the resistance applying members.

Also, in this case, the second gear part 45B of the agitator gear 45 may be configured to have the gear teeth and only the transmitted part 121A of the rotary member 121 may be provided with the second resistance applying member 122 of which the outer peripheral surface is configured by the material having a relatively large friction coefficient such as rubber.

Also in the sixth modified embodiment, it is possible to accomplish the same operational effects as the first illustrative embodiment.

(vii) Seventh Modified Embodiment

Figure 23A:
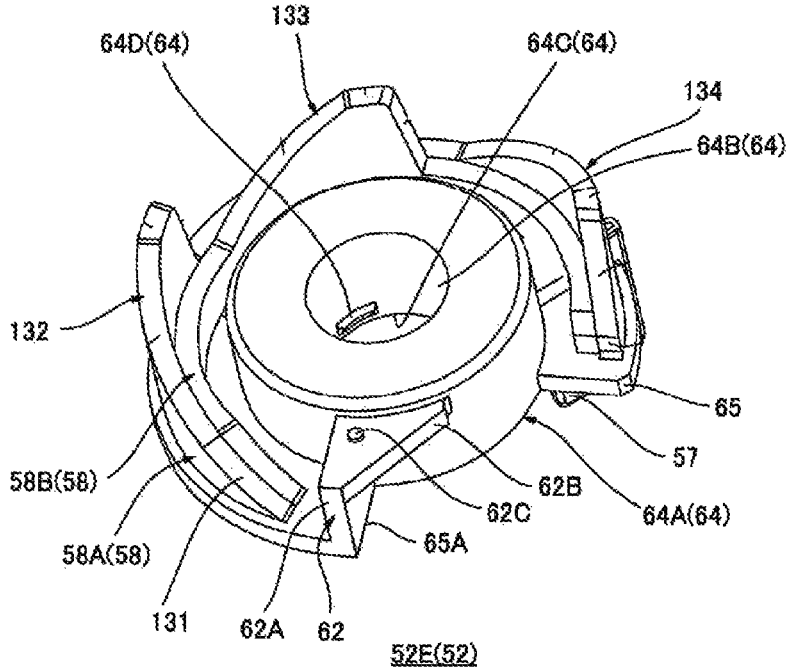
FIG. 23A is a perspective view for illustrating a seventh modified embodiment of the developing cartridge, as seen from a right-lower side.
Figure 23B:
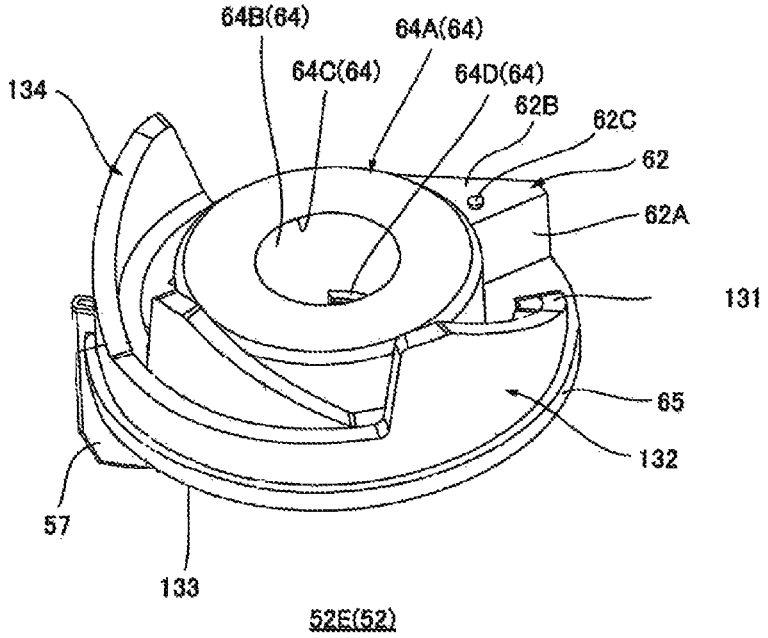
FIG. 23B is a perspective view for illustrating the seventh modified embodiment of the developing cartridge, as seen from a right-front side.

In the first illustrative embodiment, the one displacement part 58 of the third detection member 52C and the like is provided with the plurality of protruding parts. However, for example, like a fifth detection member 52E shown in FIGS. 23A and 23B, two displacement parts 58 may be arranged to overlap with each other in the diametrical direction of the detection member 52 and the diametrically outer-side displacement part 58A and the diametrically inner-side displacement part 58B may be provided with the protruding part, respectively. That is, the plurality of displacement parts 58 may be arranged to deviate each other in the diametrical direction of the detection member 52.

Specifically, the diametrically outer-side displacement part 58A may be provided with a first base part 131, a first protruding part 132 and a third protruding part 134, and the diametrically inner-side displacement part 58B may be provided with a second protruding part 133.

Also in the seventh modified embodiment, it is possible to accomplish the same operational effects as the first illustrative embodiment.

(viii) Other Modified Embodiments

In the first illustrative embodiment, the developing coupling 41 has been exemplified as the driving receiving part. However, the driving receiving part is not limited to the shaft coupling such as the developing coupling 41 and may be a gear, for example.

Also, in the first illustrative embodiment, the developing cartridge 1 having the developing roller 2 has been exemplified as the cartridge. However, the cartridge may be configured by a toner cartridge having only the toner accommodating portion 5, without the developing roller 2 and the supply roller 3, for example.

Also, in the first illustrative embodiment, the developing roller 2 has been exemplified as the developer carrier. However, for example, a developing sleeve and the like may also be applied as the developer carrier.

Also, in the first illustrative embodiment, the agitator gear 45 supported by the rotary shaft of the agitator 6 has been exemplified as the transmission member. However, the transmission member may be configured by an idle gear, which is not coupled to the rotary shaft of the agitator 6 and is supported by the left wall of the developing frame 31.

Also, in the first illustrative embodiment, the compression spring 63 has been exemplified as the urging member. However, a shape of the urging member is not limited to the coil shape, and a plate spring and the like may also be applied, for example.

Also, in the first illustrative embodiment, when the detection member 52 is advance and retreated a plurality of times, the second detection member 52B, the third detection member 52C and the fourth detection member 52D are once moved from the accommodation position to the standby position and are then located at the advance position and are thereafter reciprocally moved between the standby position and the advance position. That is, the movement distance of the detection member 52 during the second and thereafter advancing operations is shorter than the movement distance of the detection member 52 during the first advancing operation.

However, the movement distances of the detection member 52 during the respective advancing operations may be the same or may be all different.

Also, during one advancing and retreating operation, the movement distance of the detection member 52 during the advancing operation and the movement distance of the detection member 52 during the retreating operation may be the same or different.

Also, in the first illustrative embodiment, the detection projection 57 is completely accommodated in the gear cover 39 at the state where the detection member 52 is located at the accommodation position. However, the detection projection 57 may slightly protrude from the gear cover 39 at the state where the detection member 52 is located at the accommodation position.

Also, in the first illustrative embodiment, both sidewalls of the developing frame 31 in the left-right direction extend in the front-rear direction, respectively. However, at least one of both sidewalls of the developing frame 31 in the left-right direction may be inclined relative to the front-rear direction.

Also, in the first illustrative embodiment, the idle gear support shaft 30 is integrally provided to the developing frame 31. However, the idle gear support shaft 30 may be configured as a separate member from the developing frame 31.

Also, in the first illustrative embodiment, the support shaft (not shown) that supports the developing coupling 41 is integrally provided to the developing frame 31. However, the support shaft (not shown) that supports the developing coupling 41 may be configured as a separate member from the developing frame 31.

Also, in the first illustrative embodiment, the maximum number of image formation sheets corresponding to the first detection member 52A is set to 3,000 sheets, the maximum number of image formation sheets corresponding to the second detection member 52B is set to 6,000 sheets, the maximum number of image formation sheets corresponding to the third detection member 52C is set to 9,000 sheets, and the maximum number of image formation sheets corresponding to the fourth detection member 52D is set to 12,000 sheets.

However, the maximum number of image formation sheets corresponding to each of the detection members 52 may be appropriately set. For example, the maximum number of image formation sheets corresponding to the first detection member 52A may be set to 12,000 sheets, the maximum number of image formation sheets corresponding to the second detection member 52B may be set to 9,000 sheets, the maximum number of image formation sheets corresponding to the third detection member 52C may be set to 6,000 sheets, and the maximum number of image formation sheets corresponding to the fourth detection member 52D may be set to 3,000 sheets.

Also, the numerical values of the maximum number of image formation sheets are not limited to the above numerical values and may be appropriately set. For example, the maximum number of image formation sheets corresponding to the first detection member 52A may be set to 1,500 sheets, the maximum number of image formation sheets corresponding to the second detection member 52B may be set to 2,000 sheets, the maximum number of image formation sheets corresponding to the third detection member 52C may be set to 4,000 sheets, and the maximum number of image formation sheets corresponding to the fourth detection member 52D may be set to 7,000 sheets.

Also, in the first illustrative embodiment, the control unit 93 counts the number of rotations of the developing roller 2. However, for example, the control unit 93 may be configured to count the number of rotations of the agitator 6 or to measure a remaining amount of toner in the toner accommodating portion 5. In this case, the control unit 93 resets the number of rotations of the agitator 6 or the measured value of the remaining amount of toner in the toner accommodating portion 5 when it is determined that an unused (new product) developing cartridge 1 has been mounted.

The above illustrative embodiment and modified embodiments may be combined with each other.

The disclosure provides illustrative, non-limiting aspects as follows:

According to an aspect of the disclosure, there is provided a cartridge including: a housing configured to accommodate therein developer; a driving receiving part configured to rotate by receiving a driving force; a rotary member configured to rotate from a first position by receiving a driving force from the driving receiving part; and a detected member including a detected part and configured to move in an axis direction parallel with a rotational axis of the rotary member while being restrained from rotating, by receiving a driving force from the rotary member, wherein the detected member includes a first restraint part configured to restrain the rotation of the rotary member at the first position.

According to the above configuration, it is possible to move the detected member only in the axis direction while restraining the rotation thereof.

For this reason, as compared to a configuration where the detected part is moved in a rotation direction in accordance with the rotation of the detected member, it is possible to save a moving trajectory space of the detected member.

Also, the rotary member is restrained from rotating at the first position before it is rotated. After the driving force is input to the driving receiving part, the rotary member is rotated from the first position. Thereby, the detected member is moved in the axis direction.

That is, it is possible to prevent the rotary member from receiving the driving force at an unintentional posture.

Also, after the driving force is input to the driving receiving part, the detected member is moved at predetermined timing by the rotation of the rotary member. Thereby, it is possible to enable an external device to recognize that an unused cartridge has been mounted.

Also, since the rotation of the rotary member is restrained by the first restraint part of the detected member, it is possible to restrain the rotation of the rotary member by keeping a relative arrangement between the detected member and the rotary member.

In the above cartridge, the rotary member may include an operating part configured to apply a force for moving the detected member in the axis direction to the detected member. The detected member may have an abutment part on which the operating part is configured to abut.

According to the above configuration, it is possible to enable the operating part to abut on the abutment part, thereby transmitting the driving force of the rotary member to the detected member.

In the above cartridge, the first restraint part may be arranged next to the abutment part in a rotating direction of the rotary member and continues to the abutment part.

According to the above configuration, the first restraint part and the abutment part are continuous in the rotating direction of the rotary member.

For this reason, when the rotary member is rotated by the driving force from the driving receiving part, the operating part of the rotary member continuously abuts from the first restraint part to the abutment part.

As a result, after the driving force is input to the driving receiving part, it is possible to smoothly transmit the driving force of the rotary member to the detected member.

In the above cartridge, the first restraint part may include a flat surface continuing to the abutment part.

According to the above configuration, when the rotary member is rotated, the operating part of the rotary member continuously abuts from the first restraint part to the abutment part by the flat surface.

As a result, it is possible to smoothly deliver the operating part of the rotary member from the first restraint part to the abutment part.

In the above cartridge, the first restraint part may include an inclined part, which is inclined in a direction from the detected member to the rotary member towards a downstream side in a rotating direction of the rotary member and arranged at the downstream side of the operating part in the rotating direction of the rotary member when the rotary member is at the first position.

According to the above configuration, before the driving force is input to the driving receiving part, the operating part interferes with the inclined part of the first restraint part, so that the rotary member is retrained from rotating in the rotating direction.

Also, when the driving force is input to the driving receiving part, the rotary member presses the inclined part of the first restraint part at the operating part.

At this time, it is possible to smoothly move the detected member in a direction separating from the rotary member due to the inclination of the inclined part.

As a result, it is possible to keep the rotary member at a stopped state until the driving force is input to the driving receiving part, and it is possible to smoothly rotate the rotary member after the driving force is input to the driving receiving part.

In the above cartridge, the first restraint part may include an extension part extending in the axis direction and arranged at an upstream side of the operating part in the rotating direction of the rotary member when the rotary member is at the first position.

According to the above configuration, it is possible to restrain the rotary member at the first position from both sides in the rotating direction by the extension part and the first restraint part.

Also, since the extension part extends in the axis direction, it is possible to reliably restrain the rotary member from being rotated in an opposite direction of the rotating direction.

As a result, it is possible to restrain the rotary member at the first position until the driving force is input to the driving receiving part.

In the above cartridge, the abutment part may include a first abutment part and a second abutment part arranged next to the first abutment part in a rotating direction of the rotary member.

According to the above configuration, when the rotary member is rotated, the operating part of the rotary member sequentially abuts on the first and second abutment parts of the detected member.

Thereby, it is possible to move the detected member a plurality of times after the driving force is input to the driving receiving part.

The above cartridge may further include a covering member including a covering part that faces the detected member from an opposite side of the rotary member in the axis direction.

According to the above configuration, when the detected member is not detected by the external device, the detected member is covered with the covering part, so that it is possible to reliably prevent an interference with a surrounding member.

In the above cartridge, the rotary member may be configured to rotate from the first position to a second position. The covering member may include a second restraint part configured to restrain the rotary member from rotating in a rotating direction of the rotary member at the second position.

According to the above configuration, after the rotary member is rotated, it is possible restrain the rotary member at the second position by the second restraint part.

As a result, when the rotary member is rotated, it is possible to rotate the rotary member from the first position by a predetermined driving amount and then to stop the same at the second position.

In the above cartridge, the detected member may include a third restraint part configured to restrain the rotary member from rotating in an opposite direction of the rotating direction of the rotary member at the second position.

According to the above configuration, it is possible to restrain the rotary member at the second position from both sides in the rotating direction by the second restraint part and the third restraint part.

As a result, it is possible to reliably restrain the rotary member at the second position after the rotary member is rotated.

The above cartridge may further include, an urging member abutting on the covering part and the detected member to urge the detected member towards the housing.

According to the above configuration, it is possible to reliably retreat the detected member in the direction from the covering part towards the rotary member by the urging force of the urging member.

In the above configuration, at least one of the covering member and the housing may include a support part that supports the rotary member and the detected member.

According to the above configuration, it is possible to support the rotary member and the detected member while reducing the number of components by using at least one of the covering member and the housing.

In the above cartridge, the support part may include a first support part provided to the covering member and a second support part provided to the housing. The detected member may be supported by the first support part. The rotary member may be supported by the second support part.

According to the above configuration, it is possible to rotate the rotary member at a position close to the housing by supporting the rotary member by the second support part.

Thereby, it is possible to stably rotate the rotary member.

Further, the detected member is supported by the first support part of the covering member positioned at an outer side than the housing in the axis direction.

For this reason, it is possible to stably move the detected member towards the outer side in the axis direction.

As a result, it is possible to stably move the detected member towards the outer side in the axis direction by the driving force input from the rotary member being stably rotated.

In the above cartridge, the housing may include a filling port for filling the developer inside the housing, and a closing member that closes the filling port. The support part may be provided to the closing member.

According to the above configuration, it is possible to support the rotary member and the detected member while reducing the number of components by using the closing member closing the filling port.

The above cartridge may further include a transmission member configured to rotate by receiving the driving force from the driving receiving part, and including a transmitting part configured to transmit the driving force to the rotary member and an engaging part provided at a position different from the transmitting part and configured to move in accordance with the rotation of the transmission member. The rotary member may include a transmitted part configured to abut on the transmitting part and an engaged part configured to abut on the engaging part. The rotary member may be configured to move from the first position at which an abutting state between the transmitted part and the transmitting part is released to a driving position at which the transmitted part abuts on the transmitting part due to the engaging part abutting on the engaged part.

According to the above configuration, it is possible to operate the cartridge with the rotary member being stopped after the driving force is input from the outside to the driving receiving part and until the engaging part of the transmission member abuts on the engaged part of the rotary member.

Thereafter, the engaging part of the transmission member abuts on the engaged part of the rotary member, so that it is possible to transmit the driving force from the transmission member to the rotary member.

Thereby, after the cartridge operates stably, the driving force is transmitted from the transmission member to the rotary member, thereby moving the detected member.

As a result, it is possible to enable the external device to detect the detected part while the cartridge is stably operating.

In the above cartridge, the rotary member may be configured to move between the first position and a retreat position at which the engaged part is retreated from a moving trajectory of the engaging part in accordance with the rotation of the transmission member, before receiving the driving force. The detected member may include a fixing part configured to fix a position of the rotary member at the retreat position.

According to the above configuration, if the driving force is input to the driving receiving part with the rotary member being fixed at the retreat position, it is possible to check the driving transmission of the cartridge at a state where the transmission of the driving force from the transmission member to the rotary member is released.

In the above cartridge, the detected member may include a notched portion notched in a direction away from the transmission member. At least a portion of the transmission member may be positioned within the notched portion.

According to the above configuration, it is possible to closely arrange the detected member and the transmission member so that at least a part of the transmission member is located in the notched portion.

As a result, it is possible to make the cartridge small.

The above cartridge may further include a developer carrier configured to carry thereon the developer.

According to the above configuration, in the configuration where the developer carrier is provided, it is possible to protect the detected part and to move the detected member at predetermined timing.

The above cartridge may further include a guide part configured to guide movement of the detected member in the axis direction.

According to the above configuration, it is possible to stably move the detected member in the axis direction.

According to another aspect of the disclosure, there is provided a cartridge including: a housing configured to accommodate therein developer; a driving receiving part configured to rotate by receiving a driving force; a rotary member configured to rotate by receiving the driving force from the driving receiving part, and a detected member including a detected part and configured to move in an axis direction along a rotational axis of the rotary member while being restrained from rotating, by receiving a driving force from the rotary member, wherein the detected member is configured to move from an original position to a first advance position more advanced towards a direction away from the housing than the original position, upon a first movement after receiving the driving force from the rotary member, and then move from the first advance position to a second advance position more advanced towards the direction away from the housing than the first position.

According to the above configuration, after the driving force is input to the driving receiving part, the detected member is temporarily moved from the original position to the first spaced position, and then to the second advance position at predetermined timing. Thereby, it is possible to enable the external device to recognize that the unused cartridge has been mounted.

According to the cartridge of the disclosure, it is possible to enable the external device to recognize that the unused cartridge has been mounted.

What is claimed is:

1. A cartridge comprising:

a housing configured to accommodate therein developer;

a driving receiving part configured to rotate by receiving a driving force;

a rotary member configured to rotate from a first position by receiving a driving force from the driving receiving part; and a detected member including a detected part and configured to move in an axis direction parallel with a rotational axis of the rotary member while being restrained from rotating, by receiving a driving force from the rotary member, wherein the detected member includes a first restraint part configured to restrain the rotation of the rotary member at the first position, wherein the rotary member includes an operating part configured to apply a force or moving the detected member in the axis direction to the detected member, wherein the detected member has an abutment art on which the operating part is configured to abut, and wherein the first restraint part is arranged next to the abutment part in a rotating direction of the rotary member and continues to the abutment part.

2. The cartridge according to claim 1, wherein the first restraint part includes a flat surface continuing to the abutment part.

3. The cartridge according to claim 1, wherein the first restraint part includes an inclined part, which is inclined in a direction from the detected member to the rotary member towards a downstream side in a rotating direction of the rotary member and arranged at the downstream side of the operating part in the rotating direction of the rotary member when the rotary member is at the first position.

4. The cartridge according to claim 1, wherein the first restraint part includes an extension part extending in the axis direction and arranged at an upstream side of the operating part in the rotating direction of the rotary member when the rotary member is at the first position.

5. The cartridge according to claim 1, wherein the abutment part includes a first abutment part and a second abutment part arranged next to the first abutment part in a rotating direction of the rotary member.

6. The cartridge according to claim 1, further comprising:

a covering member including a covering part that faces the detected member from an opposite side of the rotary member in the axis direction.

7. The cartridge according to claim 6, wherein the rotary member is configured to rotate from the first position to a second position, and wherein the covering member includes a second restraint part configured to restrain the rotary member from rotating in a rotating direction of the rotary member at the second position.

8. The cartridge according to claim 7, wherein the detected member includes a third restraint part configured to restrain the rotary member from rotating in an opposite direction of the rotating direction of the rotary member at the second position.

9. The cartridge according to an claim 6, further comprising:

an urging member abutting on the covering part and the detected member to urge the detected member towards the housing.

10. The cartridge according to claim 6, wherein at least one of the covering member and the housing includes a support part that supports the rotary member and the detected member.

11. The cartridge according to claim 10, wherein the support part includes a first support part provided to the covering member and a second support part provided to the housing, wherein the detected member is supported by the first support part, and wherein the rotary member is supported by the second support part.

12. The cartridge according to claim 10, wherein the housing includes a filling port for filling the developer inside the housing, and a closing member that closes the filling port, and wherein the support part is provided to the closing member.

13. The cartridge according to claim 1, further comprising:

a transmission member configured to rotate by receiving the driving force from the driving receiving part, and including a transmitting part configured to transmit the driving force to the rotary member and an engaging part provided at a position different from the transmitting part and configured to move in accordance with the rotation of the transmission member, wherein the rotary member includes a transmitted part configured to abut on the transmitting part and an engaged part configured to abut on the engaging part, and wherein the rotary member is configured to move from the first position at which an abutting state between the transmitted part and the transmitting part is released to a driving position at which the transmitted part abuts on the transmitting part due to the engaging part abutting on the engaged part.

14. The cartridge according to claim 13, wherein the rotary member is configured to move between the first position and a retreat position at which the engaged part is retreated from a moving trajectory of the engaging part in accordance with the rotation of the transmission member, before receiving the driving force, and wherein the detected member includes a fixing part configured to fix a position of the rotary member at the retreat position.

15. The cartridge according to claim 13, wherein the detected member includes a notched portion notched in a direction away from the transmission member, and wherein at least a portion of the transmission member is positioned within the notched portion.

16. The cartridge according to claim 1, further comprising:

a developer carrier configured to carry thereon the developer.

17. The cartridge according to claim 1, further comprising:

a guide part configured to guide movement of the detected member in the axis direction.

18. A cartridge comprising:

a housing configured to accommodate therein developer;

a driving receiving part configured to rotate by receiving a driving force;

a rotary member configured to rotate from a first position by receiving a driving force from the driving receiving part; and a detected member including a detected part and configured to move in an axis direction parallel with a rotational axis of the rotary member while being restrained from rotating, by receiving a driving force from the rotary member, wherein the detected member includes a first restraint part configured to restrain the rotation of the rotary member at the first position, wherein the rotary member includes an operating part configured to apply a force for moving the detected member in the axis direction to the detected member, wherein the detected member has an abutment part on which the operating part is configured to abut, and wherein the first restraint part includes an inclined part, which is inclined in a direction from the detected member to the rotary member towards a downstream side in a rotating direction of the rotary member and arranged at the downstream side of the operating part in the rotating direction of the rotary member when the rotary member is at the first position.

19. A cartridge comprising:

a housing configured to accommodate therein developer;

a driving receiving part configured to rotate by receiving a driving force;

a rotary member configured to rotate from a first position by receiving a driving force from the driving receiving part; and a detected member including a detected part and configured to move in an axis direction parallel with a rotational axis of the rotary member while being restrained from rotating, by receiving a driving force from the rotary member, wherein the detected member includes a first restraint part configured to restrain the rotation of the rotary member at the first position, wherein the rotary member includes an operating part configured to apply a force for moving the detected member in the axis direction to the detected member, wherein the detected member has an abutment part on which the operating part is configured to abut, and wherein the first restraint part includes an extension part extending in the axis direction and arranged at an upstream side of the operating part in the rotating direction of the rotary member when the rotary member is at the first position.

20. A cartridge comprising:

a housing configured to accommodate therein developer;

a driving receiving part configured to rotate by receiving a driving force;

a rotary member configured to rotate from a first position by receiving a driving force from the driving receiving part;

a detected member including a detected part and configured to move in an axis direction parallel with a rotational axis of the rotary member while being restrained from rotating, by receiving a driving force from the rotary member; and a covering member including a covering part that faces the detected member from an opposite side of the rotary member in the axis direction, wherein the detected member includes a first restraint part configured to restrain the rotation of the rotary member at the first position, wherein the rotary member is configured to rotate from the first position to a second position, and wherein the covering member includes a second restraint part configured to restrain the rotary member from rotating in a rotating direction of the rotary member at the second position.

* * * * *